US010433098B2

(12) United States Patent
Karapetyan et al.

(10) Patent No.: US 10,433,098 B2
(45) Date of Patent: Oct. 1, 2019

(54) APPARATUS AND METHOD FOR GENERATING A FILTERED AUDIO SIGNAL REALIZING ELEVATION RENDERING

(71) Applicant: Fraunhofer-Gesellschaft zur Foerderung der angewandten Forschung e.V., Munich (DE)

(72) Inventors: Aleksandr Karapetyan, Erlangen (DE); Jan Plogsties, Fuerth (DE); Felix Fleischmann, Stein (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/960,881

(22) Filed: Apr. 24, 2018

(65) Prior Publication Data

US 2018/0249279 A1 Aug. 30, 2018

Related U.S. Application Data

(63) Continuation of application No. PCT/EP2016/075691, filed on Oct. 25, 2016.

(30) Foreign Application Priority Data

Oct. 26, 2015 (EP) ..... 15191542

(51) Int. Cl.
*H04S 7/00* (2006.01)
*H04R 3/04* (2006.01)
*H04S 3/00* (2006.01)

(52) U.S. Cl.
CPC ..... *H04S 7/307* (2013.01); *H04R 3/04* (2013.01); *H04S 3/008* (2013.01); *H04S 7/302* (2013.01);

(Continued)

(58) Field of Classification Search
CPC ..... H04S 7/00; H04R 3/04

(Continued)

(56) References Cited

U.S. PATENT DOCUMENTS

2004/0196991 A1 10/2004 Iida et al.
2004/0247144 A1* 12/2004 Nelson ..... H04S 5/00 381/300

(Continued)

FOREIGN PATENT DOCUMENTS

AU 2015234454 B2 11/2017
AU 2016266052 B2 11/2017

(Continued)

OTHER PUBLICATIONS http://www.f07.fh-koeln.de/einrichtungen/nachrichtentechnik/forschung_kooperationen/aktuelle_projekte/asar/00534/index.html.

(Continued)

*Primary Examiner* — Melur Ramakrishnaiah
(74) *Attorney, Agent, or Firm* — Perkins Coie LLP; Michael A. Glenn

(57) ABSTRACT

An apparatus for generating a filtered audio signal from an audio input signal includes a filter information determiner being configured to determine filter information depending on input height information wherein the input height information depends on a height of a virtual sound source. Moreover, the apparatus includes a filter unit being configured to filter the audio input signal to obtain the filtered audio signal depending on the filter information. The filter information determiner is configured to determine the filter information using selecting, depending on the input height information, a selected filter curve from a plurality of filter curves, or the filter information determiner is configured to determine the filter information using determining a modi- (Continued)

fied filter curve by modifying a reference filter curve depending on the elevation information.

26 Claims, 53 Drawing Sheets

(52) U.S. Cl.
CPC ..... *H04S 7/303* (2013.01); *H04S 2400/11* (2013.01); *H04S 2400/15* (2013.01); *H04S 2420/01* (2013.01); *H04S 2420/07* (2013.01)

(58) Field of Classification Search
USPC ..... 381/303, 56, 310
See application file for complete search history.

(56) References Cited

U.S. PATENT DOCUMENTS

| | | | | |
|---|---|---|---|---|
| 2009/0046864 | A1 | 2/2009 | Mahabub et al. | |
| 2010/0266133 | A1 | 10/2010 | Nakano | |
| 2012/0008789 | A1* | 1/2012 | Kim | H04S 3/002 381/17 |
| 2014/0064527 | A1 | 3/2014 | Walther et al. | |
| 2016/0044434 | A1* | 2/2016 | Chon | H04S 5/005 381/18 |

FOREIGN PATENT DOCUMENTS

| | | | | |
|---|---|---|---|---|
| CA | 2943670 | A1 | 10/2015 | |
| EP | 1596627 | A2 | 11/2005 | |
| EP | 2802161 | A1 * | 11/2014 | H04S 5/00 |
| EP | 2802161 | A1 | 11/2014 | |
| EP | 2925024 | A1 * | 9/2015 | H04S 7/301 |
| EP | 2925024 | A1 | 9/2015 | |
| EP | 2981101 | A1 | 2/2016 | |
| EP | 3125240 | A1 | 2/2017 | |
| JP | H07-231500 | A | 8/1995 | |
| JP | H07-241000 | A | 9/1995 | |
| JP | 2003-102099 | A | 4/2003 | |
| JP | 2010-520671 | A | 6/2010 | |
| RU | 2013154768 | A | 6/2015 | |
| WO | 2010122455 | A1 | 10/2010 | |
| WO | 2014157975 | A1 | 10/2014 | |
| WO | 2015147530 | A1 | 10/2015 | |

OTHER PUBLICATIONS

"Akustik—Richtungsbander", https://commons.wikimedia.org/wiki/File:Akustik_-Richtungsb%C3%A4nder.svg.
"Equivalent Rectangular Bandwidth", https://ccrma.stanford.edu/~jos/bbt/Equivalent_Rectangular_Bandwidth.html.
"Haas-Effekt", Haas-Effekt und Präzedenz-Effekt (Gesetz der ersten Wellenfront) Dec. 2003.
"Praktische Daten Zur Stereo-Lookalisation", Praktische Daten zur Lokalisation von Phantomschallquellen bei 'Intensitäts.'-und Laufzeit-Stereofonie, Jan. 2009.
"Real Cepstrum and Minimum Phase Reconstruction", http://www.mathworks.com/matlabcentral/mlc-downloads/downloads/submissions/43856/versions/8/screenshot.jpg—link inactive.
"SOFiA Sound Field Analysis Toolbox for MATLAB".
Abel, Jonathan S. et al., "A Simple, Robust Measure of Reverberation Echo Density", AES 121st Convention, Oct. 5-8, 2006, Oct. 2006.
Bernschutz, B., "Bandwidth Extension for Microphone Arrays", AES 8751, Oct. 2012.
Bernschutz, B. et al., "Entwurf und Aufbau eines variabel spharischen Mikrofonarrays für Forschungsanwendungen in Raumakustik und Virtual Audio", DAGA 2010, Berlin, 2010.
Brandner, M. et al., "Richtungsdetektion mit dem Eigenmike Mikrofonarray, Messung und Analyse", IEM, Kunst Uni Graz, 2013.
Cherry, E.C., "Some experiments on the recognition of speech with one and with two ears", J. Acoustical Soc. Am. vol. 25, pp. 975-979 (1953) 1953, pp. 975-979.
Farina, A, "Advances in Impulse Response Measurements by Sine Sweeps", AES Convention 122. Vienna, Mai, 2007.
Fleischmann, F., "Messung, Vergleich and psychoakustische Evaluierung von Kopfhörer-Übertragungsmaßen", FAU Erlangen, Thesis, 2011.
Gunther, Theile, "On the Standardization of the Frequency Response of High Quality Studio Headphones", AES convention 77, 1985.
Heinrich, Kuttruff, "Room Acoustics", Fourth Edition, Spon Press, 2000.
Jens, Blauert, "Raumliches Horen", S. Hirzel Verlag, Stuttgart, 1974.
Jot, Jean-Marc, "Analysis and synthesis of room reverberation based on a statistical time-frequency model", Proceedings of the 103rd AES Convention, preprint 4629, New York, Sep. 26-29, 1997, Sep. 1997.
Lindau, Alexander et al., "Perceptual Evaluation of Model- and Signal-Based Predictors of the Mixing Time in Binaural Room Impulse Responses", J. Audio Eng. Soc., vol. 60, No. 11, Nov. 2012.
Litovsky, Ruth Y. et al., "The Precedence Effect", J. Acoust. Soc. Am vol. 106, No. 4. Pt. 1., Oct. 1999.
Minhaar, P., "Localization with Binaural Recordings from Artificial and Human Heads", Audio Eng. Soc., vol. 49, No. 5, May 2001.
Pulkki, V. et al., "How to Study and Develop Communication Acoustics", Wiley, https://play.google.com/books/reader?id=r_TqCAAAQBAJ&hl=de&printsec=frontcover&source=gbs_vpt_buy&pg=GBS.PA1.w.5.0.0, 2015.
Rubak, Per et al., "Artificial reverberation based on a pseudo-random impulse response", Proceedings of the 104th AES Convention, preprint 4875, Amsterdam, Netherlands, May 16-19, 1998., May 1998.
Rubak, Per et al., "Artificial reverberation based on a pseudo-random impulse response II", Proceedings of the 106th AES Convention, preprint 4875, Munich, Germany, May 8-11, 1999. May 1999.
Sank, J.R., "Improved Real-Ear Test for Stereophones", J. Audio Eng Soc 28 (1980), Nr. 4, S.206-218, 1980.
Silzle, A, "Vision and Technique behind the New Studios and Listening Rooms of the Fraunhofer IIS Audio Laboratory", AES 7672, May 2009.
Spikofski, G. et al., "Das Diffusfeldsonden-Übertragungsmass eines Studiokopfhörers", Rundfunktechnische Mitteilung Nr. 3, 1988.
Spors, Sascha et al., "First Database of Audio-Visual Scenarios", (Dec. 1, 2014), URL: http://twoears.aipa.tu-berlin.de/wp-content/uploads/deliverables/D1.1_first_database_of_audio-visual_scenarios.pdf, (Jan. 18, 2017), XP055336680, Nov. 30, 2014.
Stevens, Stanley S., "Psychoacoustics", John Wiley & Sons, 1975.
Tomasz, Wozniak, "Code & Sound", (May 3, 2015), URL: https://codeandsound.wordpress.com/tag/hrtf/, (Jan. 18, 2017), XP055336705.
Von Ruschkowski, Arne, "Loudness of Music: An empirical study on the influence of Organism variables on the perception of volume", dissertation to obtain the dignity of Doctor of Philosophy of the Department of Cultural History and cultural studies the University of Hamburg, 2013.
Weinzierl, S. et al., "Generalized multiple sweep measurement", AES Convention 126, 7767. Munich, May 2009.
Weinzierl, S. et al., "Handbuch der Audiotechnik", Springer, 2008—see: https://rd.springer.com/book/10.1007%2F978-3-540-34301-1, 2008.
Williams, E.G., "Fourier Acoustics: Sound Radiation and Nearfield Acoustical", E. G. Williams, Fourier Acoustics: Sound Radiation and Nearfield Acoustical Holography, Academic Press, 1999.
Wolfgang, Hrauda, "Essentials on HRTF Measurement and Storage Format Standardization", Bachelor Thesis (Jun. 14, 2013), URL: http://iem.kug.ac.at/fileadmin/media/iem/projects/2013/hrauda.pdf, (Jan. 18, 2017), XP055336668, Jun. 14, 2013, pp. 1-55.
Zotter, F, "Analysis and Synthesis of Sound-Radiation with Spherical Arrays", Dissertation, University of Music and Performing Arts Graz, 2009.

* cited by examiner

APPARATUS AND METHOD FOR GENERATING A FILTERED AUDIO SIGNAL REALIZING ELEVATION RENDERING

CROSS-REFERENCE TO RELATED APPLICATIONS

This application is a continuation of copending International Application No. PCT/EP2016/075691, filed Oct. 25, 2016, which is incorporated herein by reference in its entirety, and additionally claims priority from European Application No. EP 15191542.8, filed Oct. 26, 2015, which is incorporated herein by reference in its entirety.

The present invention relates to audio signal processing, and, in particular, to an apparatus and method for generating a filtered audio signal realizing elevation rendering.

BACKGROUND OF THE INVENTION

In audio processing, amplitude panning is a concept, commonly applied. For example, considering stereo sound, it is a common technique to virtually locate a virtual sound source between two loudspeakers. To locate a virtual sound source far left to a sweet spot, corresponding sound is replayed with a high amplitude by the left loudspeaker and is replayed with a low amplitude by the right loudspeaker. The concept is equally applicable for binaural audio.

Moreover, similar concepts exist to pan virtual sound sources between loudspeakers in a horizontal plane and elevated loudspeakers. The approaches applied there, can however, not be similar be applied for binaural audio.

It would therefore be highly appreciated, if concepts for elevating or lowering virtual sound sources for binaural audio would be provided.

Similarly, it would be highly appreciated, if concepts for elevating or lowering virtual sound sources for loudspeakers would be provided, if all loudspeakers are located in the same plane, and if none of the loudspeakers are physically elevated or lowered with respect to the other loudspeakers.

SUMMARY

According to an embodiment, an apparatus for generating a filtered audio signal from an audio input signal may have: a filter information determiner being configured to determine filter information depending on input height information, wherein the input height information depends on a height of a virtual sound source, and a filter unit being configured to filter the audio input signal to obtain the filtered audio signal depending on the filter information, wherein the filter information determiner is configured to determine the filter information using selecting, depending on the input height information, a selected filter curve from a plurality of filter curves, or wherein the filter information determiner is configured to determine the filter information using determining a modified filter curve by modifying a reference filter curve depending on the elevation information.

According to another embodiment, a system may have: an apparatus for generating an filtered audio signal from an audio input signal, wherein the filter unit is configured to filter the audio input signal to obtain a binaural audio signal as the filtered audio signal having exactly two audio channels depending on the filter information, wherein the filter information determiner is configured to receive input information on an input head-related transfer function, and wherein the filter information determiner is configured to determine the filter information by determining a modified head-related transfer function by modifying the input head-related transfer function depending on the selected filter curve or depending on the modified filter curve; an apparatus for providing direction modification information, wherein the apparatus for providing direction modification information may have: a plurality of loudspeakers, wherein each of the plurality of loudspeakers is configured to replay a replayed audio signal, wherein a first one of the plurality of loudspeakers is located at a first position at a first height, and wherein second one of the of the plurality of loudspeakers is located at a second position being different from the first position at a second height, being different from the first height, two microphones, each of the two microphones being configured to record a recorded audio signal by receiving sound waves from each loudspeaker of the plurality of loudspeakers emitted by said loudspeaker when replaying the audio signal, a binaural room impulse response determiner being configured to determine a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and a filter curve generator being configured to generate at least one filter curve depending on two of the plurality of binaural room impulse responses, wherein the direction modification information depends on the at least one filter curve, wherein the filter information determiner of the apparatus for generating an filtered audio signal from an audio input signal is configured to determine filter information using selecting, depending on input height information, a selected filter curve from a plurality of filter curves, or wherein the filter information determiner of the apparatus for generating an filtered audio signal from an audio input signal is configured to determine the filter information using determining a modified filter curve by modifying a reference filter curve depending on the elevation information, wherein direction modification information provided by the apparatus for providing direction modification information includes the plurality of filter curves or the reference filter curve.

According to another embodiment, an apparatus for providing direction modification information may have: a plurality of loudspeakers, wherein each of the plurality of loudspeakers is configured to replay a replayed audio signal, wherein a first one of the plurality of loudspeakers is located at a first position at a first height, and wherein second one of the of the plurality of loudspeakers is located at a second position being different from the first position, at a second height, being different from the first height, two microphones, each of the two microphones being configured to record a recorded audio signal by receiving sound waves from each loudspeaker of the plurality of loudspeakers emitted by said loudspeaker when replaying the audio signal, a binaural room impulse response determiner being configured to determine a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and a filter curve generator being configured to generate at least one filter curve depending on two of the plurality of binaural room impulse responses, wherein the direction modification information depends on the at least one filter curve.

According to another embodiment, a method for generating a filtered audio signal from an audio input signal may have the steps of: determining filter information depending on input height information wherein the input height information depends on a height of a virtual sound source, and filtering the audio input signal to obtain the filtered audio signal depending on the filter information, wherein determining the filter information is conducted using selecting, depending on the input height information, a selected filter curve from a plurality of filter curves, or wherein determining the filter information is conducted using determining a modified filter curve by modifying a reference filter curve depending on the elevation information.

According to another embodiment, a method for providing direction modification information may have the steps of for each loudspeaker of a plurality of loudspeakers, replaying a replayed audio signal by said loudspeaker and recording sound waves emitted from said loudspeaker when replaying said replayed audio signal by two microphones to obtain a recorded audio signal for each of the two microphones, wherein a first one of the plurality of loudspeakers is located at a first position at a first height, and wherein second one of the of the plurality of loudspeakers is located at a second position being different from the first position, at a second height, being different from the first height, determining a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and generating at least one filter curve depending on two of the plurality of binaural room impulse responses, wherein the direction modification information depends on the at least one filter curve.

According to another embodiment, a non-transitory digital storage medium may have a computer program stored thereon to perform any of the inventive methods when said computer program is run by a computer.

An apparatus for generating a filtered audio signal from an audio input signal is provided. The apparatus comprises a filter information determiner being configured to determine filter information depending on input height information wherein the input height information depends on a height of a virtual sound source. Moreover, the apparatus comprises a filter unit being configured to filter the audio input signal to obtain the filtered audio signal depending on the filter information. The filter information determiner is configured to determine the filter information using selecting, depending on the input height information, a selected filter curve from a plurality of filter curves, or the filter information determiner is configured to determine the filter information using determining a modified filter curve by modifying a reference filter curve depending on the elevation information.

Moreover, an apparatus for providing direction modification information is provided. The apparatus comprises a plurality of loudspeakers, wherein each of the plurality of loudspeakers is configured to replay a replayed audio signal, wherein a first one of the plurality of loudspeakers is located at a first position at a first height, and wherein second one of the of the plurality of loudspeakers is located at a second position being different from the first position, at a second height, being different from the first height. Moreover, the apparatus comprises two microphones, each of the two microphones being configured to record a recorded audio signal by receiving sound waves from each loudspeaker of the plurality of loudspeakers emitted by said loudspeaker when replaying the audio signal. Furthermore, the apparatus comprises a binaural room impulse response determiner being configured to determine a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker. Moreover, the apparatus comprises a filter curve generator being configured to generate at least one filter curve depending on two of the plurality of binaural room impulse responses. The direction modification information depends on the at least one filter curve.

Furthermore, a method for generating a filtered audio signal from an audio input signal is provided. The method comprises:

Determining filter information depending on input height information wherein the input height information depends on a height of a virtual sound source. And:

Filtering the audio input signal to obtain the filtered audio signal depending on the filter information.

Determining the filter information is conducted using selecting, depending on the input height information, a selected filter curve from a plurality of filter curves. Or, determining the filter information is conducted using determining a modified filter curve by modifying a reference filter curve depending on the elevation information.

Moreover, a method for providing direction modification information is provided. The method comprises:

For each loudspeaker of a plurality of loudspeakers, replaying a replayed audio signal by said loudspeaker and recording sound waves emitted from said loudspeaker when replaying said replayed audio signal by two microphones to obtain a recorded audio signal for each of the two microphones, wherein a first one of the plurality of loudspeakers is located at a first position at a first height, and wherein second one of the of the plurality of loudspeakers is located at a second position being different from the first position, at a second height, being different from the first height.

Determining a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker. And Generating at least one filter curve depending on two of the plurality of binaural room impulse responses. The direction modification information depends on the at least one filter curve.

Moreover, computer programs are provided wherein each of the computer programs is configured to implement one of the above-described methods when being executed on a computer or signal processor.

BRIEF DESCRIPTION OF THE DRAWINGS

Embodiments of the present invention will be detailed subsequently referring to the appended drawings, in which.

DETAILED DESCRIPTION OF THE INVENTION

Before the present invention is described in more detail, some concepts on which the present invention is based are described.

At first, room acoustics concepts are considered.

Figure 2:
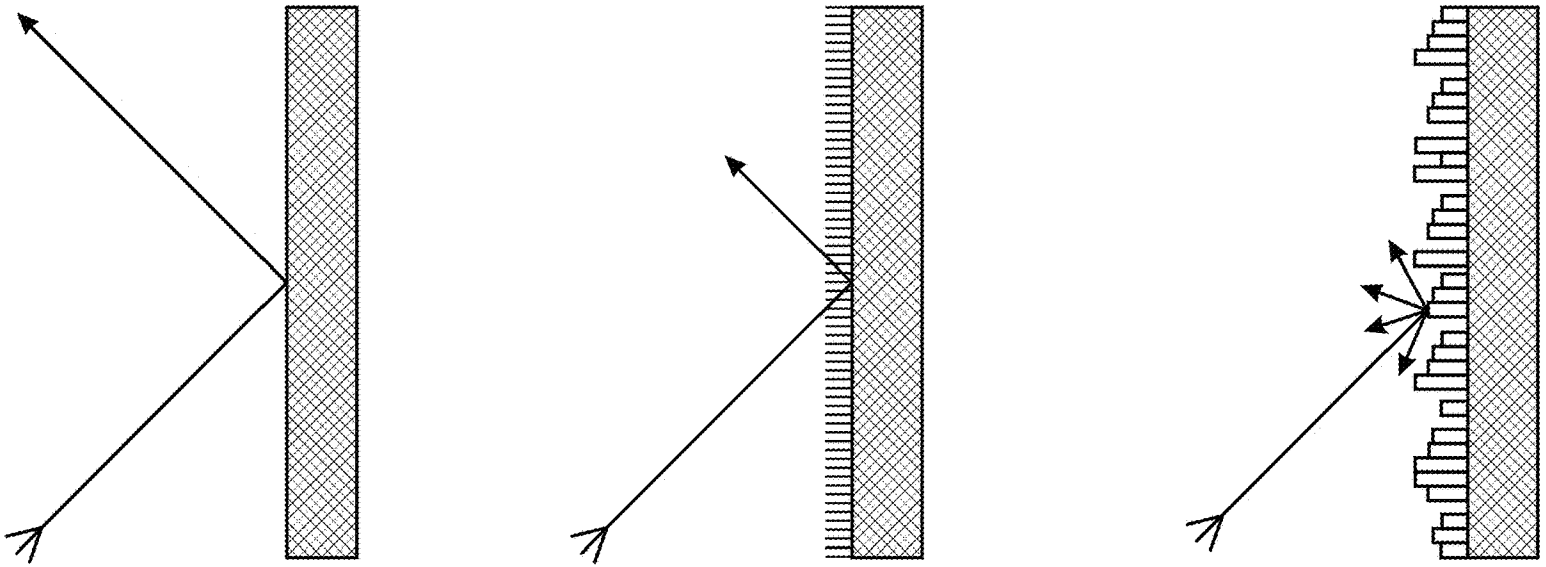
FIG. 2 depicts an illustration of the three types of reflections.

FIG. 2 depicts an illustration of the three types of reflections. The reflective surface (left) almost preserves the acoustical behavior of the incident sound, and whereby the absorbing and diffusing surfaces modify the sound stronger. Usually a combination of several types of surfaces is found.

There are many types of room reflections which affect the room acoustics and the sound impression. The sound wave reflected by a reflective surface may sound almost as loud and clear as the original sound. Whereas a reflection from an absorbing surface will have less intensity and mostly sound duller. Compared to the reflective and absorbing surface, where the incident and reflective sound waves have the same angle, the wave reflected on a diffusing surface propagates from there into all directions. An unclear and smeared sound impression occurs. Usually all kind of reflective behavior can be found and a mix of clear and unclear sounds forms the sound impression.

In reality a sound wave propagates in all directions from the sound source, in particular, as far as low frequencies are considered.

Figure 3:
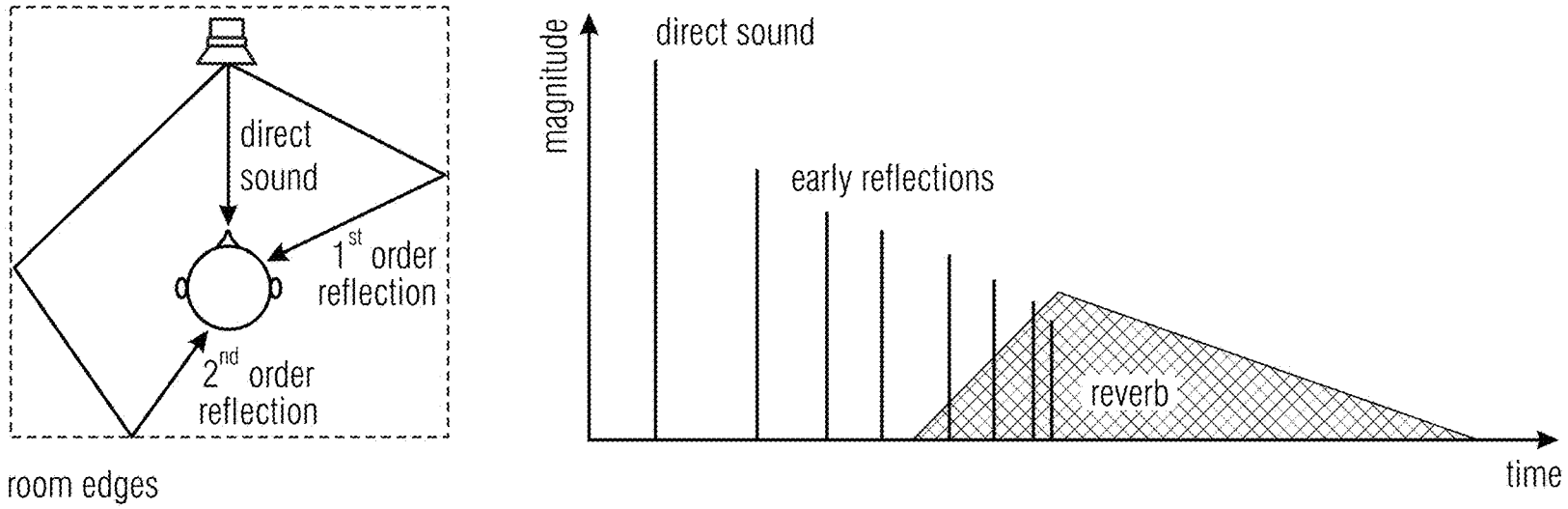
FIG. 3 illustrates a geometric representation of the reflections and a geometric representation of a temporal representation of the reflections.

FIG. 3 illustrates a geometric representation of the reflections (left) and a geometric representation of a temporal representation of the reflections (right). The direct sound arrives at the listener on a direct path and has the shortest distance (see FIG. 3 (left)). Depending on the geometry of the environment, many reflections and diffusely reflected parts will arrive at the listener afterwards from different directions. Depending on the order of each reflection and its path length, a temporal reflection distribution with an increasing density can be observed.

As can be seen in FIG. 3 (right), the time period with the low reflection density is defined as the early reflection period. In contrast, the part with the high density is called reverberant field. There are different investigations dealing with the transition point between the early reflections and the reverb. In [001] and [002] a reflection rate on the order of 2000-4000 echoes/s is defined as a measure for transition. Here, reverb may, for example, be interpreted as "statistically reverb".

Now, binaural listening is described.

At first, Localization Cues are considered.

The human auditory system uses both ears for analyzing the position of the sound source. There is a differentiation between the localization on the horizontal and the median plane.

Figure 4:
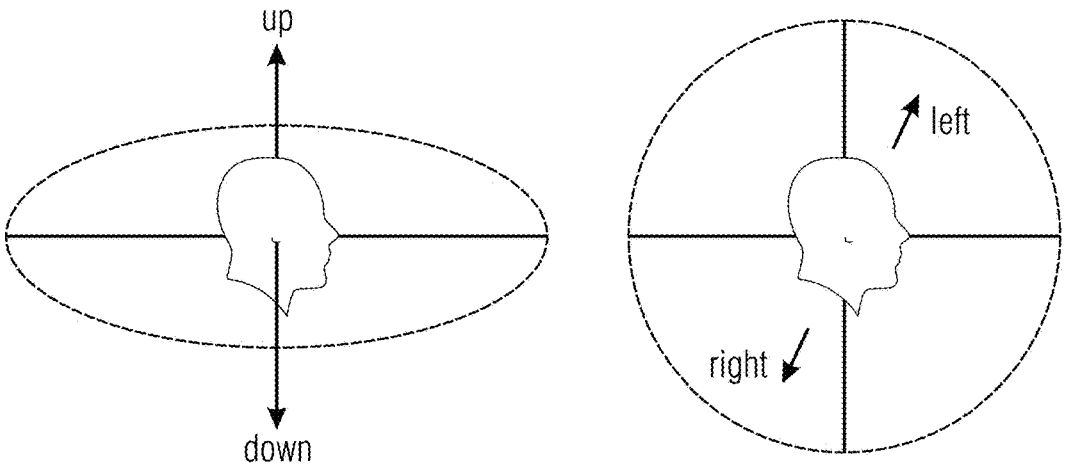
FIG. 4 depicts an illustration of the horizontal and the median plane for localization tasks.

FIG. 4 depicts an illustration of the horizontal and the median plane for localization tasks.

On the horizontal plane we distinguish whether the sound comes from the left or the right side. In this case two parameters may be used. The first parameter is the Interaural Time Difference (ITD). The distance traveled by the sound wave from the sound source to the left and right ear will differ, causing the sound to reach the ipsilateral ear (the ear closest to the source) earlier than the contralateral ear (the ear farthest from the source). The resulting time difference is the ITD. The ITD is minimal, for example, zero, if the source is exactly in front or behind the listeners head and it is maximal, if it is completely on the left or the right side.

The second parameter is the Interaural Level Difference (ILD). When the wavelengths of the sound are short relative to the head size, the head acts as an acoustical shadow, or as an obstacle, attenuating the sound pressure level of the wave reaching the contralateral ear.

The analysis of the localization is frequency dependent Below 800 Hz, where the wavelength is long relative to the head size, the analysis is based on the ITD while evaluating the phase differences between both ears. Above 1600 Hz the analysis is based on the ILD and the evaluation of the group delay differences. Below, e.g., 100 Hz, localization may, e.g., not be possible. In the frequency range between those two limits there is an overlapping of the analysis methods.

On the median plane vertical directions are evaluated, as well as whether the sound is in front or behind the listener. The auditory system obtains the information from the filtering effect of the pinnae. As already investigated by Jens Blauert (see [003]) only the amplification of certain frequency ranges is substantial for the localization on the median plane, while listening to a natural sound source. Since there are no evaluable ITDs or ILDs at the ears, the auditory system is able to get the information from the signal spectrum. For instance, an increasing of the range between 7-10 kHz leads the listener to perceive the sound from above (see FIG. 5).

Figure 5:
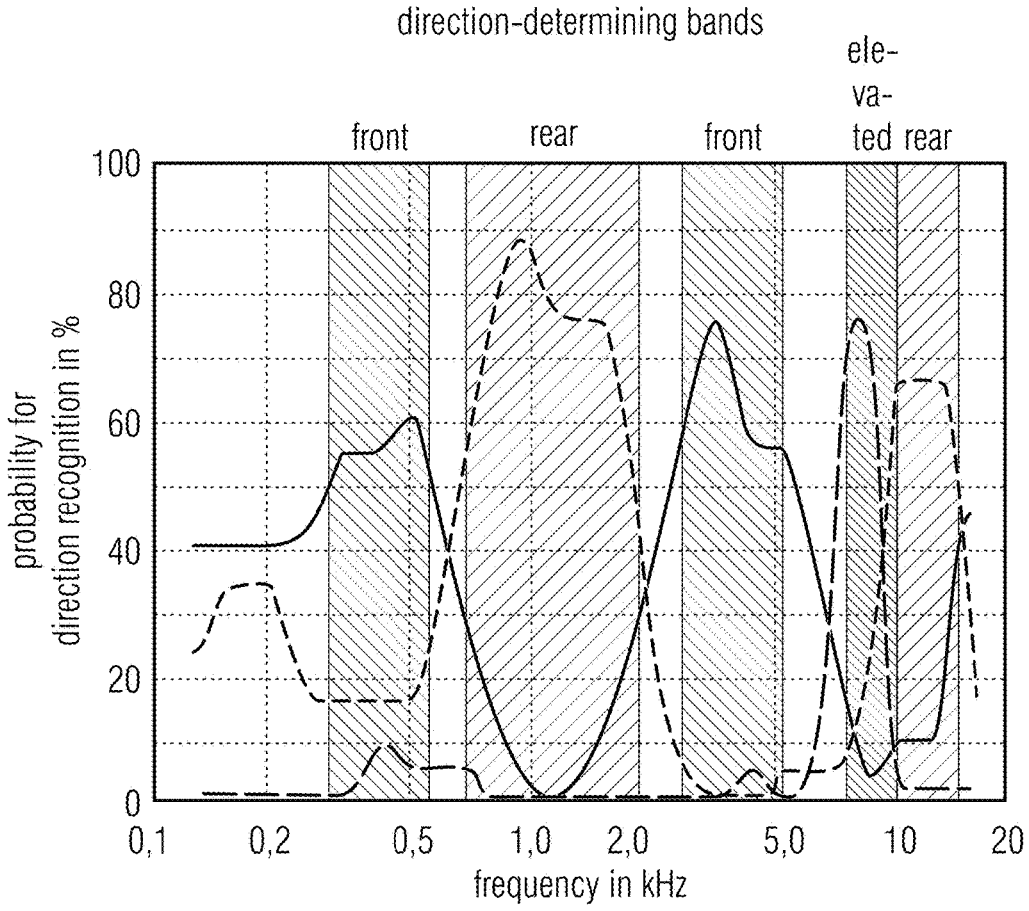
FIG. 5 shows a directional hearing in the median plane.

FIG. 5 shows a directional hearing in the median plane. The localization on the median plane is strongly correlated to the amplification of certain frequency ranges of the signal spectrum (see [004])

In terms of signal processing, the localization cues mentioned already are collectively known as head related transfer functions (HRTFs) in the frequency domain or in the time domain as head related impulse responses (HRIRs). Referring to the room acoustics, the HRIRs are comparable to the direct sounds arriving at each ear of the listener. Furthermore, the HRIRs also comprise complex interactions of the sound waves with the shoulders and the torso. Since these (diffusive) reflections arrive at the ears almost simultaneously with the direct sound, there is a strong overlapping. For this reason they are not considered separately.

Reflections will also interact with the outer ear, as well as with the shoulders and the torso. Thus, depending on the incident direction of the reflection, it will be filtered by the corresponding HRTFs before being evaluated by the auditory system. The measurements of the room impulse responses at each ear are defined as binaural room impulse responses (BRIRs) and in the frequency domain as binaural room transfer functions (BRTFs).

Now, virtual sound sources are considered. In reality when the listener hears a sound coming from a natural source in a natural environment, he compares the given acoustics to the stimulus pattern stored in the brain in order to localize the source. If the acoustics are similar to the stored pattern, the listener will easily localize the source. Making use of binaural room impulse responses, it is possible to create a naturally sounding virtual environment over headphones.

Figure 6:
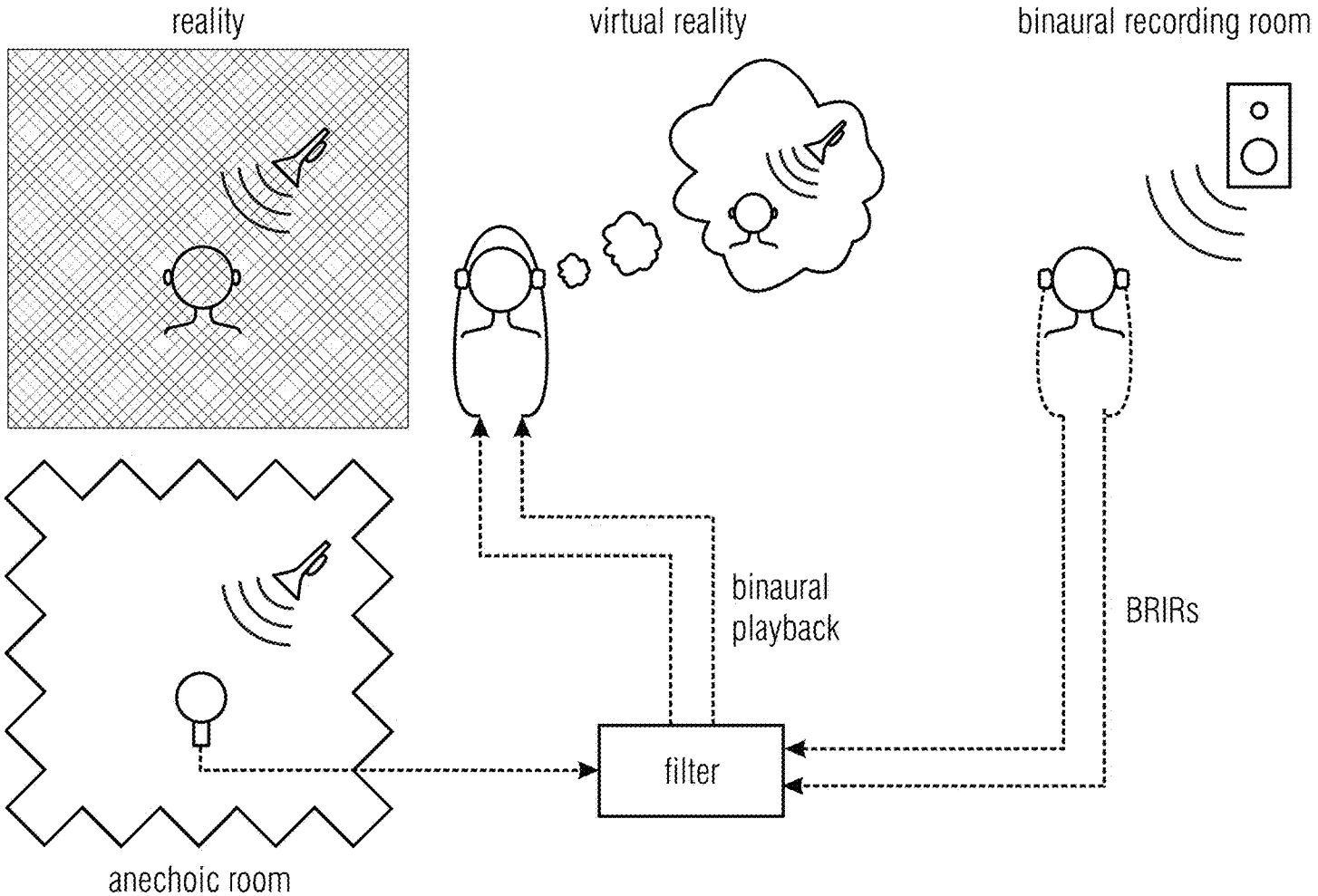
FIG. 6 illustrates creating virtual sound sources.

FIG. 6 illustrates creating virtual sound sources. The recorded sound is filtered with the BRIRs being measured in another environment and played back over headphones while positioning the sound in a virtual room.

As illustrated in FIG. 6, a loudspeaker is used as sound source playing back an excitation signal. For each desired position, the loudspeaker is measured by a binaural measurement head, comprising microphones in each ear to create BRIRs. Each pair of BRIRs can be seen as a virtual source, since it represents the acoustical paths (direct sounds and reflections) from the loudspeaker to each (inner) ear. By filtering a sound with a BRIR pair, the sound will acoustically appear at the same position and the same environment as the measured loudspeaker. It is desirable not to mix the recording room acoustics with the acoustics captured in the BRIRs. Therefore the sound is recorded in an (almost) anechoic room.

The simplest way to listen to binaurally rendered audio signals is to use headphones, because each ear receives its content separately. In doing so, the transfer function of the headphones may be excluded. This can be done by diffuse field equalization, which will be explained below.

In the following, further psychoacoustic principles are described.

At first, the precedence effect is considered.

The precedence effect is an important localization mechanism for spatial hearing. It allows detecting the direction of a source in reverberant environments, while suppressing the perception of early reflections. The principle states that in the case where a sound reaches the listener from one direction and the same sound reaches time-delayed from another direction, the listener perceives the second signal from the first direction.

Litovsky et. al. (see [005]) has summarized different investigations on the effects of the precedence. The result is that there are many parameters influencing the quality of this effect. Firstly, the time difference between the first and second sound is important. Different time values (5-50 ms) have been determined from different experimental setups. The listeners react differently not only for different kind of sounds, but also for different lengths of the sounds. For small time intervals the sound is perceived between the two sources. This is mainly applicable on the horizontal plane and is commonly known as phantom source (see [007]). For large time intervals two spatially separated auditory events are produced and usually perceived as echo (see [008]). Furthermore it is important how loud the second sound is. The louder it gets the more probable it is that it will be audible (see [006]). In this case it is rather perceived as a difference in timbre, than a separated auditory event.

Due to the different set-ups, it is difficult to rely on the values being investigated across the experiments, since the implemented scenarios have little to do with realistic acoustic environments (see [005]). Nevertheless, it is clear that there is an effect, which strongly assists the spatial hearing.

Another concept is spectral masking which describes the effect of when a sound makes the perception of another sound with non-similar spectral behavior harder, while both sound spectra do not have to overlap. The principle may be demonstrated using a narrowband noise with a center frequency at 1 kHz as a masking sound. Depending on the sound pressure level Lce it creates masking curves at different levels with the same envelope. Any other sound located spectrally under one of these curves will be suppressed by the corresponding masking sound. For broadband masking sound, larger bandwidths are masked.

Now, temporal masking is considered.

Figure 8:
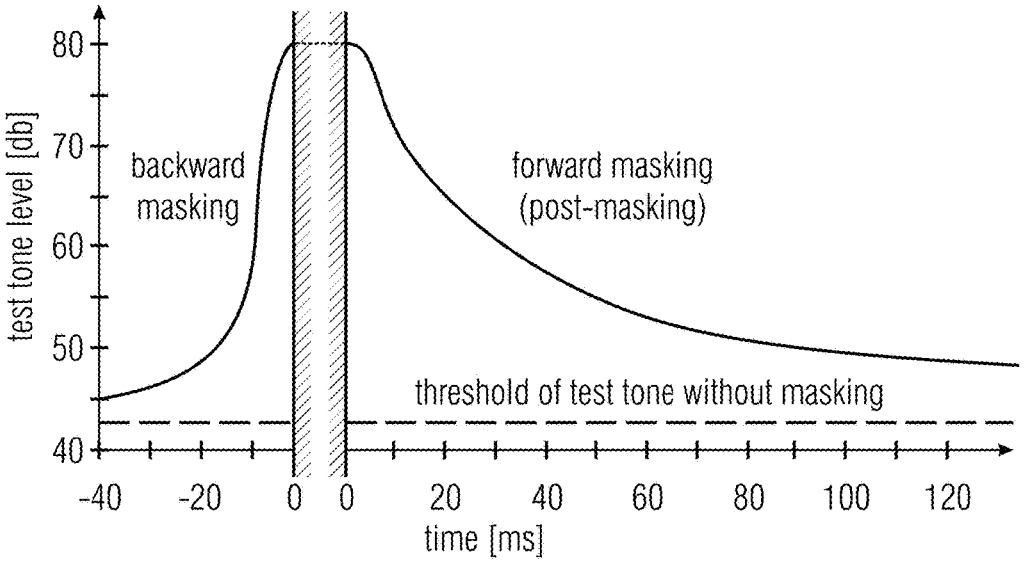
FIG. 8 depicts temporal masking curves for the backward and forward masking effect.

An auditory event in the time domain, as illustrated by the hatched lines in FIG. 8, influences the perception of preceding and following sounds. Therefore, any sound located beneath the backward or the forward masking curve will be suppressed. Compared to the forward masking, the backward masking curve has a higher slope and affects a shorter period of time. The influence of both curves is raised by increasing the masking sound. Depending on the length of the masker sound, the forward masking may cover a range of 200 ms (see [005]).

Figure 7:
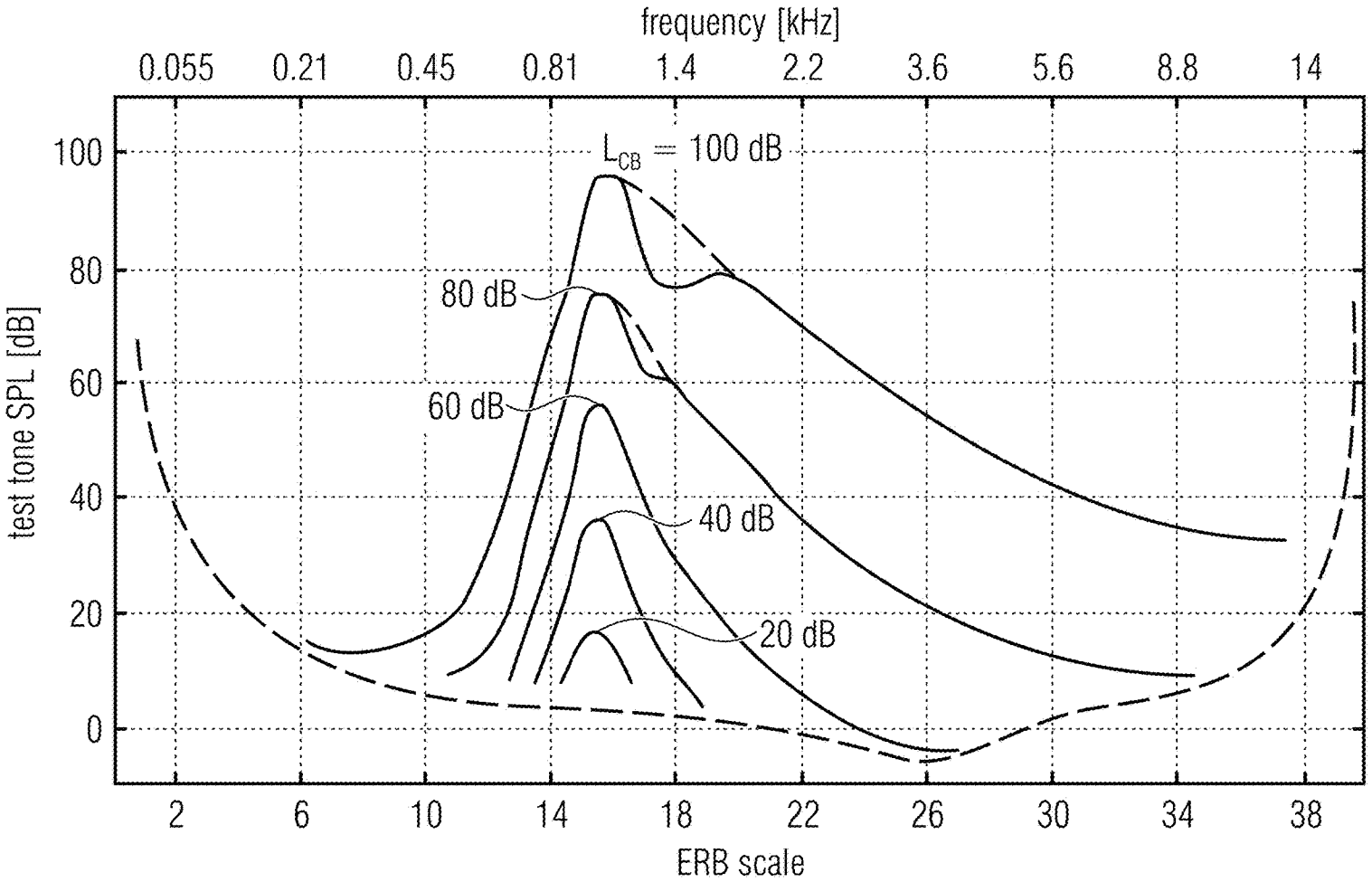
FIG. 7 depicts masking threshold curves for a narrowband noise signal at different sound pressure levels.

FIG. 7 depicts masking threshold curves for a narrowband noise signal (see [005]) at different sound pressure levels $L_{CB}$.

FIG. 8 illustrates temporal masking curves for the backward and forward masking effect. The hatched lines illustrate the beginning and the ending of the masker sound (see [005]).

The Association Model is explained in Theile (see [009]) which describes how the influences of the outer ear are analyzed by the human auditory system.

Figure 9:
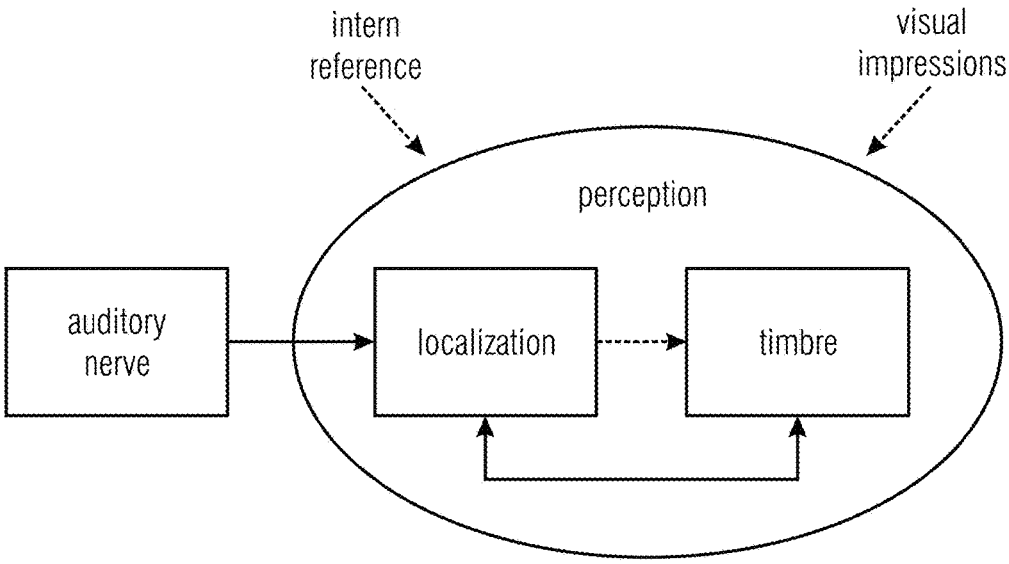
FIG. 9 depicts a simplified illustration of the Association Model.

FIG. 9 depicts a simplified illustration of the Association Model (see [010]). The sound being captured by the ears is firstly compared to the internal reference trying to assign a direction (see FIG. 9). If the localization process is successful, the auditory system is then able to compensate for the spectral distortions caused by the pinnae. If no suitable reference pattern is found, the distortions are perceived as changes in timbre.

In the following, digital signal processing tools are described.

At first, an estimation of Transition Points in BRIRs is presented.

Early reflections lie between the direct sound and the reverb. To investigate their influence in a binaural room impulse response, the starting and ending points of the early reflections may be defined in the time domain.

Figure 10:
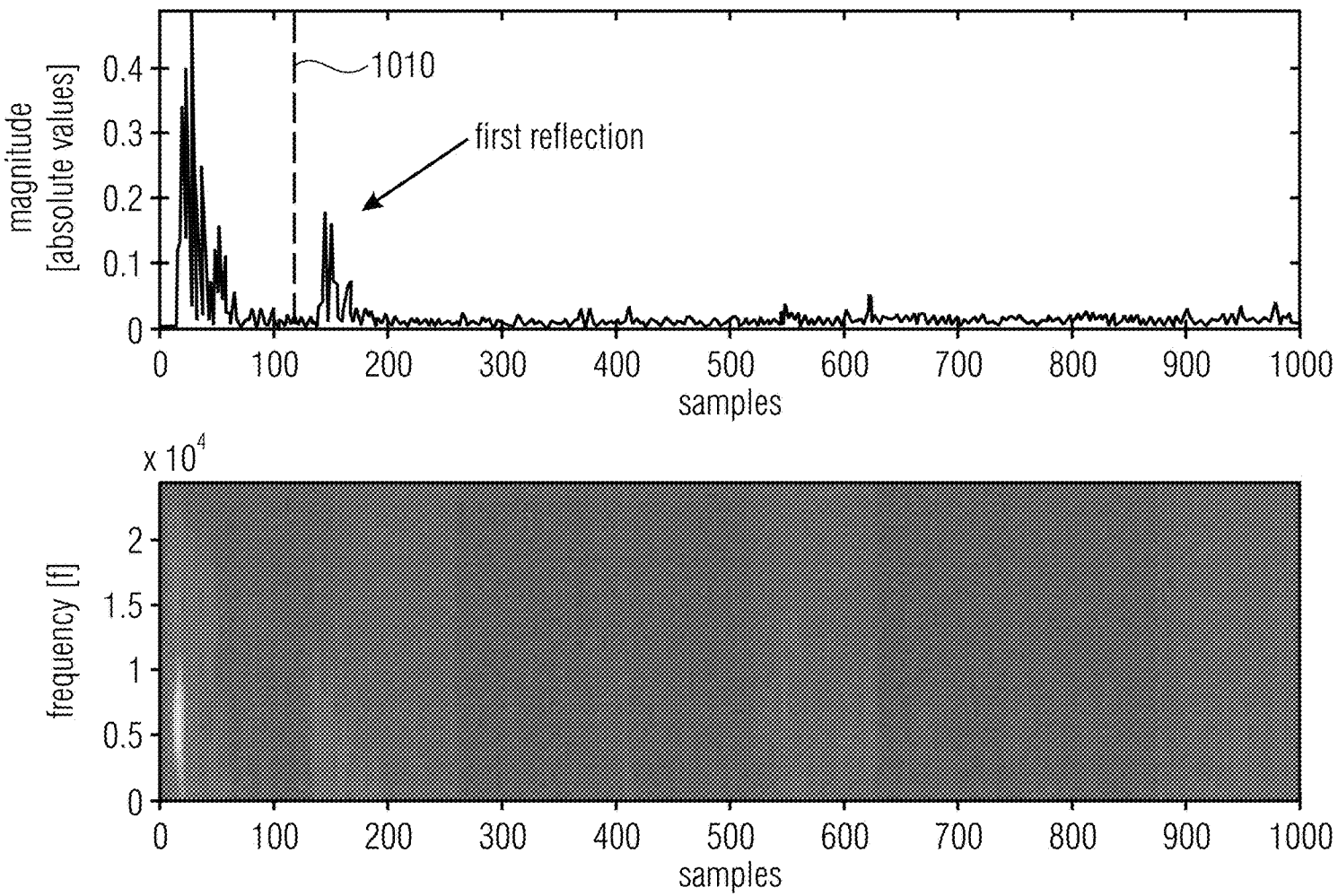
FIG. 10 illustrates temporal and STFT diagrams of the ipsilateral channel of a BRIR (binaural room impulse response)

FIG. 10 illustrates temporal (top) and STFT (bottom) diagrams of the ipsilateral channel of a BRIR (azimuth angle: 45°, elevation angle: 55°). The dashed line 1010 is the transition between the HRIR on the left side and the early reflections on the right side.

The transition point between the direct sound and the first reflection, the reflection that is not a part of the HRIR, can be determined from the temporal plot and the STFT diagram, as shown in FIG. 10. Because of the distinct magnitude, the first reflection can be determined visually. Thus the transition point is set in front of the transient phase of the first reflection. Theoretically calculated values for the time difference of arrival for the first reflection correspond almost exactly to the visually found values.

The determination of the transition point between early reflections and reverb is done by the method of Abel and Huang (see [011]). This approach is recommended by Lindau, Kosanke and Weinzierl in (see [012]), due to the achievement of meaningful results in their investigations.

In a reverberant environment the echo density tends to increase strongly over time. After a sufficient period of time the echoes may then be treated statistically (see [013] and [014]) and the reverberant part of the impulse response would be indistinguishable from Gaussian noise except the color and level (see [015]).

Assuming that the sound pressure amplitudes of the reverb follow the Gaussian distribution, this can be used as a reference. It is compared to the statistics of the impulse response and a transition point is estimated for that point, when the statistical cues in the sliding window are similar to that of the reference.

As a first step a sliding window is used to calculate the standard deviation, σ, for each time index (1).

$$\sigma = \left[\frac{1}{2\delta+1}\sum_{\tau=t-\delta}^{t+\delta} h^2(\tau)\right]^{\frac{1}{2}}, \tag{1}$$

The amount of the amplitudes lying outside the standard deviation for the window is determined and normalized in (2) by that expected for a Gaussian distribution.

$$\eta(t) = \frac{1/\operatorname{erfc}(1/\sqrt{2})}{2\delta+1} \sum_{\tau=t-\delta}^{t+\delta} 1\{|h(\tau)| > \sigma\}, \tag{2}$$

Here h(t) is the reverberation impulse response, 2δ+1 the length of the sliding window and 1{.} the indicator function, returning one when its argument is true and zero otherwise. The expected fraction of samples lying outside the standard deviation from the mean for a Gaussian distribution is given by $\operatorname{erfc}(1/\sqrt{2}) \doteq 0.3173$. With increasing time and reflection density. η(t) tends to unity. At that time index the transition point is defined, since statistically a complete diffusion is reached.

This method is applied to each channel of a BRIR individually. For this reason two separate transition points will be estimated (see FIG. 11). To make sure no important information will be left out, the higher (e.g., later) transition point is chosen permanently in the following investigations.

Figure 11:
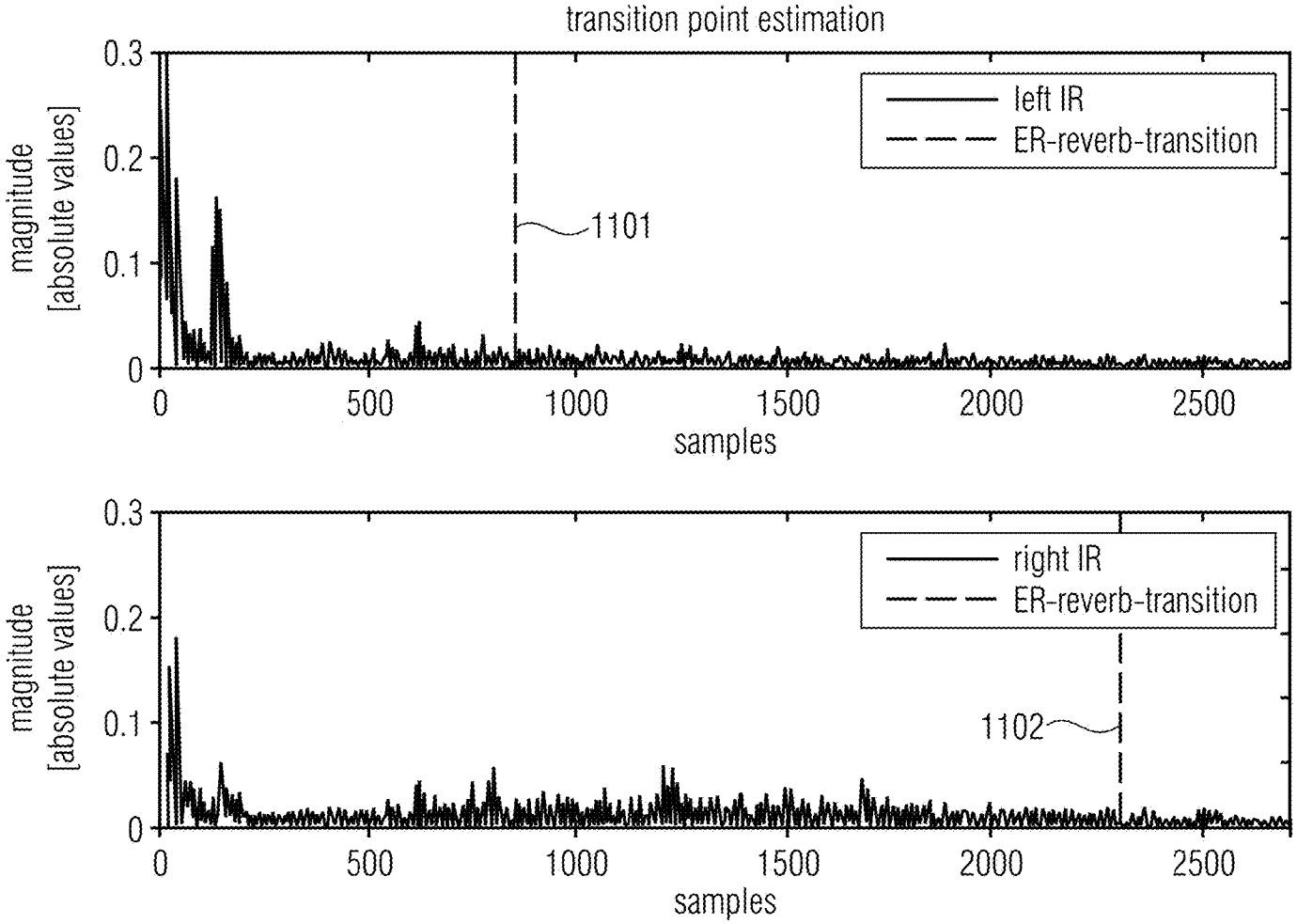
FIG. 11 illustrates an estimation of the transition points for each channel of a BRIR.

FIG. 11 illustrates an estimation of the transition points (lines 1101, 1102) for each channel of a BRIR.

Now, the Mel filterbank is described.

The human auditory system is roughly limited to the range between 16 Hz and 20 kHz, however the relationship between pitch and frequency is not linear. According to Stanley Smith Stevens (see [16]), pitch can be measured in Mel given by the following equation:

$$Mel(f)=m$$

$$m = 2595 Mel \log_{10}\left\{\frac{f}{700\ \text{Hz}} + 1\right\}, \tag{3}$$

$$f = 700\ \text{Hz}\left(\left(10^{\frac{m}{2595 Mel}}\right) - 1\right). \tag{4}$$

Moreover, auditory information (e.g. pitch, loudness, direction of arrival) are analyzed in frequency bands. Thus, to imitate the non-linear frequency resolution and the band wise processing, a Mel filterbank can be used.

Figure 12:
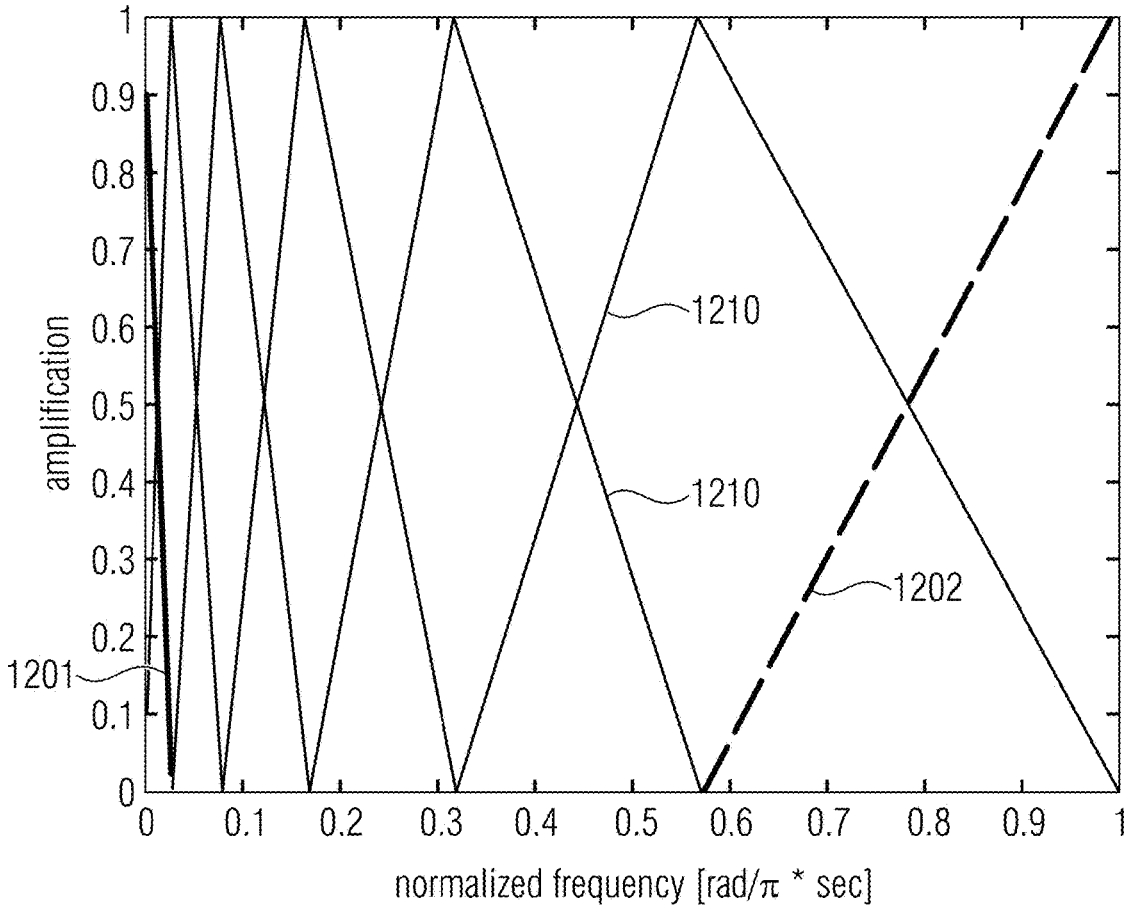
FIG. 12 illustrates a Mel filterbank with five triangular bandpass filters, a low-pass filter and a high-pass filter.

FIG. 12 shows a possible arrangement of triangular bandpass filters of the Mel filterbank over the frequency axis. The center frequencies and also the bandwidths of the filters are controlled by equation 2.2. Usually, the Mel filterbank consists of 24 filters. In particular, FIG. 12 illustrates a Mel filterbank with five triangular bandpass filters 1210, a low-pass filter 1201 and a high-pass filter 1202.

For correct analysis and synthesis, the following two requirements may be met. Firstly, to ensure the allpass characteristics of the filterbank, additional low- and high-pass filters are designed. So the addition of all filters H, in the frequency domain $$\sum_{i=1}^{M} H_i(e^{j\omega}) \overset{!}{=} 1$$

(M: Amount of filters) will lead to a linear frequency response.

The second requirement of the filterbank is expressed by a linear phase response. This property is important as additional phase modifications caused by nonlinear filtering may be prevented. In this case a shifted impulse is expected as an impulse response with $$h(n) = \sum_{i=1}^{N} h_i(n) \overset{!}{=} \delta(n-\tau)$$

(τ latency of the filterbank). The two requirements are illustrated in FIG. 13.

Figure 13:
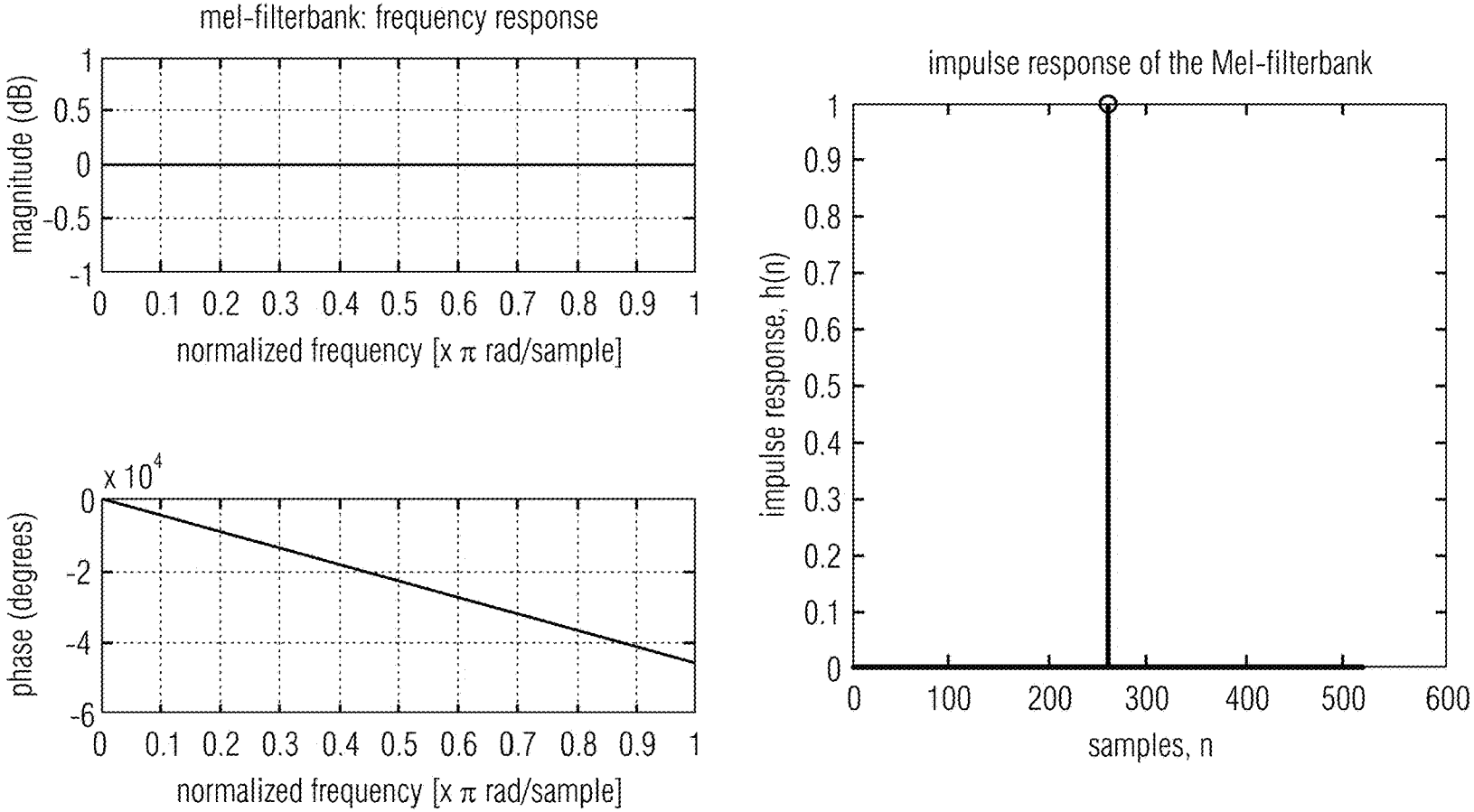
FIG. 13 depicts frequency response and impulse response of the Mel filterbank.

In particular, FIG. 13 depicts frequency response (left) and impulse response (right) of the Mel filterbank. The filterbank corresponds to a linear phase FIR allpass filter. A filter order of 512 samples leads to a latency of 256 samples.

In the following, spherical harmonics and Spatial Fourier Transform are considered.

Sound radiated in a reverberant room interacts with objects and surfaces in the environment to create reflections. By using a spherical microphone array, it is possible to measure those reflections at a fixed point in the room and to visualize the incoming wave directions.

The reflections arriving at the microphone array will cause a sound pressure distribution over the microphone sphere. Unfortunately, it is not possible to read out the incoming wave directions from it intuitively. Therefore one may decompose the sound pressure distribution to its elements, the plane-waves.

In doing so, the sound field is first transformed into the spherical harmonics domain. Figuratively, a combination of spatial shapes (see FIG. 15 below) is found, which describes the given sound pressure distribution on the sphere. The wave field decomposition, that is comparable to spatial filtering or beamforming, can be then executed in that domain to concentrate the shapes to the incident wave directions.

At first, Legendre polynomials are considered.

In order to define the spherical harmonics across the elevation angle β, a set of orthogonal functions may be used. The Legendre polynomials are orthogonal on the interval [−1, 1]. The first six polynomials are given in (5):

$$P_0(x)=1$$

$$P_1(x)=x$$

$$P_2(x)=\tfrac{1}{2}(3x^2-1)$$

$$P_3(x)=\tfrac{1}{2}(5x^3-3x)$$

$$P_4(x)=\tfrac{1}{8}(35x^4-30x^2+3)$$

$$P_5(x)=\tfrac{1}{8}(63x^5-70x^3+15x) \tag{5}$$

Figure 14:
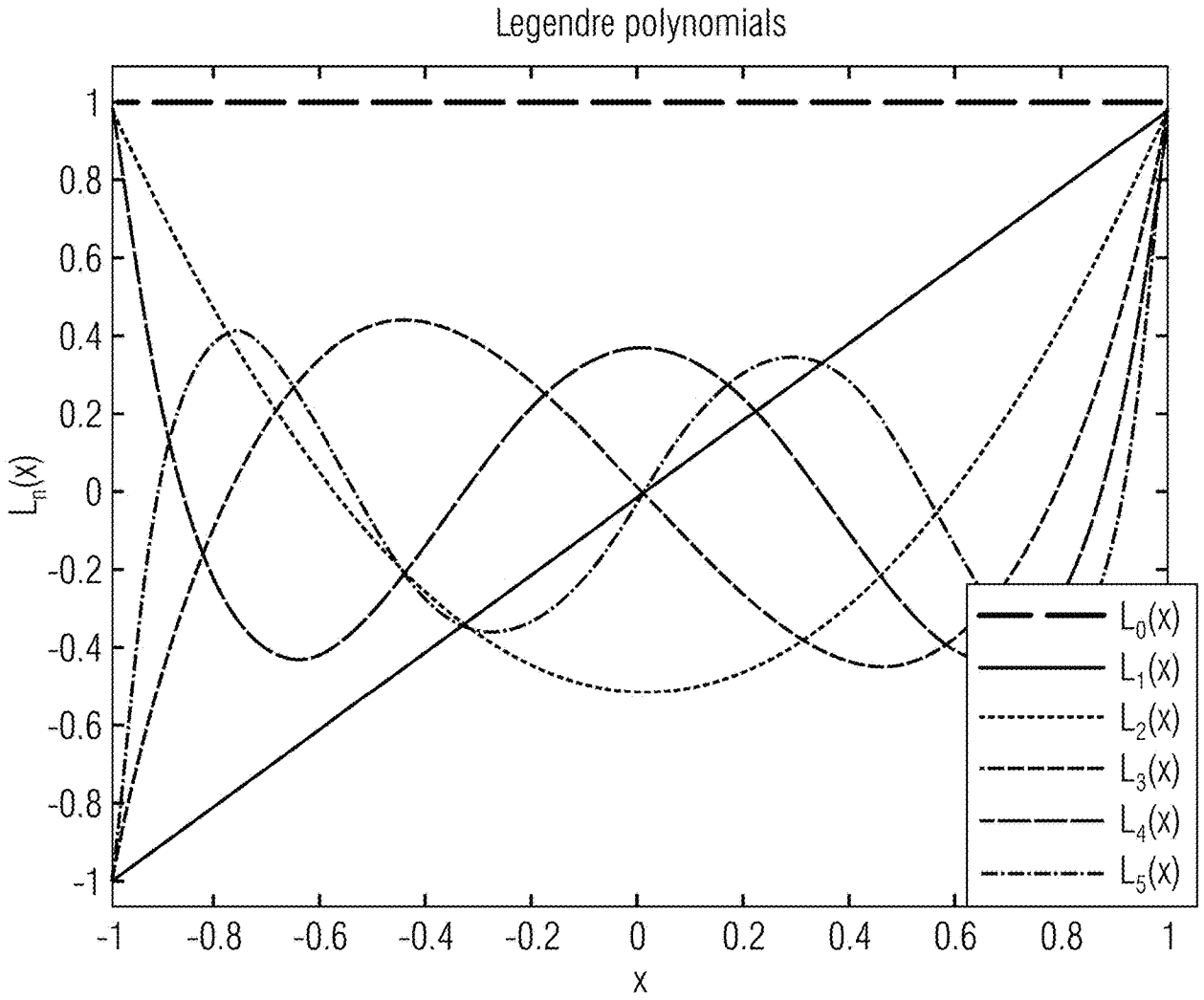
FIG. 14 illustrates Legendre polynomials up to the order n=5.

The corresponding plots are shown in FIG. 14, wherein FIG. 14 illustrates Legendre polynomials up to the order n=5.

The elevation angle is defined between[0,π]. Therefore all orthogonal relations may be transferred to the unit sphere. Since (6) is valid, the associated Legendre polynomials $L_n(\cos\beta)$ can be used in the following.

$$\int_0^{\pi} f(\cos\beta)\sin\beta\, d\beta = \int_{-1}^{1} f(x)\, dx \tag{6}$$

Now, spherical harmonics are considered.

Consider a sound pressure function P(r,β,α,k) in the spherical coordinate system, where β and α are the elevation and azimuth angles, r the radius and k the wavenumber (k=w/c). Assuming that P(r,β,α,k) is square integrable over both angles, it can be represented in the spherical harmonics domain.

As can be seen in (7) the spherical harmonics are composed of the associated Legendre polynomials $L_n^m$, an exponential term $e^{+jm\alpha}$ and a normalization term. The Legendre polynomials are responsible for the shape across the elevation angle β and the exponential term is responsible for the azimuthal shape.

$$Y_n^m(\beta, \alpha) = \sqrt{\frac{2n+1}{4\pi}\frac{(n-m)!}{(n+m)!}}\, L_n^m(\cos\beta)e^{+jm\alpha} \tag{7}$$

Figure 15:
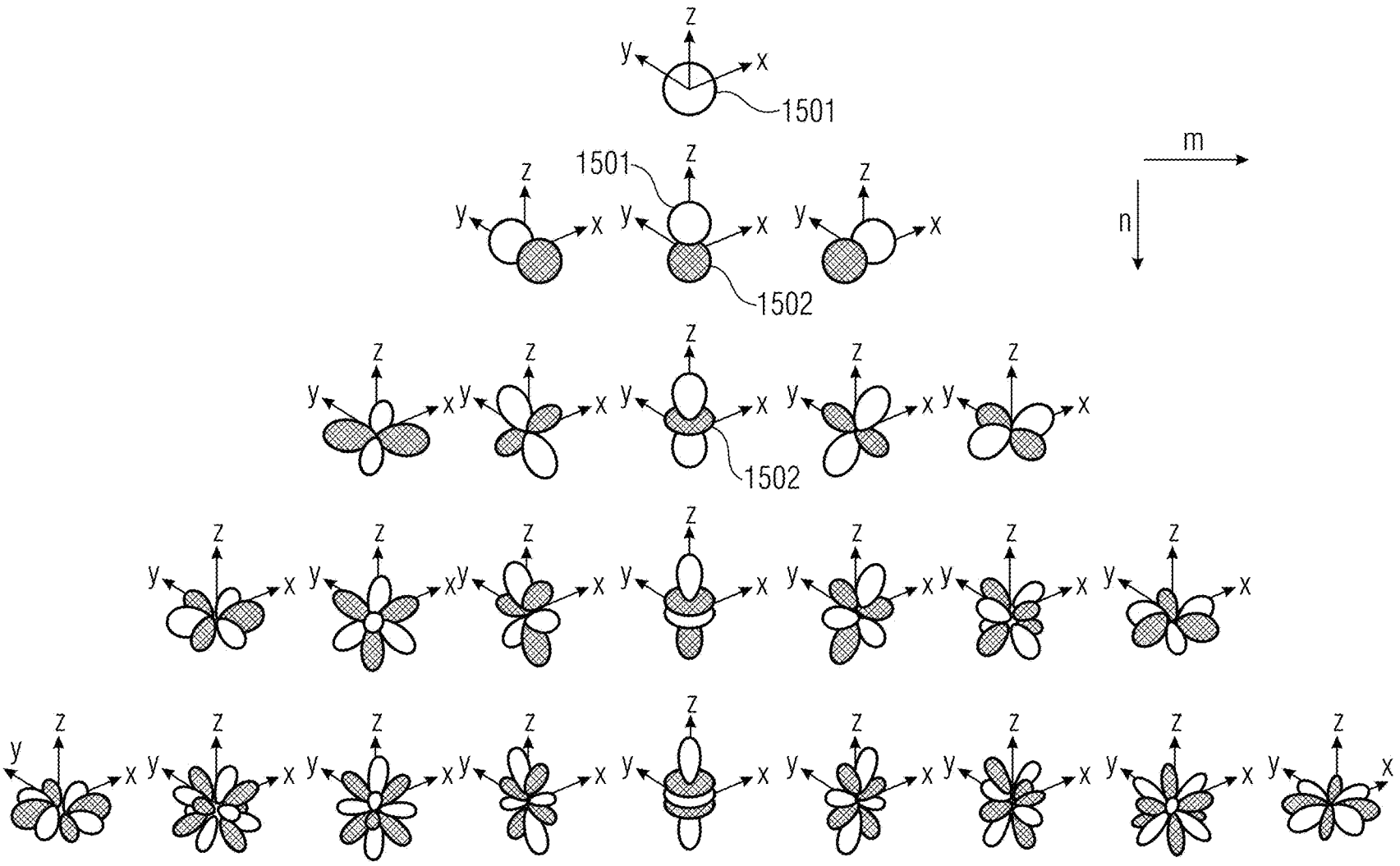
FIG. 15 shows spherical harmonics up to order n=4 and the corresponding modes.

FIG. 15 shows the spherical harmonics up to order n=4 and the corresponding modes, from −m to m (see [017]). Each order consists of 2m+1 modes. The signs of the spherical harmonics are either positive 1501 or negative 1502.

The spherical harmonics are a complete and orthonormal set of Eigenfunctions of the angular component of the Laplace operator on a sphere, which is used to describe a wave equation (see [018] and [019]).

Now, Spatial Fourier Transform is described.

Equation (8) describes how the spatial Fourier coefficients $\check{P}_n^m(r,k)$ can be calculated using the spatial Fourier transformation.

$$\check{P}_n^m(r,k)=SHT\{P(r,\beta,\alpha,k)\}=\int_{\alpha=0}^{2\pi}\int_{\beta=0}^{\pi}P(r,\beta,\alpha,k)Y_n^m(\beta,\alpha)^*\sin\beta d\beta da \tag{8}$$

Here P(r,β,α,k) is the frequency and angle dependent (complex) sound pressure and $Y_n^m(\beta,\alpha)^*$ are the complex conjugated spherical harmonics. The complex coefficients comprise information about the orientation and the weighting of each spherical harmonic to describe the analyzed sound pressure on the sphere.

The equation for the synthesis of the sound pressure across the sphere, while the spatial Fourier coefficients are given, is shown in (9):

$$P(r,\beta,\alpha,k)=SHT^{-1}\{\check{P}_n^m(r,k)\}=\Sigma_{n=0}^{+\infty}\Sigma_{m=-n}^{+n}\check{P}_n^m(r,k)Y_n^m(\beta,\alpha) \tag{9}$$

Since the transformation is dependent of the wavenumber k=ω/c, the sound pressure distribution has to be analyzed for each frequency individually.

In the following, spherical Sampling is described.

The discrete frequency wavenumber spectrum $\check{P}_n^m$ is theoretically exact only for an infinite amount of sampling points, which would involve a continuous spherical surface. From a practical point of view only a finite spectrum resolution is reasonable for achieving a realistic computational effort and computation time. Being restricted to discrete sampling points, an appropriate sampling grid has to be chosen. There are several strategies for sampling the spherical surface (see [021]). One commonly used grid is the Lebedev-quadrature.

Figure 16:
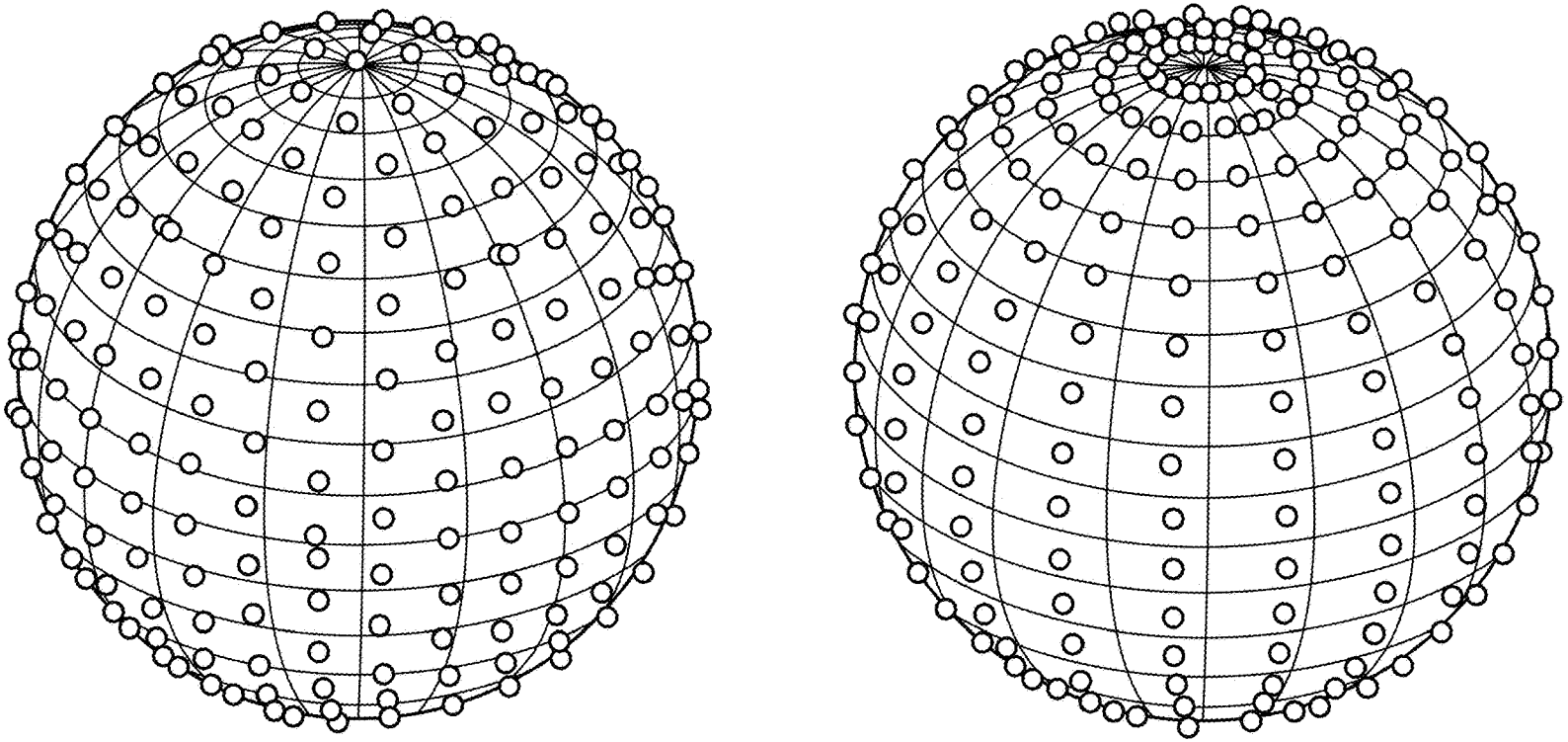
FIG. 16 depicts Lebedev-Quadrature and Gauss-Legendre-Quadrature on a sphere.

FIG. 16 depicts a Lebedev-Quadrature and a Gauss-Legendre-Quadrature on a sphere. The Lebedev-Quadrature has 350 sampling points. The Gauss-Legendre-Quadrature has 18×19=342 sampling points.

Compared to other grids it has equally distributed sampling positions and achieves a higher sampling order for a certain amount of sampling points. For instance, the Lebedev-quadrature only needs 350 and the Gauss-Legendre-quadrature 512 sampling points to achieve a sampling order of N=15.

Now, plane-wave decomposition is described.

Because it is not possible to intuitively read out the incoming wave directions from the sound pressure distribution, plane-wave decomposition may be used. This removes radially incoming and outgoing wave components and reduces the sound field for an infinite number of spherical sampling points to Dirac impulses for incident wave directions Since the spherical Bessel and Hankel functions are the Eigenfunctions of the radial component of the Laplace operator, they describe the radial propagation of the incoming and outgoing waves.

Assuming that there is no source within the sphere and a cardioid polar pattern microphone is used, (10) can be used in the plane-wave decomposition procedure (see [020]). In (10) $j_n(kr)$ is the Bessel function of the first type.

$$b_n(kr)=4\pi i^n\tfrac{1}{2}(j_n(kr)-ij_n'(kr)) \tag{10}$$

The decomposition takes place by dividing the spatial Fourier coefficients by $b_n(kr)$ in the synthesis equation (9), in the spherical harmonics domain.

$$P(r,\beta,\alpha,k)=SHT^{-1}\{\tilde{P}_n^m(r,k)\}=\sum_{n=0}^{+\infty}\sum_{m=-n}^{+n}\tilde{P}_n^m(r,k)Y_n^m(\beta,\alpha)\frac{1}{b_n(kr)} \tag{11}$$

In the following, analysis restrictions are discussed.

Figure 17:
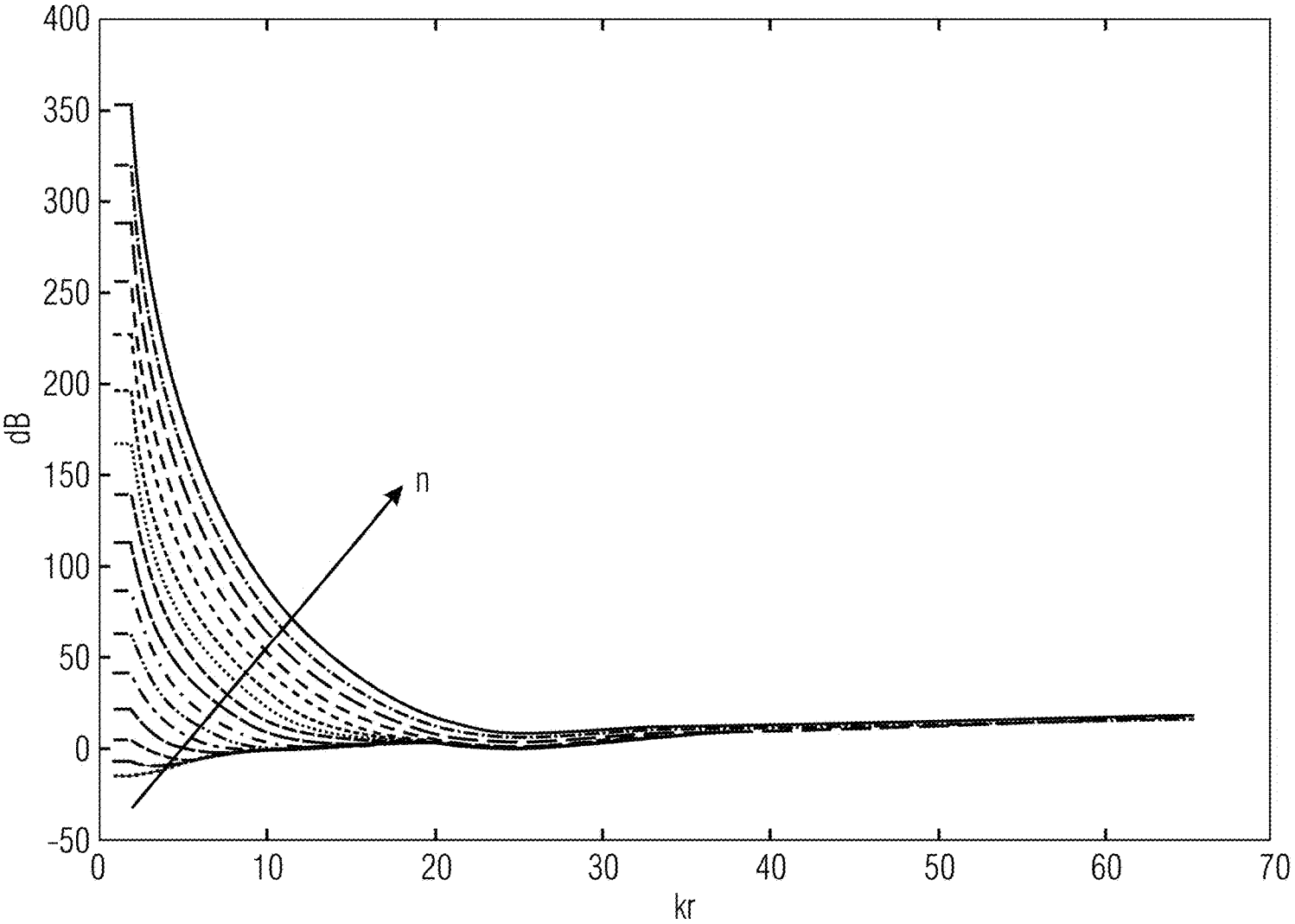
FIG. 17 illustrates an inversion of $b_n(kr)$.

FIG. 17 illustrates an inversion of $b_n(kr)$. Depending on the order n high gains are caused for small kr values.

As shown in FIG. 17, the division by $b_n(kr)$ causes high gains for small kr values depending on the order n. In that case measurements with small SNR values might lead to distortions. To overcome visual artefacts it is reasonable to limit the order of the spatial Fourier transformation for small kr values.

The second constraint is the spatial aliasing criterion kr<<N, where N is the maximum spherical sampling order. It states that the analysis of high frequencies in combination with high radial values expects a high spatial sampling order. This will result in visual artefacts. Being interested in only one analyzing radius, the radius of the human head, the investigations will be executed up to a certain limiting frequency $f_{Alias}$.

$$f_{Alias} \ll \frac{Nc}{2\pi r} \tag{12}$$

Now, diffuse field equalization is described.

The shoulders, head and outer ear of humans or artificial heads distort the spectrum of impinging sound waves.

When comparing transfer functions from a speaker to an artificial head against those recorded with a microphone at the same position, differences in the spectrum can be observed. There are peaks and dips in the magnitude transfer function of the artificial head Some of those cues are directionally dependent, but there are also cues that are independent of direction.

Measuring at the beginning of the blocked ear canal, an increase of approximate 10 dB between the range of 2 kHz and 5 kHz in the spectrum of the transfer function of the measurement head can be observed (see [022]). When playing back signals that were produced for speakers on headphones, this transfer function from the speaker to the ear is missing. To compensate for this missing path, headphones often show an in-built equalization that shows the same boost in the presence region between 2 and 5 kHz (see [023]), the so called "diffuse field equalization".

In order to properly listen to binaural recordings on diffuse field equalized headphones, the BRIRs have to be processed in order to remove that presence peak that is already included in the headphone transfer function. This function is already included in the device of the "Cortex":

The spectrally non-dependent cues are removed in order to be able to play back the binaural recording on non-processed headphones.

Now, measurements are considered.

Regarding the measurement setup, the spherical microphone array is used in the investigations to interpret the reflections of a binaural room impulse response spatially. In order to create a correct correlation between the BRIR and the plane-wave distribution, both the binaural and the spherical measurements have to be carried out at the same position. Furthermore, the diameter of the spherical measurement may correspond to that of the binaural measurement head. This ensures the same time-of-arrival (TOA) values for both systems, preventing on unwanted offset.

Figure 18:
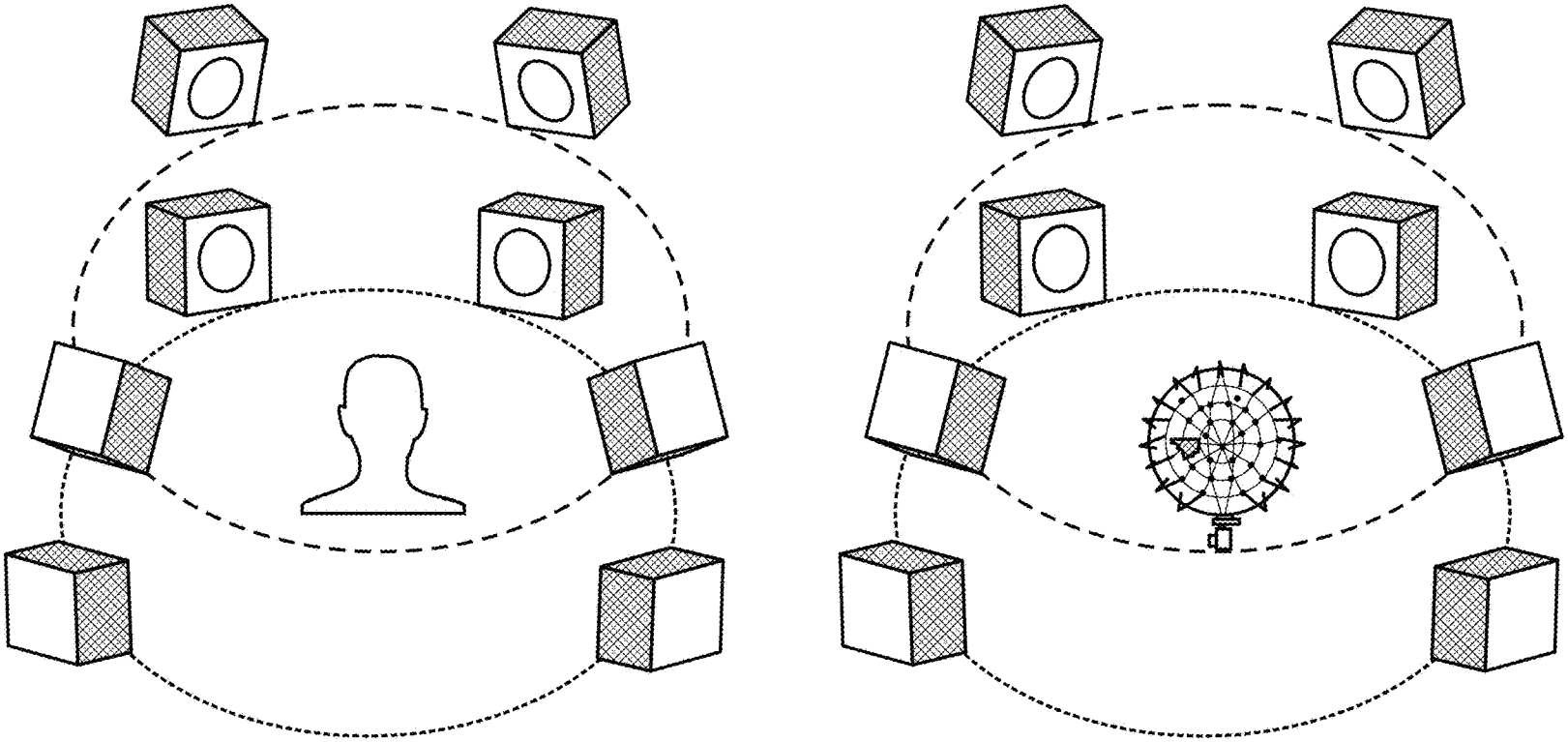
FIG. 18 depicts two measurement configurations, wherein the binaural measurement head as well as the spherical microphone array are positioned in the middle of the eight loudspeakers.

In FIG. 18, two measurement configurations are depicted. The binaural measurement head as well as the spherical microphone array are positioned in the middle of the eight loudspeakers. In each case four non-elevated and four elevated loudspeakers are measured. The non-elevated loudspeakers are on the same level as the ears of the measurement head and the origin of the microphone array. The elevated loudspeakers have an angle of EL=35° to the non-elevated level. The eight loudspeakers have each an azimuth angle of AZ=45° to the median plane. From previous tests, it has been shown that modifications to diagonally arranged sound sources cause the largest differences in localization and timbre.

As a measurement environment a listening test room [W×H×D: 9.3×4.2×7.5 m], the measurement environment "Mozart", at Fraunhofer IIS has been used. This room is adapted to ITU-R BS.1116-3 regarding the background noise level and also the reverberation time, which leads to a more lively and natural sound impression. the room is equipped with already installed loudspeakers across two metallic rings (see FIG. 19), that are suspended one above the other. Thanks to the adjustable height of the rings, accurate loudspeaker positions can be defined. Each ring has a radius of 3 meters and both are positioned in the middle of the room.

Figure 19:
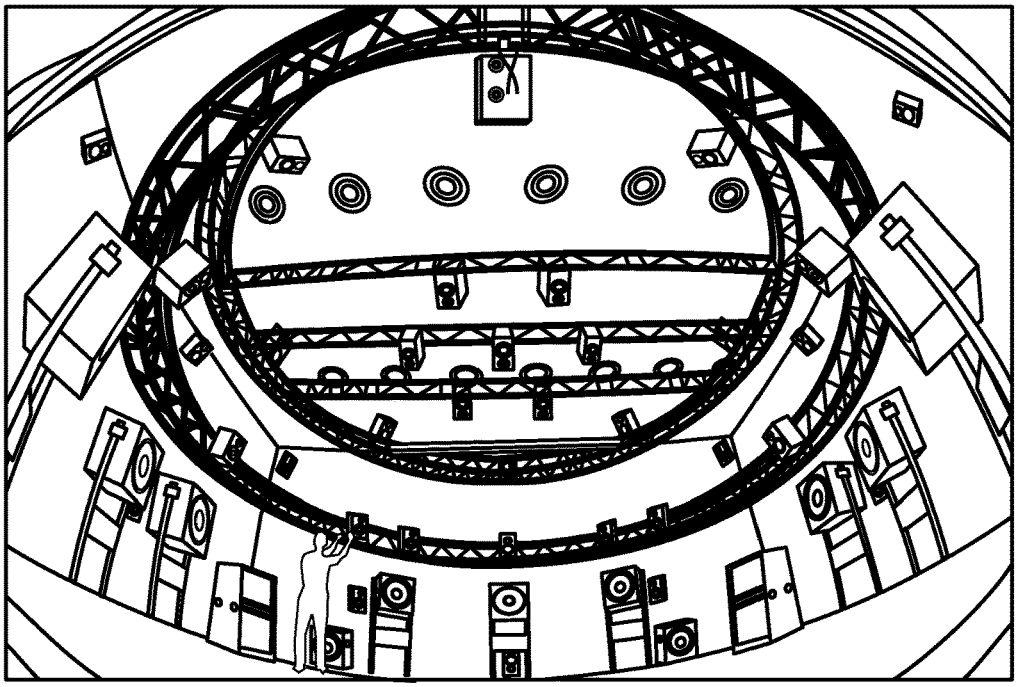
FIG. 19 illustrates a listening test room.

FIG. 19 illustrates a listening test room "Mozart" at Fraunhofer IIS, Erlangen. Standardized to ITU-R BS.1116-3 (see [024]). The huge wooden loudspeakers in FIG. 19 didn't stay in the room during the measurements.

The microphone array and the binaural measurement head (e.g., artificial head or binaural dummy) are placed alternately in the "sweet spot" of the loudspeaker set up. A laser based distance meter was used to ensure the exact distance of each measurement system to each loudspeaker of the lower ring. A height of 1.34 m was chosen between the center of the ear and the ground.

In [026] Minhaar et. al. have compared several human and artificial binaural head measurements by analyzing the quality of localization.

Figure 20:
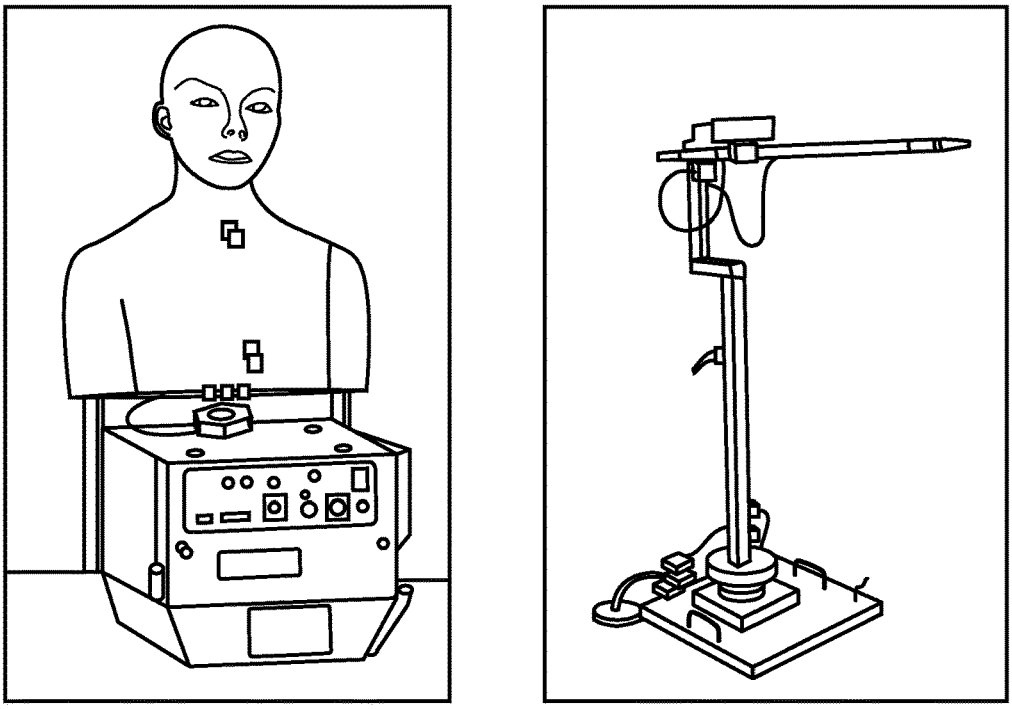
FIG. 20 illustrates a binaural measurement head and a microphone array measurement system.

FIG. 20 illustrates a binaural measurement head: "Cortex Manikin MK1" (left) (see [025]) and a Microphone Array Measurement System "VariSphear" (right) (see [027]). To prevent reflections caused by the system itself, non-relevant components has been removed (e.g. the yellow laser system).

It has become evident that measurements with human heads might sometimes lead to a better localization. Although similar results have been observed at the beginning of this work, an artificial measurement head is used due to its easy handling and the compliance of constant positions during the measurements.

The Spherical Microphone Array "VariSphear" (see [028]), see FIG. 20, is a steerable microphone holder system with a vertical and a horizontal stepping motor. It allows moving the microphone to any position on a sphere with a variable radius and has an angular resolution of 0.01°. The measurement system is equipped with its own control software, which is based on Matlab. Here different measurement parameters can be set. The essential parameters are given in the following:

Sampling grid: Lebedev-quadrature

Number of sampling points: 350 (sampling order N=15, aliasing limit $f_{Alias}$=8190 Hz)

Radius of the sphere: 0.1 m (corresponding to the human anatomy)

Sampling frequency: 48000 Hz

Excitation signal: Sweep (increasing logarithmically)

VariSphear is able to measure the room impulse responses for all positions of the sampling grid automatically and save them in a Matlab file.

In the following, sweep measurement is considered.

When measuring room acoustics, the room is regarded as a largely linear and time invariant system, and can be excited by a determined stimulus to obtain its complex transfer function or the impulse response. As an excitation signal, the sine sweep turned out to be well suited for acoustical measurements. The most important advantage is the high signal-to-noise ratio that can be raised by increasing the sweep duration. Furthermore, its spectral energy distribution can be shaped as desired, and non-linearities in the signal chain can be removed simply by windowing the signal (see [030]).

The excitation signal used in this work is a Log-Sweep Signal. It is a sine with a constant amplitude and exponentially increasing frequency over time. Mathematically it can be expressed (see [029]) by equation (13). Here x is the amplitude, t the time, T the duration of the sweep signal, $\omega_1$ the beginning and $\omega_2$ the ending frequency.

$$x(t) = \sin\left[\frac{\omega_1 \cdot T}{\ln\left(\frac{\omega_2}{\omega_1}\right)} \cdot \left(e^{\frac{t}{T} \cdot \ln\left(\frac{\omega_2}{\omega_1}\right)} - 1\right)\right] \tag{13}$$

In this work, the approach of Weinzierl (see [031]) to measure room impulse responses is used and explained in the following.

Figure 21:
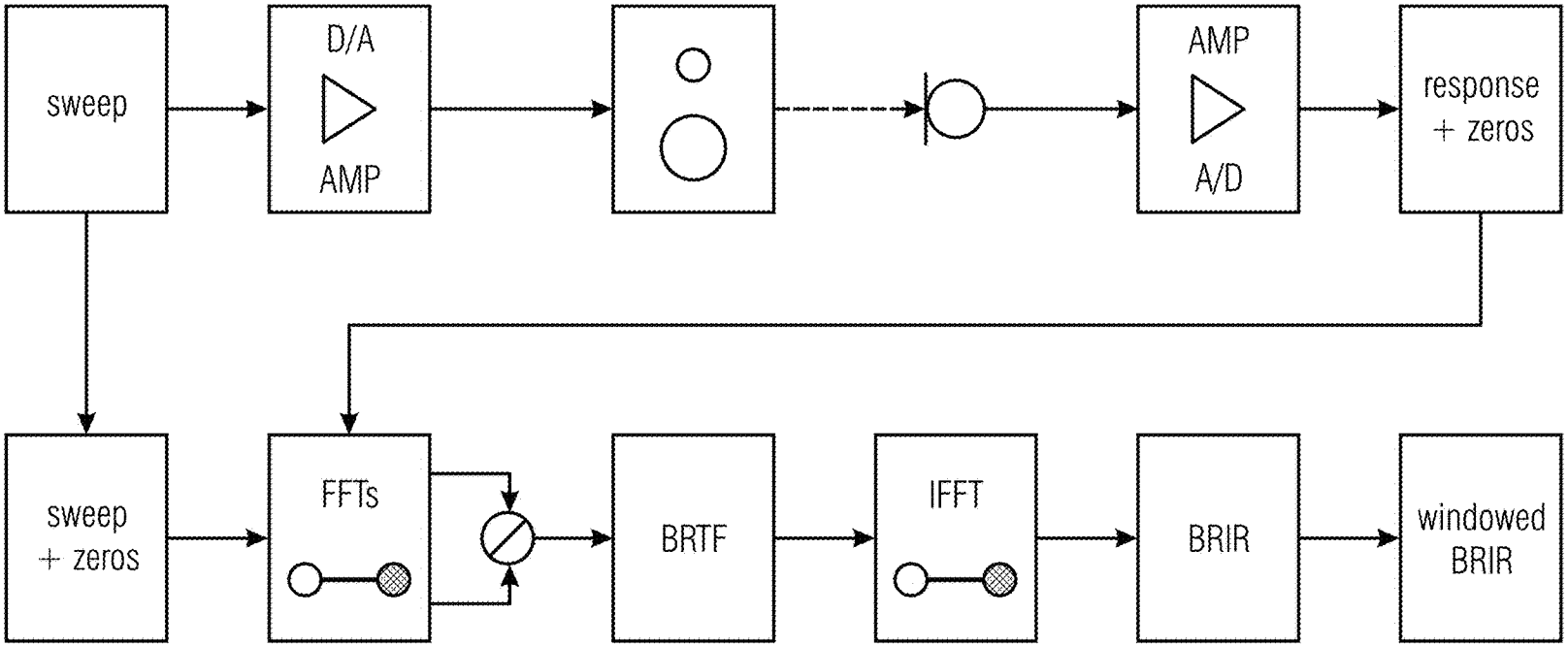
FIG. 21 shows the signal chain being used for BRIR measurements.

The measurement steps are illustrated in FIG. 21. FIG. 21 shows the signal chain being used for BRIR measurements. The sweep is used to excite the loudspakers and also as a reference for a deconvolution in the spectral domain. After being converted to an analogue signal and amplified, the sweep signal is played through a loudspeaker. At the same time the sweep signal is used as reference and extended to the double length by zero padding. The signal being played by the loudspeaker is captured by the two ear microphones of the measurement head, amplified, converted to a digital signal and zero padded as well as the reference.

At this point both signals are transformed to the frequency domain via FFT and the measured system output $Y(e^{i\omega})$ is divided by the reference spectrum $X(e^{i\omega})$. The division is comparable to a deconvolution in the time domain, and leads to the complex transfer function $H(e^{i\omega})$, which is the BRIR. By applying the inverse FFT to the transfer function, the binaural room impulse response (BRIR) is obtained. The second half of the BRIR comprises possible non-linearities occurring in the signal chain. They can be discarded by windowing the impulse response.

In the following, the measurements from the binaural measurement head and the spherical microphone array will be merged. Then a workflow for classifying the reflections of a BRIR spatially will be derived. It may be emphasized that the spherical microphone array measurements are only an additional tool and not the essential part of this work. Due to the great expense, the development of a method for automatically detecting and spatially classifying the reflections of a BRIR is not being pursued. Instead a method based on visual comparison is being developed.

For this reason, a graphical user interface (GUI) has been created to visualize both representations of the room acoustics. The GUI comprises time dependent snapshots of the plane-wave distribution and both impulse responses of the corresponding BRIR. A sliding marker shows the temporal connection between both representations of the room acoustics.

Now, sound field analysis is described.

In the first step, the sound field analysis based on the spherical room impulse response set is executed. For this purpose FH Köln provides a toolbox "SOFiA" (see [032]) which analyzes microphone array data. The constraints mentioned above should be considered here, therefore, only the core Matlab functions of the toolbox can be used. However, these need to be integrated into a custom analysis algorithm. These functions are focused on different mathematic computations and are as follows.

Regarding F/D/T (Frequency Domain Transform), this function transforms the time domain array data into frequency domain data, using the Fast Fourier Transform (FFT) for each impulse response. Because the spectral data is discrete, the spectrum is defined on a discrete frequency scale. Based on this scale and the radius of the spherical measurements, a kr scale is calculated. It is a linear scale and will be used throughout the following computations.

Regarding S/T/C (Spatial Transform Core), the Spatial Transform Core uses the complex (spectral) Fourier coefficients to compute the spatial Fourier coefficients. Since the transform is executed on the kr scale, it is frequency dependent. For this reason, the array data was previously transformed into the spectral domain.

Now, M/F (modal radial filters) are considered.

Depending on the sphere configuration and microphone type, M/F can generate modal radial filters to execute plane-wave decomposition. It uses Bessel and Hankel functions to calculate the radial filter coefficients. For the configuration used in these measurements the filter coefficients $d_n(kr)$ are, e.g., the inversion of equation (10).

$$d_n(kr) = \frac{1}{b_n(kr)} \tag{14}$$

Regarding P/D/C (Plane Wave Decomposition), this function uses the spatial Fourier coefficients to compute the inverse spatial Fourier transform. In this step the spatial Fourier coefficients are multiplied by the modal radial filters. This leads to a plane-wave decomposed spherical sound field distribution.

Figure 22:
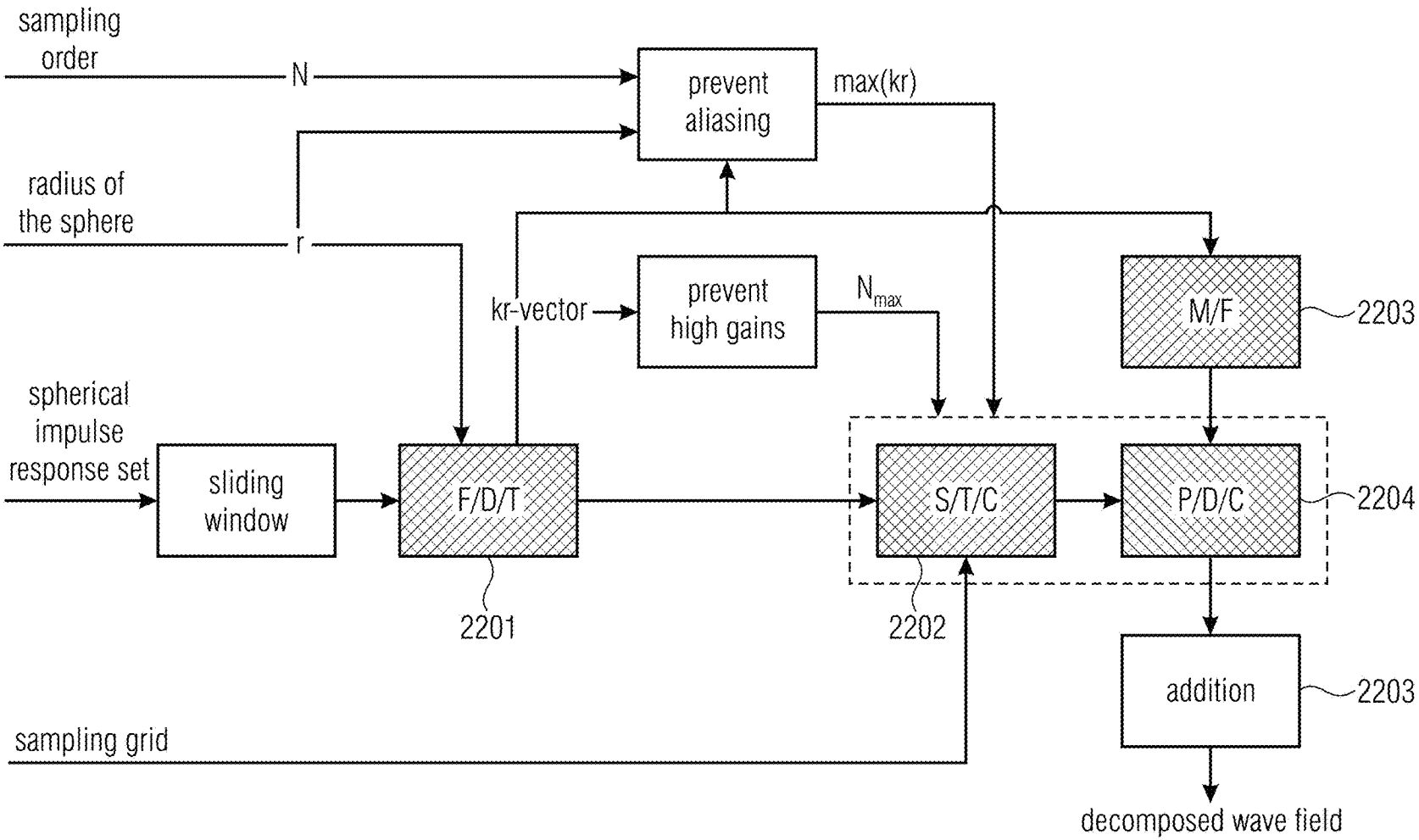
FIG. 22 depicts an overview of the sound field analysis algorithm.

FIG. 22 depicts an overview of the sound field analysis algorithm. Thin lines transmit information or parameters and thick lines transmit the data. Functions 2201, 2202, 2203 and 2204 are the core functions of the SOFIA toolbox. The four SOFIA toolbox functions are integrated into an algorithm that is explained in the following. The corresponding structure is shown in FIG. 22.

Now the sliding window concept is considered. Being interested in a short time representation of the decomposed wave field, a sliding window is created to limit the spherical impulse response to short time periods for the analysis. On the one hand, the rectangular window has to be long enough to obtain meaningful visual results. For small computational effort, the spectral Fourier transformation order is limited to N=128. This leads to an inaccurate spectral analysis especially for very short time periods, thus, the spatial analysis will be inaccurate as well. On the other hand it has to be as short as possible to obtain more snapshots per time unit. Using trial and error, $L_{win}$=40 samples (at 48 kHz) has been determined as a reasonable window length. Unfortunately a temporal resolution of 40 samples is not precise enough to detect individual reflections.

Inspired by the one dimensional Short-Time Fourier Transformation, an overlapping between adjoining time sections is involved. A window with the length of $L_{win}$=40 samples is analyzed every 10 samples. Consequently an overlapping of 75% is achieved. As a result, a four times higher temporal resolution is now possible.

Figure 23:
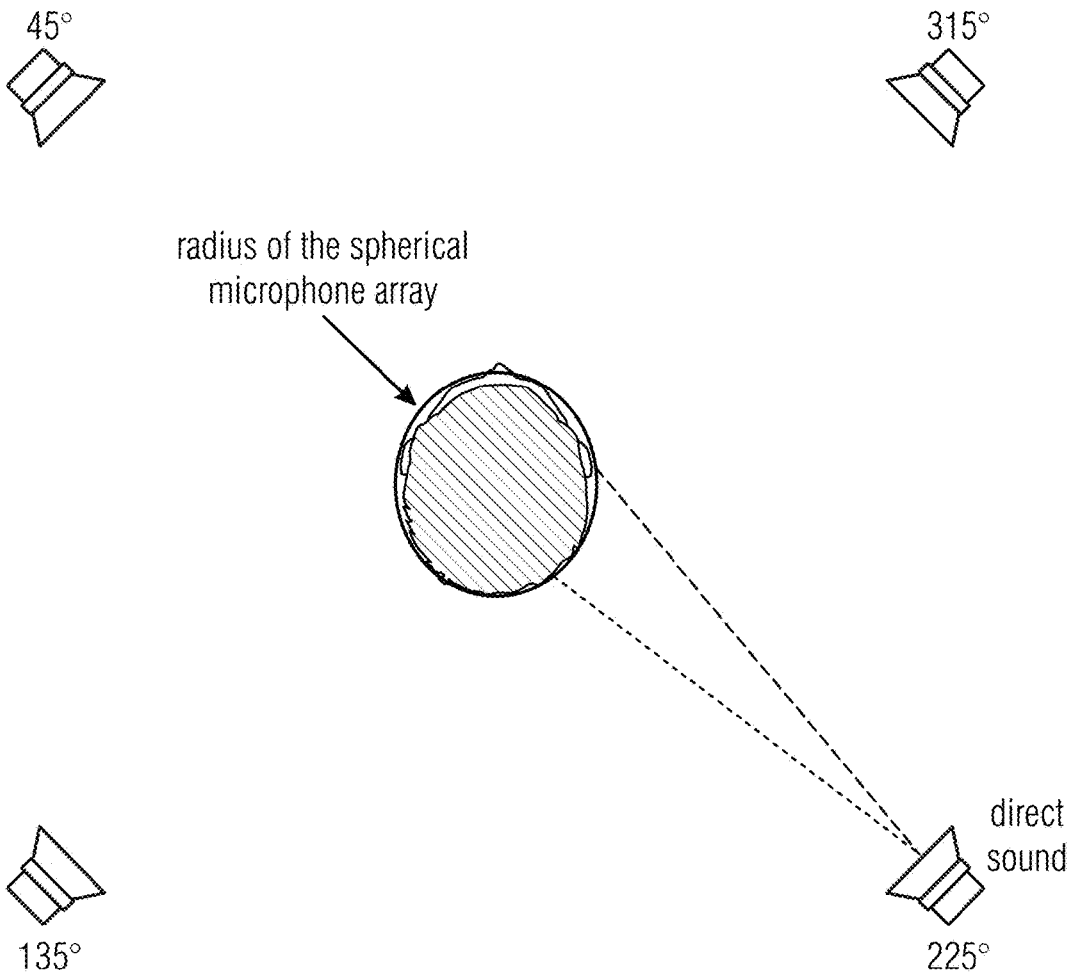
FIG. 23 illustrates different positions of the nearest microphones in each measurement set lead to an offset.

FIG. 23 illustrates different positions of the nearest microphones in each measurement set lead to an offset. As can be seen in FIG. 23 the overlapping leads to a smoothing behavior, however, this does not affect further investigations.

High gains should be prevented. To prevent high amplifications, e.g., caused by the modal radial filters, the order of the spatial Fourier transformation has to be limited for small kr values. For this, a function is implemented that compares the filter gains depending on the given kr value. The threshold is set to $G_{threshold}$=10 dB, thus only the filter curves that cause smaller amplifications than the threshold allows, are used. To put this limitation into practice, the order of the spatial Fourier transformation has to be limited to $N_{max}(kr)$.

In order to ensure the compliance of the aliasing criterion to prevent aliasing, another function is involved in the algorithm. It computes the maximum allowed kr value and finds the corresponding index in the kr vector. This information is then used to limit the analysis (in S/T/C and P/D/C) up to the determined value.

The final step of the sound field analysis may, e.g., be the addition of all kr dependent results, since the S/T/C and P/D/C computations have to be executed for each kr value individually. For the visualization of the decomposed wave field, the absolute values of the P/D/C output data are added.

The results of the sound field analysis may, e.g., then be used to correlate them with the binaural impulse responses.

Figure 24:
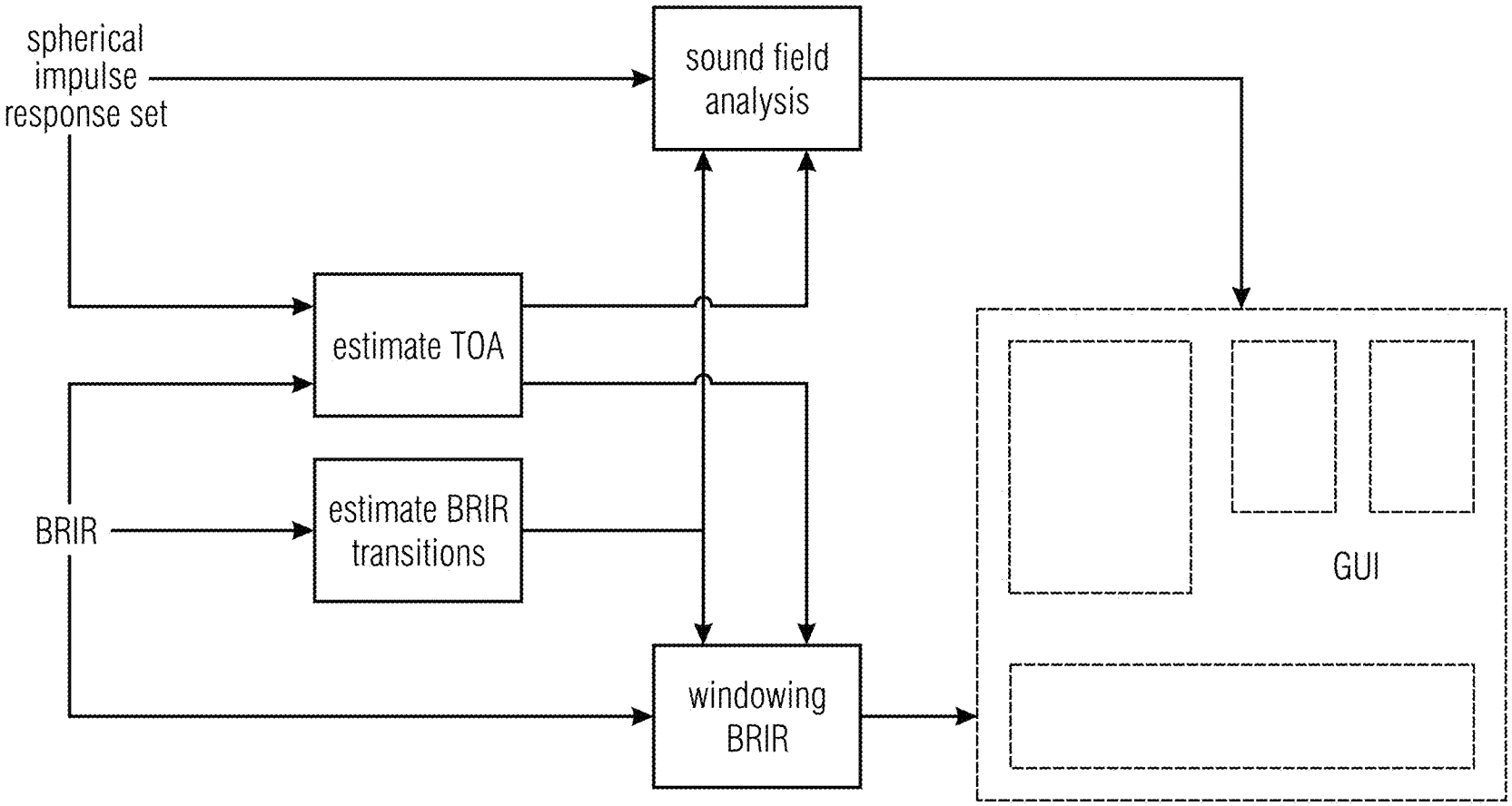
FIG. 24 depicts the graphical user interface combines visually the results of the sound field analysis and the BRIR measurements.

Both are plotted in a GUI in accordance to the direction of the responsible sound source (see FIG. 24).

But first, some precautions may, e.g., be made.

For the time adjustment, both measurements are analyzed by the function "Estimate TOA", where the duration of the sound from the loudspeaker to the nearest microphone is estimated. In the binaural set, the nearest microphone is located on the ipsilateral side. Thus, the corresponding BRIR channel is chosen to estimate the TOA. By using this impulse response, the maximum value is determined and a threshold value, which is 20 percent of the maximum, is created. Since the direct sound is temporally the first event in an impulse response and also comprises the maximum value, the TOA is defined as the first peak that exceeds the threshold. In the spherical set, the impulse response of the nearest microphone is estimated by comparing the maximum values of each impulse response temporally. Then the same procedure for the TOA estimation is applied on the impulse response with the earliest maximum.

The nearest microphone of the spherical set is not on the same position as the one of the binaural set (see FIG. 23). Nevertheless, the distance between them will be the same, because only the diagonally arranged loudspeakers are measured in this work. Thus there is a difference of around 7.5 cm or 10 samples (at 48 kHz), which corresponds to an offset of one step in the temporal resolution of the sound field analysis. Taking the offset into account, this simple method for the TOA estimation yields remarkably good results.

Using the TOA estimation and the transition point estimation, as mentioned above, the sound field analysis is temporally limited to those time indices. The BRIR set will also be windowed to be within those limits (see FIG. 24).

FIG. 24 depicts the graphical user interface combines visually the results of the sound field analysis and the BRIR measurements.

Figure 25:
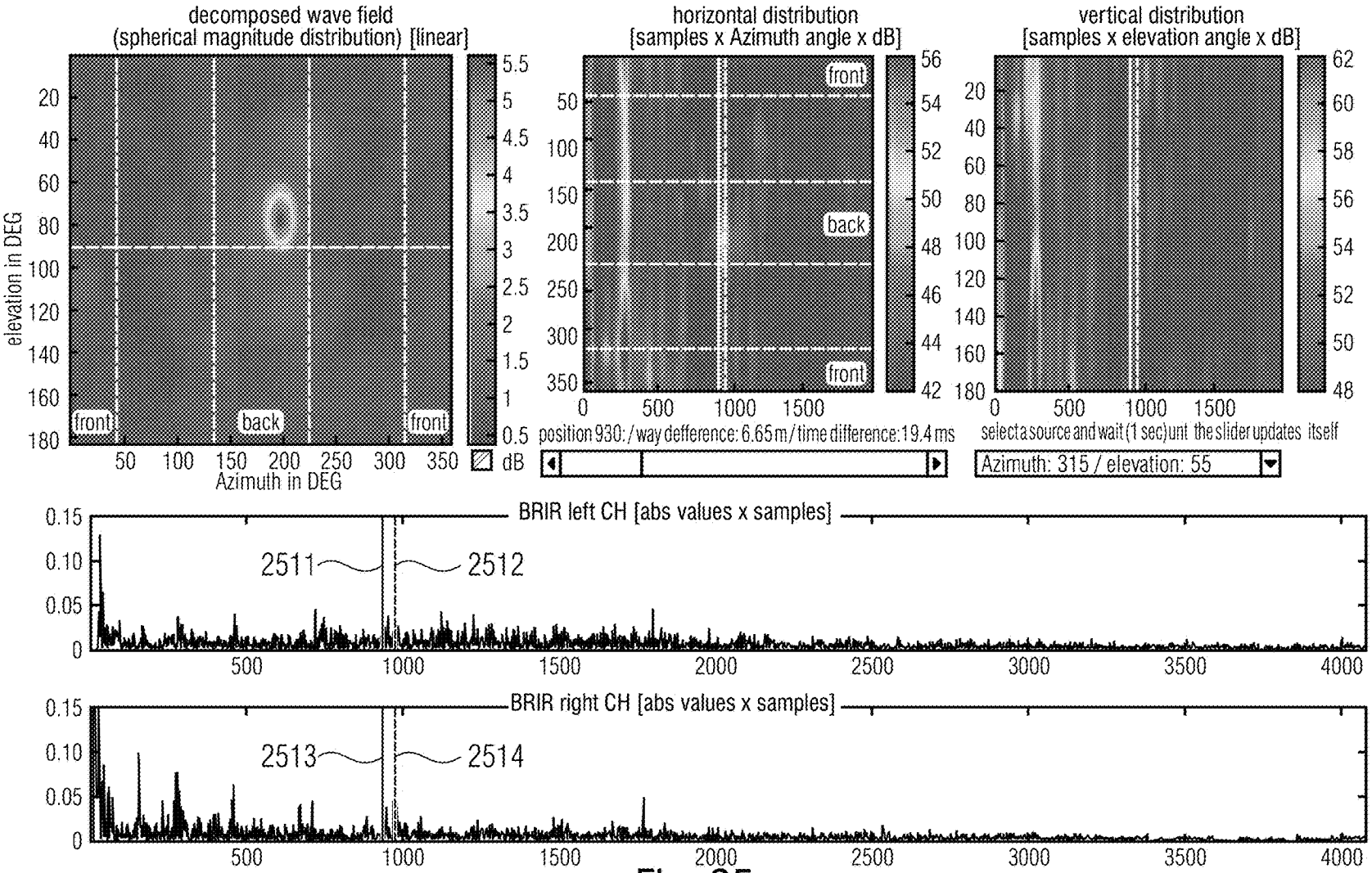
FIG. 25 depicts an output of a graphical user interface for correlating the binaural and spherical measurements.

FIG. 25 depicts an output of a graphical user interface for correlating the binaural and spherical measurements. For the current slider position a reflection is detected that arrives the head from behind slightly higher than the ears level. In the BRIR representation this reflection is marked by the sliding window (lines 2511, 2512, 2513, 2514).

The two channels of the BRIR are plotted in the lower part of the GUI showing the absolute values. In order to recognize the reflections better, the range of the values are limited to 0.15. The lines 2511, 2512, 2513, 2514 represent the 40 samples long sliding window that has been used in the sound field analysis. As already mentioned, the temporal connection between both measurements is based on the TOA estimation. The position of the sliding window is estimated only in the BRIR plots.

The snapshots of the decomposed wave field are shown in the upper left plot. Here, the sphere is projected onto a two dimensional plane, comprising the magnitudes (linear or dB scale) for each azimuth and elevation angle. A slider controls the observation time for the snapshots and also chooses the corresponding position of the sliding window in the BRIR plots.

It is not possible to see the temporal distribution of the decomposed wave field for both angles in one plot Therefore, it may be split into a horizontal and a vertical representation. For the horizontal distribution the sum of the data for all elevation angles has been calculated and reduced to one plane. For the vertical distribution the sum of the data for all azimuth angles has been calculated. Both plots are limited to 2000 samples, in order to see more detail at the beginning. The first 120 samples of the HRIR are out of the range and are clipped in the visual representation.

In the following, a workflow for detecting and classifying reflections in a BRIR are presented. Due to the strong reflection overlapping in the time domain, it is not completely possible to cut out single reflections individually. Even if the first order reflections do not overlap among themselves at the beginning, there might be scattering arriving the microphones at the same time. Therefore only parts of the reflections that have dominant peaks in the BRIR and the decomposed wave field representation should be considered in the investigations.

Figure 26:
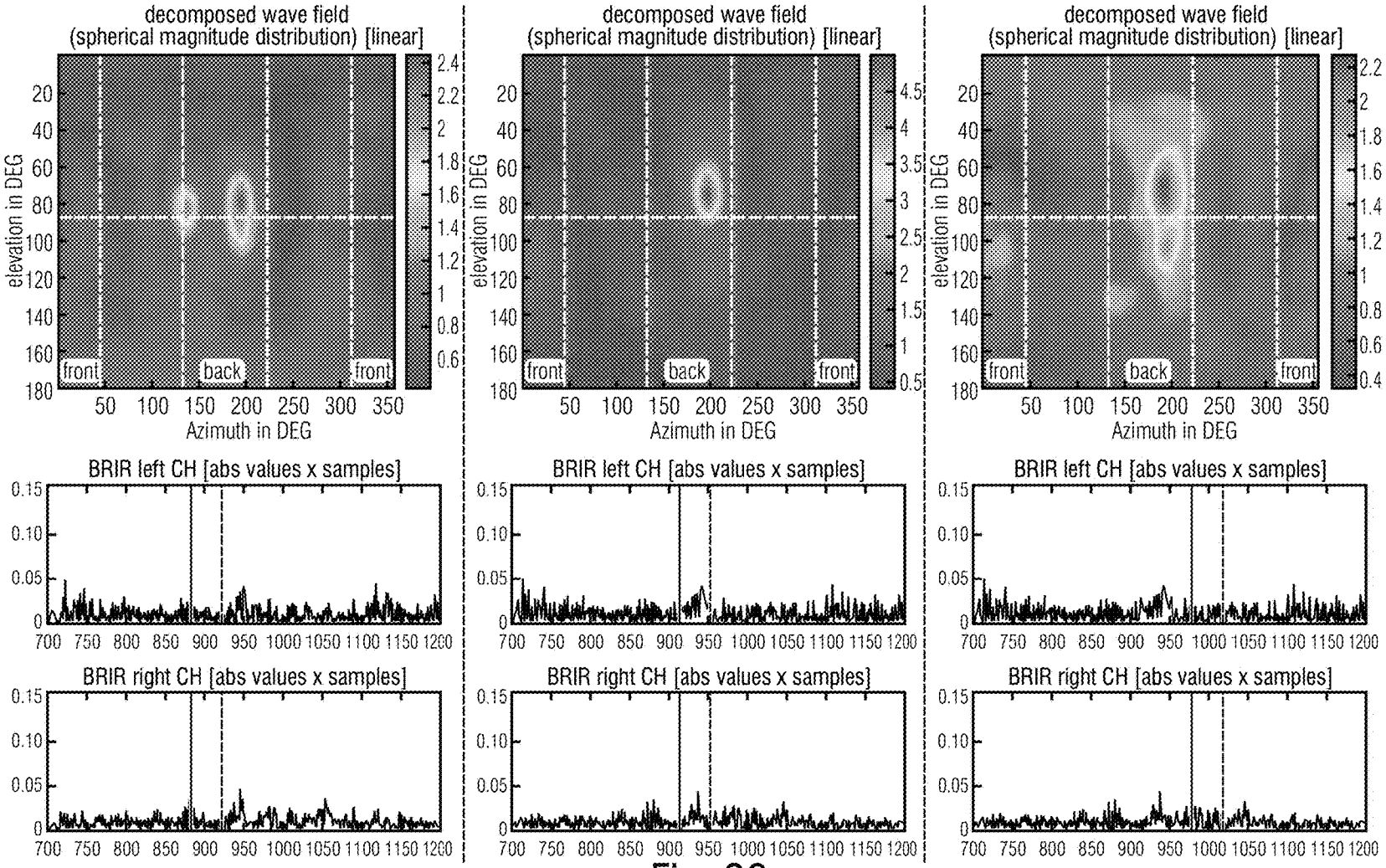
FIG. 26 shows different temporal stages of a reflection.

FIG. 26 shows different temporal stages of a certain reflection that have been captured in both measurements. As can be seen in the second row, the reflection dominates in the analyzing window of the sound field analysis. The same behavior can be seen in the BRIR. In this example the reflection causes in both channels a peak with the highest value in its immediate environment. In order to use it in further investigations the beginning and the ending time points have to be determined.

For this, one may step back a few time steps back to find the transition point from the current to the previous reflection. This process is detailed in the first row of FIG. 26. The analyzing window is located between two reflections. Based on visual assessment, the beginning point can be set for instance at sample 910. In both channels there is a local minimum. In that case the same value can be chosen for both impulse responses, because the reflection appears from behind. This means that there is almost no ITD or ILD in the BRIR. Otherwise, depending on the azimuth angle an ITD has to be added. The same procedure is executed for the ending point.

FIG. 26 illustrates different temporal stages of a reflection represented in the decomposed wave field and BRIR plots. The column left shows the beginning. At that time point another reflection fades away. In the column in the middle, the desired reflection dominates in the analyzing window. In the right column, it then becomes weaker and disappears slowly among other reflections and scattering.

Now, the influence of early reflections are discussed.

Even though this work is focused on investigating the influence of early reflections on height perception, it is useful to understand the behavior and the role of the reflections in binaural processing. Specifically, reflections are modified repetitions of the direct sound. Since masking and precedence effects may occur, it seems reasonable to suppose that not all reflections will be audible. The question that arises is, are all reflections important for preserving the localization and the overall sound impression? Which reflections might be used for height perception? How can further tests be designed without destroying the sound impression and preserving naturalness?

It is not the intention of this work to find general rules to describe how reflections are suppressed in the binaural perception. It is rather aimed at answering the mentioned questions. Therefore non relevant reflections are determined based on auditory assessment, while using the principles of the masking and precedence effects.

Now, the spatial distribution of reflections is considered with reference to the Mozart listening environment presented above.

Figure 27:
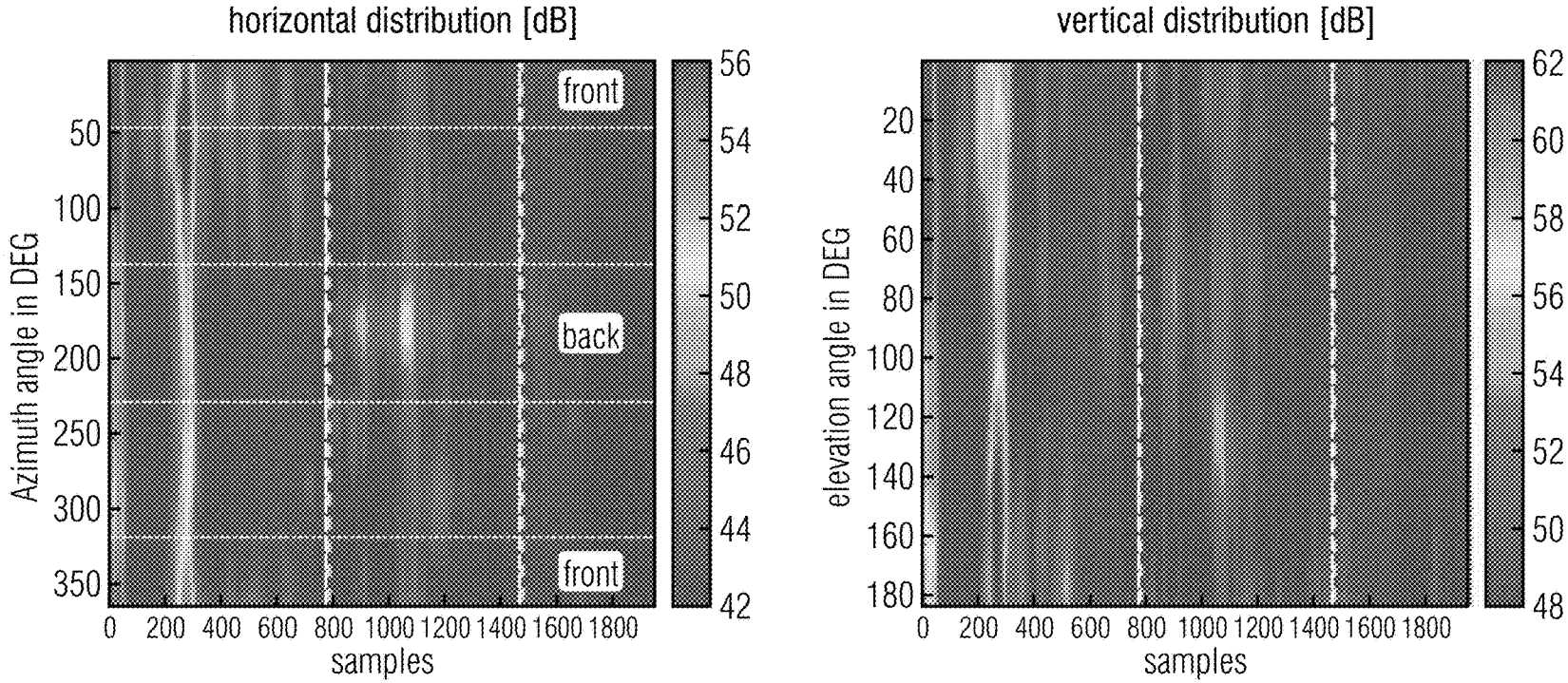
FIG. 27 illustrates horizontal and vertical reflection distributions with a first configuration.

FIG. 27 illustrates horizontal and vertical reflection distributions in Mozart with sound source direction: azimuth 45°, elevation 55°. In this room the early reflections can be separated into three sections: 1. [Sample: 120-800] Reflections coming from almost the same direction as the direct sound. 2. [Sample: 800-1490] Reflections coming from opposite directions. 3. [Sample: 1490—Transition Point] Reflections coming from all directions and having less power.

Evaluating the horizontal and vertical distributions of the early reflections for different source directions, a typical distribution pattern can be observed. The spatial distribution can be divided into three areas. The first section begins right after the direct sound at sample 120 and ends around sample 800. From the horizontal representation, it can be seen that the reflections arrive at the sweet spot from almost the same direction as the sound source (see FIG. 27, left). The elevation plot (see FIG. 27, right) shows that in this range all waves are reflected either by the ground or the ceiling.

In the second section the reflections arrive from opposite the source. This time period begins at sample 800 and ends at 1490. Here, sources from frontal directions (450/315°) cause distinctive reflections around azimuth angles of 170°/190°. This is because of a huge window with a strong reflective surface in the rear. Whereas, sources from rear directions (1350/225°) cause distinctive reflections in the opposite corners (315°/45°) because of no strong reflective surface at the front. For the height distribution, no clear statement can be made.

The third section begins at sample 1490 and ends at the estimated transition point. Here, apart from a few exceptions, the reflections arrive from almost all directions and heights. Furthermore, the sound pressure level is strongly reduced.

In the following, reduction to auditive relevant reflections is considered.

An attempt is made to reduce the early reflections to the essentials in one pair of BRIRs (Source azimuth angle: 45°, elevation angle 55°). Suppressed reflections are determined and set to zero, and then compared to the unmodified BRIRs. Since the localization is strongly correlated to the spectral cues and therefore the timbre of the sound, it is not distinguished between localization and sound impression. Removing reflections from the BRIRs should not lead to any perceptual differences.

While determining the suppressed reflections, some special features have to receive attention. Compared to classic experiments, where only two sounds are involved, many reflections influence the behavior of the masking and precedence effects in a BRIR. Moreover it is not possible to apply the rules directly to impulse responses, as a reflection impulse will cause different effect lengths and quality, depending on the sound it filters. Additionally, when dealing with BRIRs, binaural cues can affect masking, since the listener receives two versions of the masking and the masked sound. Both versions differ in the ITD, ILD and spectral composition. The listener reverts to more information in that case. A prominent example is the "cocktail party effect" (see [033]), where the auditory system is able to focus on one person in a crowded room.

Figure 28:
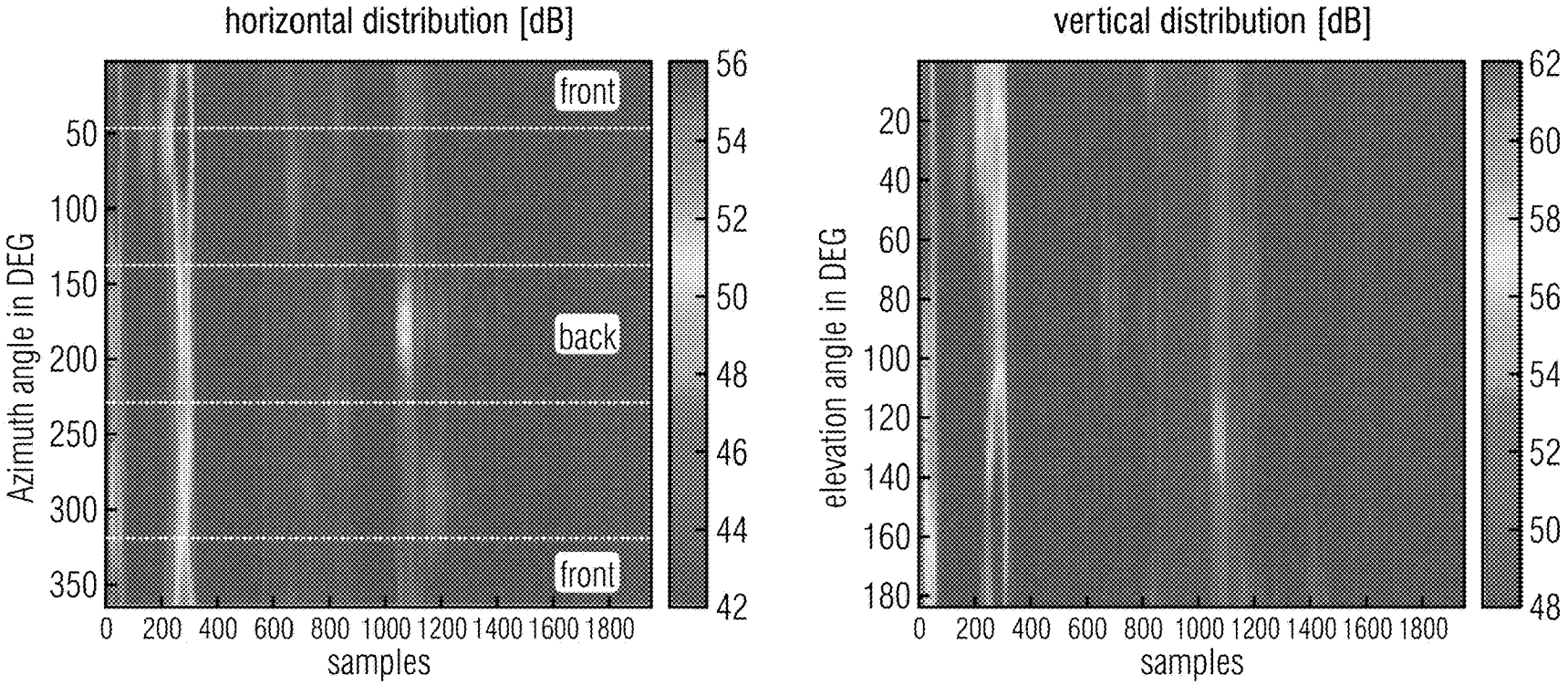
FIG. 28 illustrates horizontal and vertical reflection distributions with a second configuration.

FIG. 28 illustrates horizontal and vertical reflection distributions in "Mozart" with sound source direction: azimuth 45°, elevation 55°. This time only the audible reflections are left in both plots.

Figure 29:
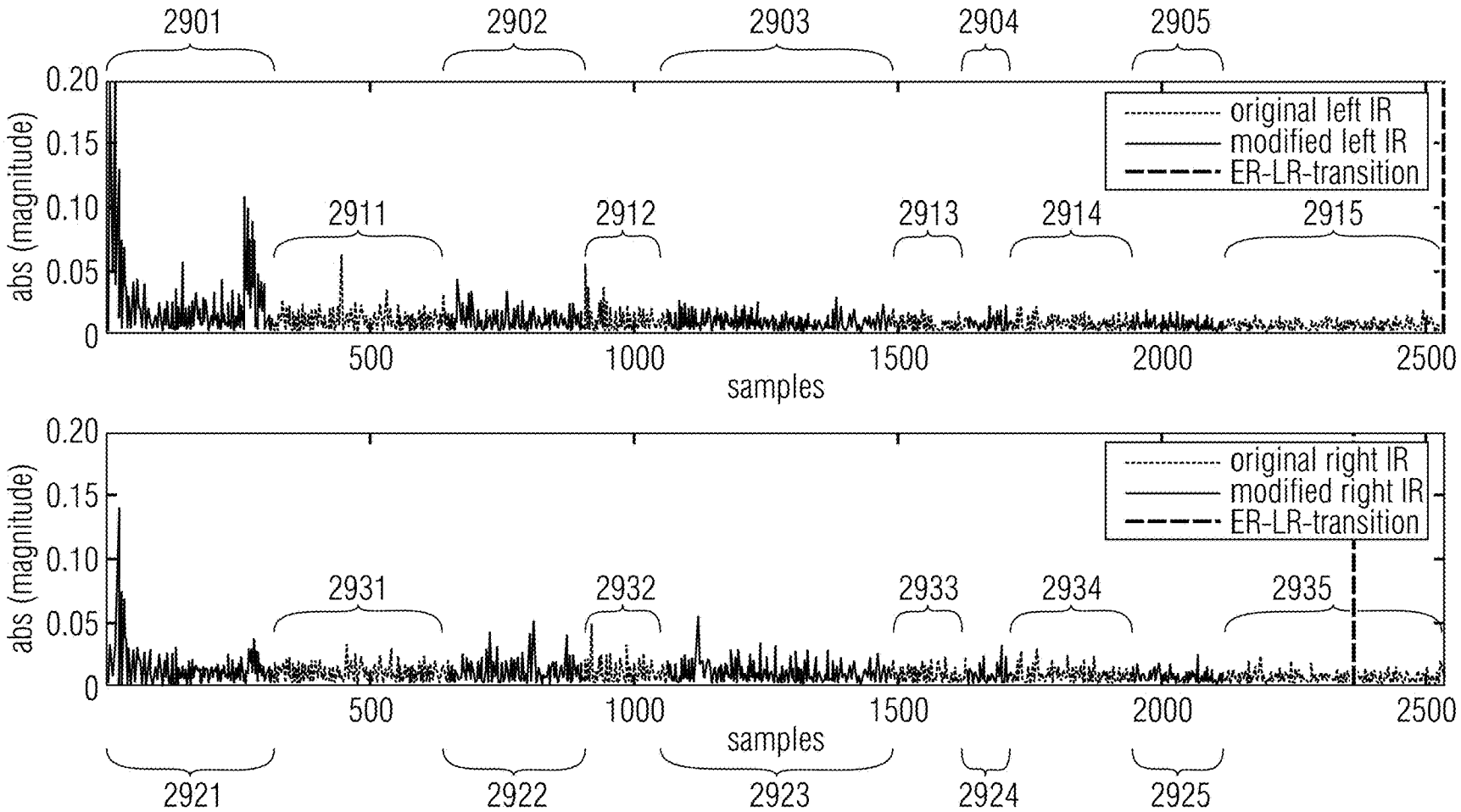
FIG. 29 shows a pair of elevated BRIRs.

FIG. 29 shows a pair of elevated BRIRs with sound source direction: azimuth 45°, elevation 55°. The sections 2911, 2912, 2913, 2914, 2915; 2931, 2932, 2933, 2934, 2935 are set to zero in the impulse responses 2901, 2902, 2903, 2904, 2905; 2921, 2922, 2923, 2924, 2925.

The approach for determining suppressed reflections is as follows. In the first section of the early reflections, everything between sample 300 and 650 is set to zero. The reflections here are spatial repetitions of the first ground and ceiling reflections (see FIG. 29). It can be assumed, that they are perceptually non-relevant in the BRIR, because of possible precedence or masking effects. The dominance of the first two reflections can also be seen in the BRIR plots (see FIG. 30). This supports the assumption made before. The range between sample 650 and 800 comprises comparatively weak reflections, however they seem to be important. It is thought that no suppressing effect extends until there, and although removing them only causes small perceptual differences, they remain in the BRIRs.

The beginning of the second section (800-900) seems not to be suppressed as well. The reflections here, show high peaks in the BRIR plots and originate from opposite directions. The reflection at sample 910 is a preceding repetition of the stronger reflection at sample 1080, and therefore perceptually irrelevant. The range between sample 900 and 1040 has been removed. From sample 1040 until 1250, there is a dominant group of reflections, which cannot be removed. Compared to the end of the first section, the end of the second section (1250-1490) is perceptually also less decisive, but still important.

Apart from two exceptions (1630-1680, 1960-2100) the complete third section is set to zero. Arriving at the sweet spot from almost all directions, the composition of reflections apparently has no directional cues.

Figure 30:
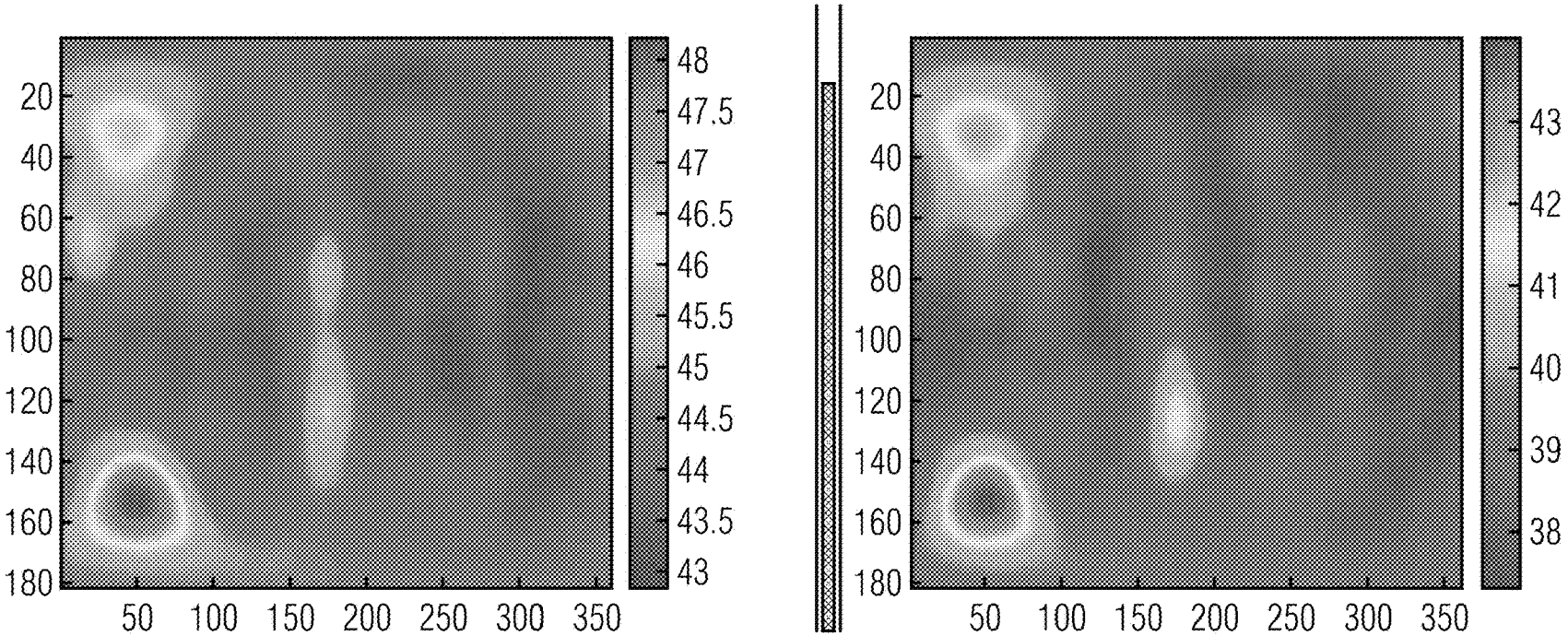
FIG. 30 shows the cumulative spatial distribution of all early reflections.

FIG. 30 illustrates an addition of all "snapshots" of the sound field analysis for all (left) early reflections and only the perceptually relevant (right) early reflections.

In particular; FIG. 30, left, shows the cumulative spatial distribution of all early reflections. In this plot the first and second sections can easily be recognized. For the source at azimuth angle 45° the first reflection group comes from the source direction and the second group from an angle around 170°. This distribution obviously causes sound cues, which result in natural sound impression and good localization, since they are comparable to those stored in the human auditory system.

Moreover, FIG. 30 shows the cumulative spatial distributions before (left) and after (right) removing the non-relevant reflections, that no important reflections have been removed. Furthermore, it is now easy to indicate the dominant reflections involved in localization. This knowledge is going to be used in the following, while searching for height perception cues in early reflections.

Figure 31:
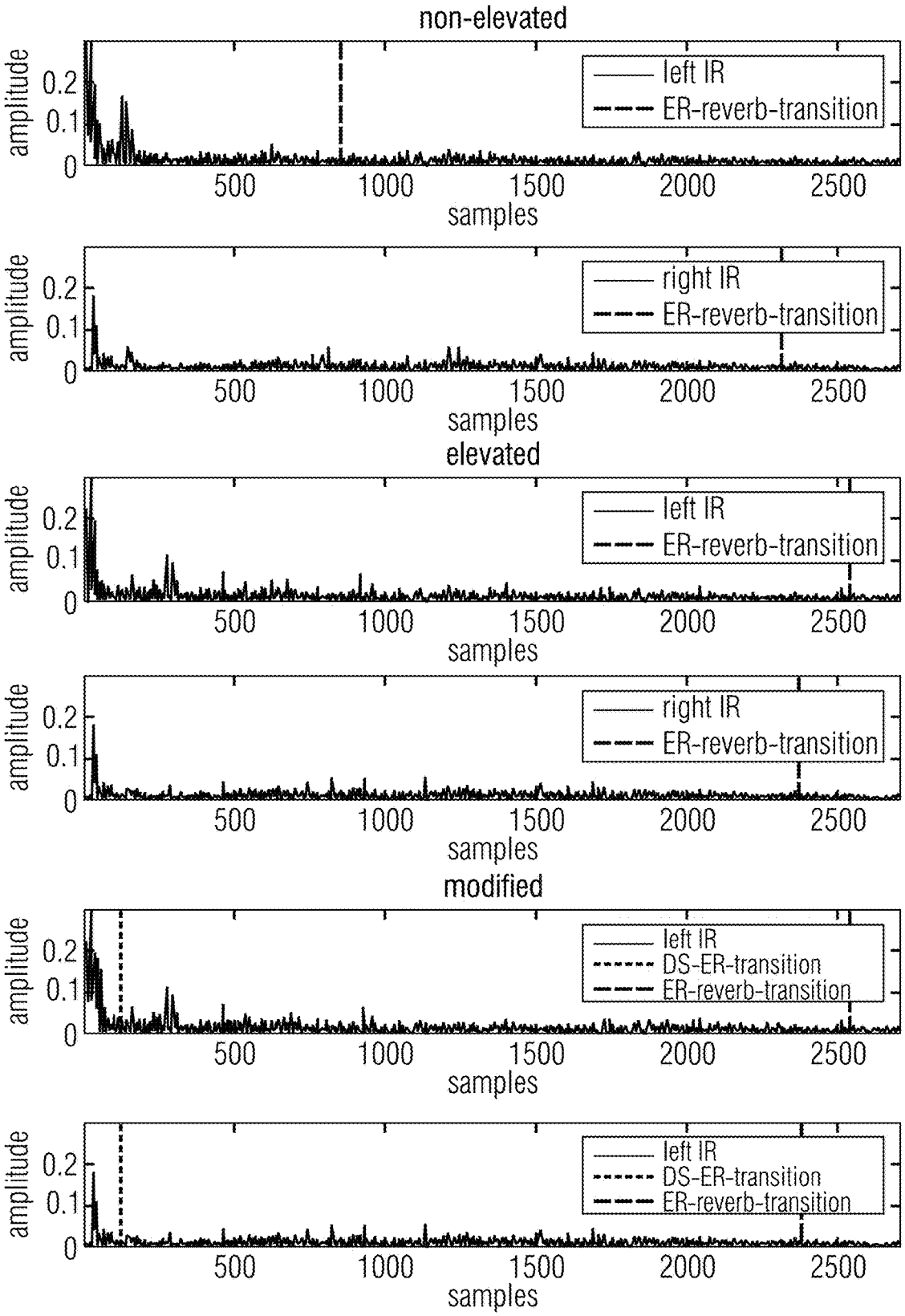
FIG. 31 illustrates the unmodified BRIRs that have been tested against the modified BRIRs in a listening test, while including three conditions.

FIG. 31 illustrates the unmodified BRIRs that have been tested against the modified BRIRs in a listening test, while including three more conditions. The first additional condition was to remove all early reflections; the second condition was to leave only the reflections being removed before; and the third condition was only to remove the first and second section of the early reflections (see FIG. 31).

FIG. 31 illustrates non-elevated BRIRs pair (1,2 row), elevated BRIRs pair (3,4 row) and modified BRIRs pair (5,6 row). In the last case, the early reflections of the elevated BRIRs have been inserted into the non-elevated BRIRs.

When listening to condition one, the direct sound is perceived from a less elevated angle. Moreover, two individual events (the direct sound and the reverb) are audible. Informal listening test appear to show that early reflections may have a connective property.

In the following, concepts are presented on which the present invention is particularly based.

At first, cues for height perception are considered.

Based on the above, now, it is considered whether early reflections support height perception? And does the spectral envelope of early reflections comprise cues for the height perception? In the following experiments the auditive evaluation is based on the feedback of a few expert listeners.

Early Reflections support Height Perception. This is demonstrated in an initial test that analyzes, if there are possible differences between the early reflections of non-elevated and those of elevated BRIRs, regarding the height perception. For the azimuth angle of 45°, two pairs of BRIRs are chosen. The early reflections of the elevated BRIRs are taken to replace the early reflections of the non-elevated BRIRs (see FIG. 32). It is expected, that the non-elevated BRIRs will then be perceived from a higher elevation angle.

Figure 32:
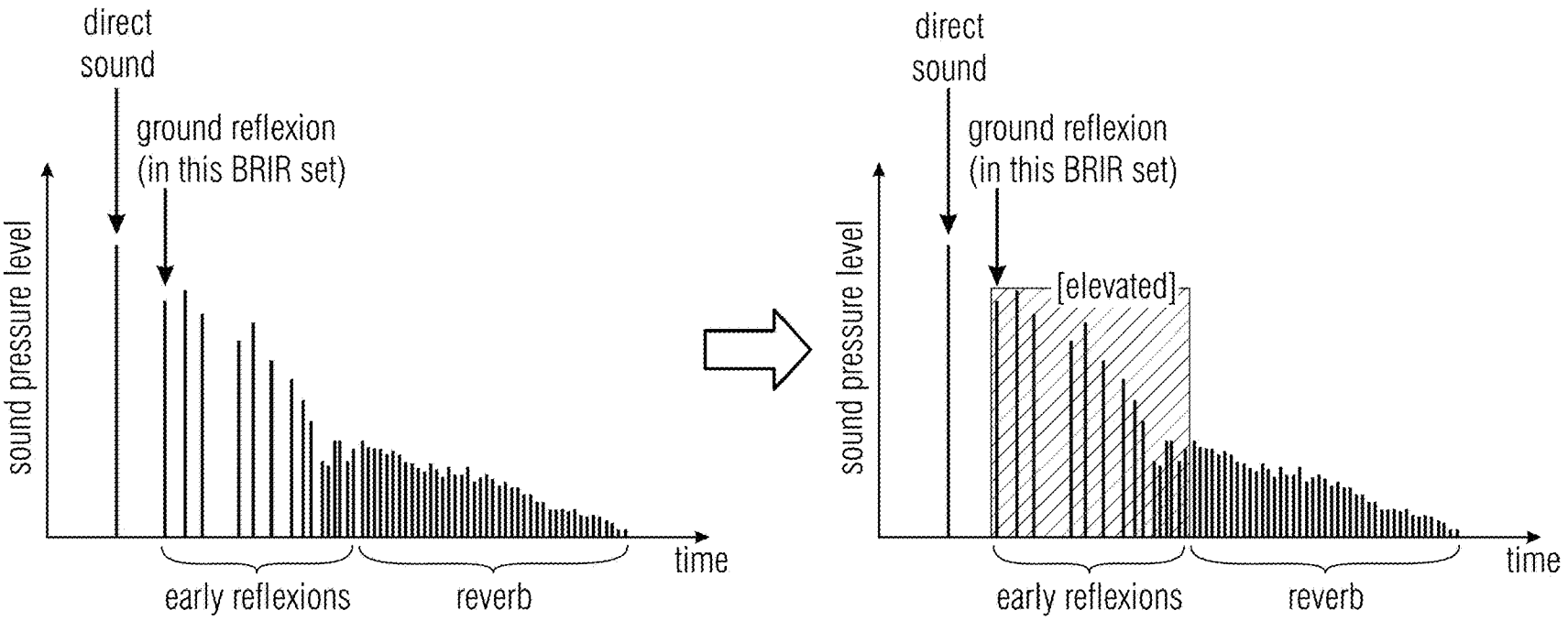
FIG. 32 illustrates for each channel a non-elevated BRIR which is perceptually compared to itself, additionally comprising early reflections of an elevated BRIR.

FIG. 32 illustrates for each channel, the non-elevated BRIR (left) is perceptually compared to itself (right), this time comprising early reflections of an elevated BRIR (box on the right side of FIG. 32).

The algorithm for estimating the transition point between early reflections and reverb is applied to each BRIR individually. Therefore four different values and four different lengths for early reflection ranges are expected. In order to exchange the early reflections of the BRIRs, the same length for each channel may be used. In this case, the extension into the area of the reverb is advantageous, over a reduction by removing the end of the early reflection part. Compared to the early reflections, the reverb does not comprise any directional Information and will not distort the experiment to great extent, as expected in the other case. As can be seen in FIG. 31 (rows 5 & 6), the early reflections in channel 1 begin at sample 120 and end at 2360. In channel 2 they begin at sample 120 and end at 2533.

That the non-elevated sound source is indeed perceived from a higher elevation angle. This means that early reflections are not only supporting the direct sound being perceived naturally, but also have audible direction-dependent properties.

The spectral envelope comprises information about the height perception. Being interested in the height perception of a sound source, the previous experiment is repeated, using only spectral information. Since the localization on the median plane is, in particular, controlled by spectral cues (and e.g., additionally by a time gap between direct sound and reverb), the aim is to find out whether modifications to the spectral domain are enough to achieve the same effect. This time the same BRIRs and also the same beginning and ending points representing the early reflection ranges have been used.

Figure 33:
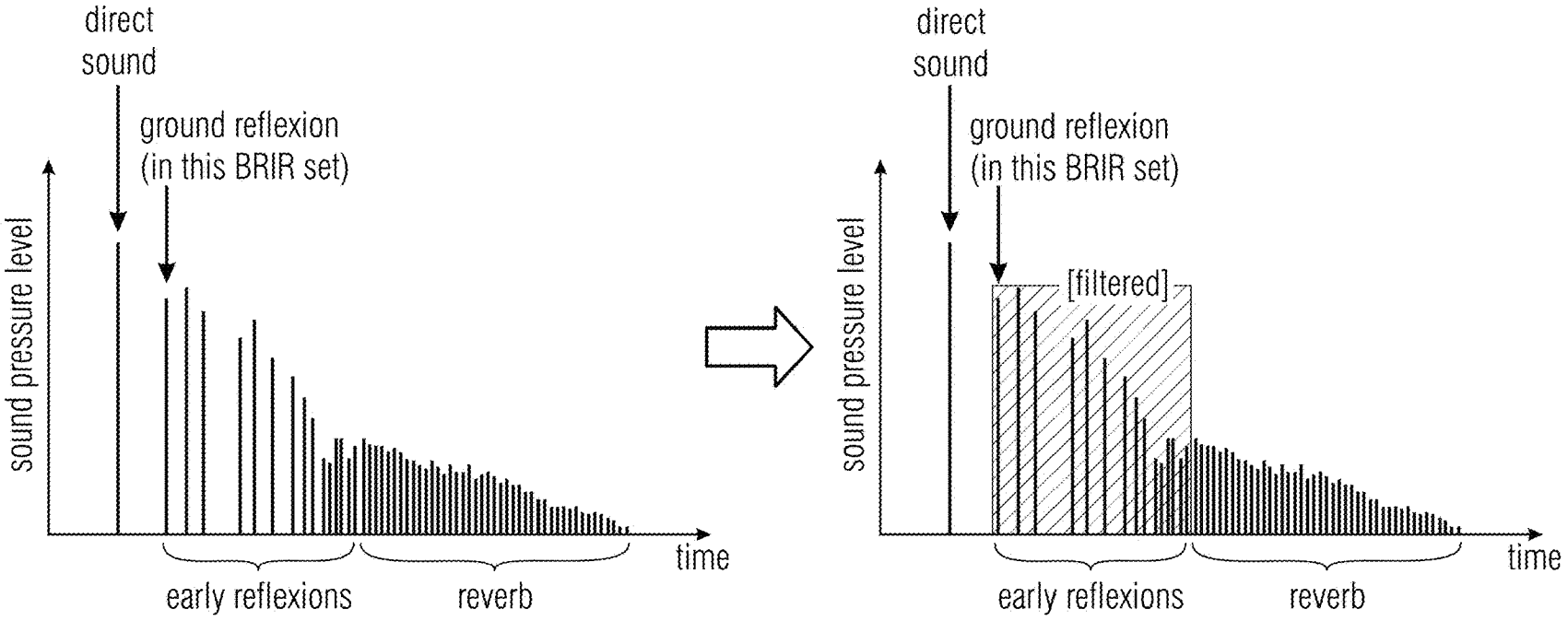
FIG. 33 illustrates the early reflections of a non-elevated BRIR (which is perceptually compared to itself, additionally comprising early reflections being colored by early reflections of an elevated BRIR channel-wise.

FIG. 33 illustrates the early reflections of the non-elevated BRIR (left) is perceptually compared to itself (right), this time the early reflections being colored by early reflections of an elevated BRIR channel-wise (box on the right side of FIG. 33). The early reflections of the elevated BRIRs are used as a reference to filter the early reflections of the non-elevated BRIRs channel-wise.

According to the filtering process for each channel:

The discrete Fourier transformation is calculated for the early reflections of the elevated BRIR to obtain $ER_{el,fft}$ The discrete Fourier transformation is calculated for the early reflections of the non-elevated BRIR to obtain $ER_{non\text{-}el,fft}$ The magnitudes of $ER_{el,fft}$ as well as $ER_{non\text{-}el,fft}$ are smoothed by a rectangular window, sliding over the ERB scale (see [034]), which gives an approximation to the bandwidths of the filters in human hearing, to obtain $ER_{el,fft,smooth}$, and $ER_{non\text{-}el,fft,smooth}$.

In order to compute a correction filter, first the reference curve is divided by the actual curve. This leads to a correction curve $CC_{smooth}=ER_{el,fft,smooth}/ER_{non\text{-}el,fft,smooth}$.

it is possible to create a minimum phase impulse response $IR_{correction}$ out of $CC_{smooth}$, by appropriate windowing in the cepstral domain (see [035]).

$IR_{connection}$ is used afterwards to filter the early reflections of the non-elevated BRIR The smoothing is executed here to obtain a simple correction curve.

For channel one, an energy difference of 4.3 percent and for channel two a value of 3.0 percent is obtained. These small differences can be seen in FIG. 34, between the spectral envelopes 3411, 3412 and the dashed spectral envelopes 3401, 3402.

Figure 34:
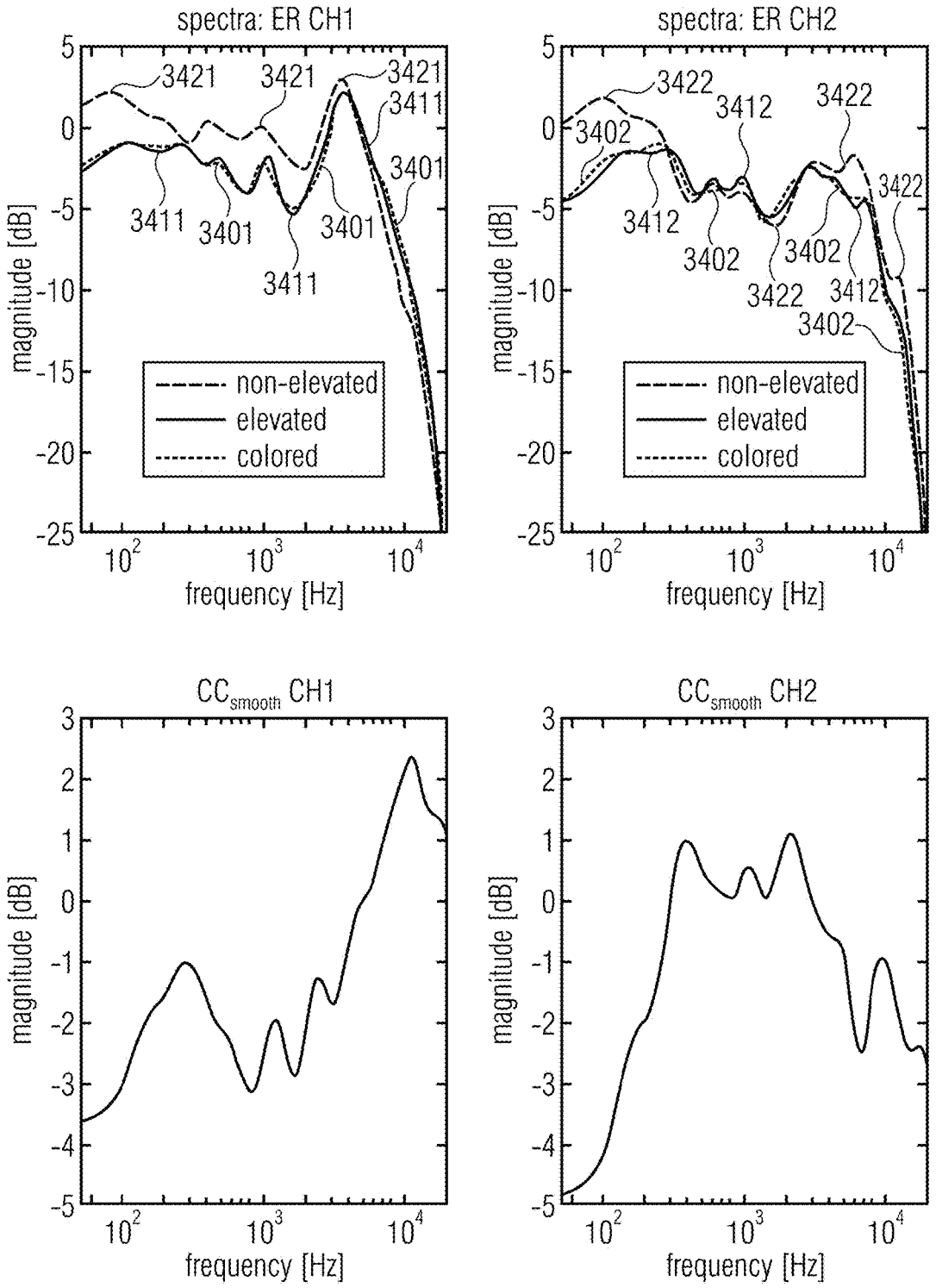
FIG. 34 illustrates spectral envelopes of the non-elevated, elevated and modified early reflections.

FIG. 34 illustrates spectral envelopes of the non-elevated early reflections 3421, 2422, elevated early reflections 3411, 2412 and modified (dashed) early reflections 3401, 3402 (first row). The corresponding corrections curves are shown in the second row.

The auditive comparison of the non-elevated and the spectrally modified BRIRs does not show an increase of the elevation angle. And also the correction curves only have a dynamic range of 6 dB. It seems that not the spectrum of all early reflections comprises information about the height.

From the above it is known, that not the entire range of the early reflections is audible. that inaudible parts being included in the spectral modifications of the last experiment, distort the results. Especially, the third part of the early reflection range, where reflections come from all directions, could be responsible for the low dynamic range of the correction curves. Therefore the last experiment is repeated, this time focused only on the audible early reflections.

The sections being chosen for the audible reflections are given in Table 1:

TABLE 1

```
ER_1_0 = [brir_0(120:200,1); brir_0(580:720,1);
brir_0(820:1110,1); brir_0(1300:1680,1); brir_0(1860:2100,1)];
ER_2_0 = [brir_0(120:200,2); brir_0(580:720,2);
brir_0(820:1110,2); brir_0(1300:1680,2); brir_0(1860:2100,2)];
ER_1_35 = [brir_35(120:300,1); brir_35(630:900,1);
brir_35(1040:1490,1); brir_35(1630:1680,1); brir_35(1960:2100,1)];
ER_2_35 = [brir_35(120:300,2); brir_35(630:900,2);
brir_35(1040:1490,2); brir_35(1630:1680,2); brir_35(1960:2100,2)];
```

Table 1 depicts audible sections of the early reflections of the elevated and non-elevated BRIRs. Due to the strong overlapping, ITD are not considered here. A Tukey-Window is used to fade in and fade out the sections, while setting the rest to zero.

Figure 35:
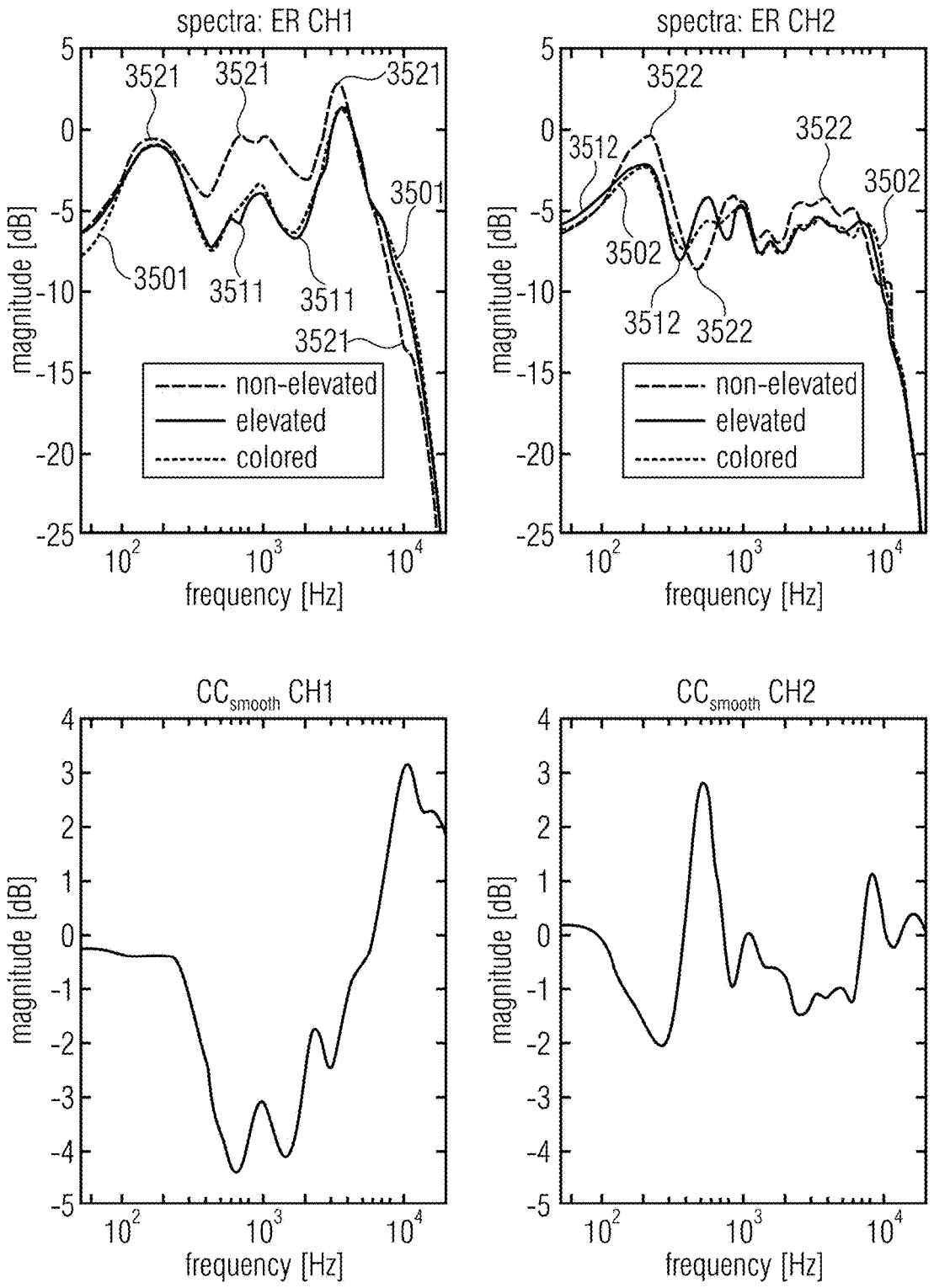
FIG. 35 depicts spectral envelopes of the audible parts of the non-elevated, elevated, and modified, early reflections.

FIG. 35 depicts spectral envelopes of the audible parts of the non-elevated early reflections 3521, 3522, elevated early reflections 3511, 3512 and modified (dashed) early reflections 3501, 3502 (first row). The corresponding corrections curves are shown in the second row.

In the following, an analysis of the spectral envelopes is conducted.

As already mentioned, the localization on the median plane is controlled by amplifications of certain frequency ranges. Hence, spectral cues are responsible for perceiving sources from elevated angles and the investigations in this work are still focused on finding the desired cues in the spectral domain.

Using the spectral envelopes of early reflections of elevated BRIRs to modify non-elevated BRIRs did not increase the elevation angle of a sound source. Comparing the spectral envelopes of all early reflections with those of single reflections, it can be said that single reflections have a more dynamic spectral course in the audible range (up to 20 kHz). In contrast, the overall spectra show rather flat curves (see FIG. 36).

Figure 36:
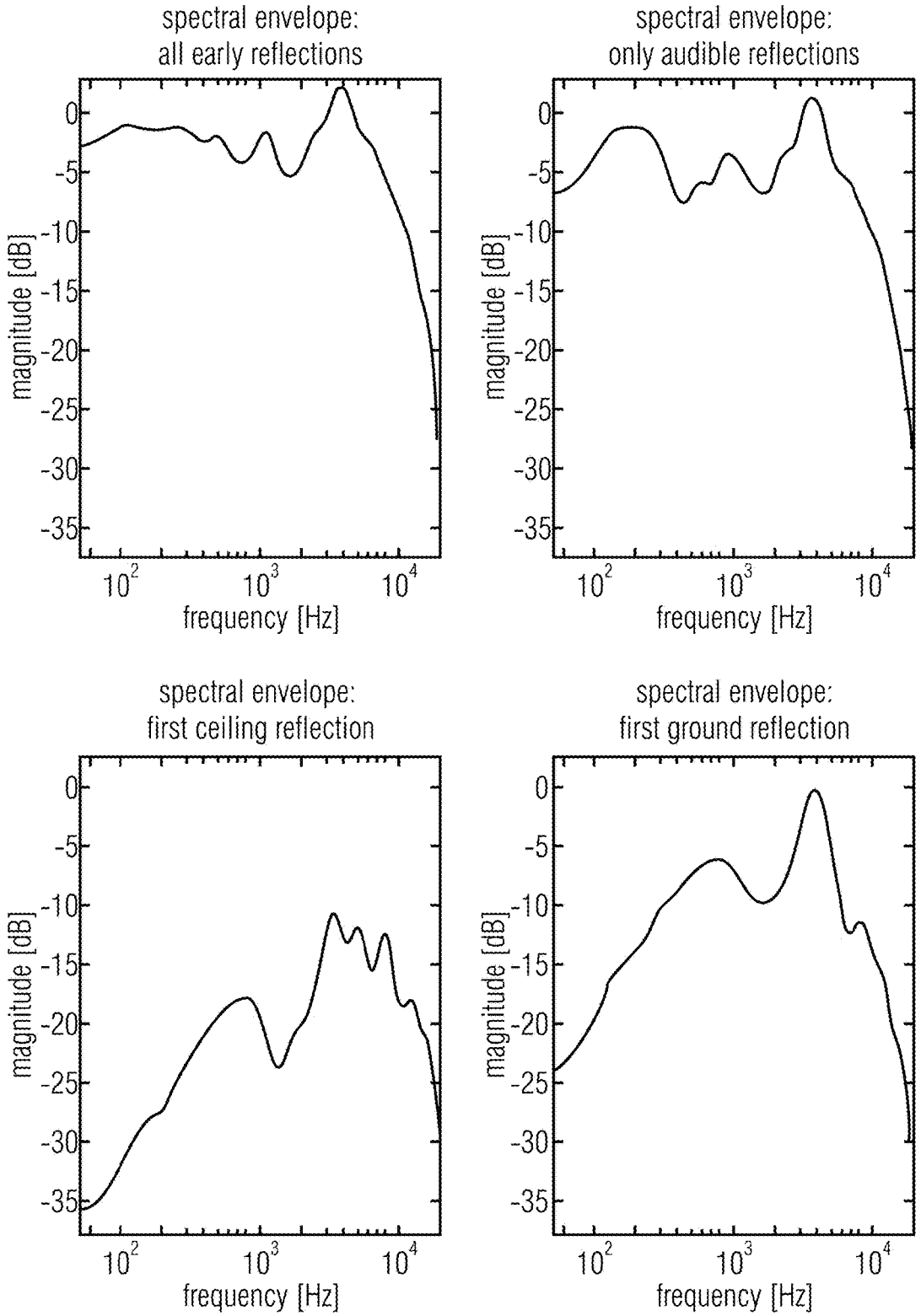
FIG. 36 illustrates a plurality of correction curves.

FIG. 36 shows a comparison of spectral envelopes: The spectral envelopes of all early reflections or even all audible early reflections show a flat curve in the audible range (up to 20 kHz). In contrast, the spectra of single reflections ($2^{nd}$ row) have a more dynamic course. In particular, FIG. 36 shows the resulting correction curves. Although, this time the patterns as well as the dynamic ranges have changed, perceptually there are no significant changes regarding the elevation angle. While, there is at least 4.5 dB difference in the spectral envelope on the ipsilateral ear (CH1), there are no substantial differences between the envelopes on the contralateral ear. These values are relatively small, considering that the range they modify lies after the dominating direct sound.

It is possible, that early reflections still have an important influence on the naturalness of the sound impression as a group, which is essential for introducing height perception while listening to virtual sound sources. However, it stands to reason that the cues for the height perception are located within the spectra of single reflections. The knowledge about the spatial distribution of the reflections gained by the microphone array measurements is used in the following experiments.

Now a concept, which amplifies early reflections from higher elevation angles is presented.

Determine the reflections comprising the cues for height perception by amplifying them. Intuitively, if there are any single reflections comprising these cues, then they might arrive at the listener from higher elevation angles.

In a previous test, it was tried to shift the energy from the reflections coming from lower elevation angles to those coming from higher elevation angles. Unfortunately, there are only two reflections from lower elevation angles, which are not within the inaudible ranges. This situation was observed in all directions, since the geometry properties for the measured loudspeakers in "Mozart" are almost identical. In comparison, it is not fatal if reflections from higher elevation angles lie within the inaudible sections. Amplifying these reflections will cause them to exceed the suppressing effect and become perceivable. However, in this case four reflections can be separated from the impulse response, without having strong overlapping areas to adjoining reflections. The corresponding values are given in table TA2. Because of the small amount of reflections being used in this experiment, gain values of only 1.14 for the $1^{st}$ and 1.33 for the $2^{nd}$ channel are obtained. They are not enough to induce an enhancement in height perception. Several other approaches for systematically shifting energies from other parts to the four reflections with higher elevation angles led to similar results.

For this reason, an attempt is made to find appropriate gain values, based on auditory evaluated tuning. Different values in the range between the range of 3 and 15 are chosen to amplify each of the four reflections. These reflections are shown in FIG. 37.

Figure 37:
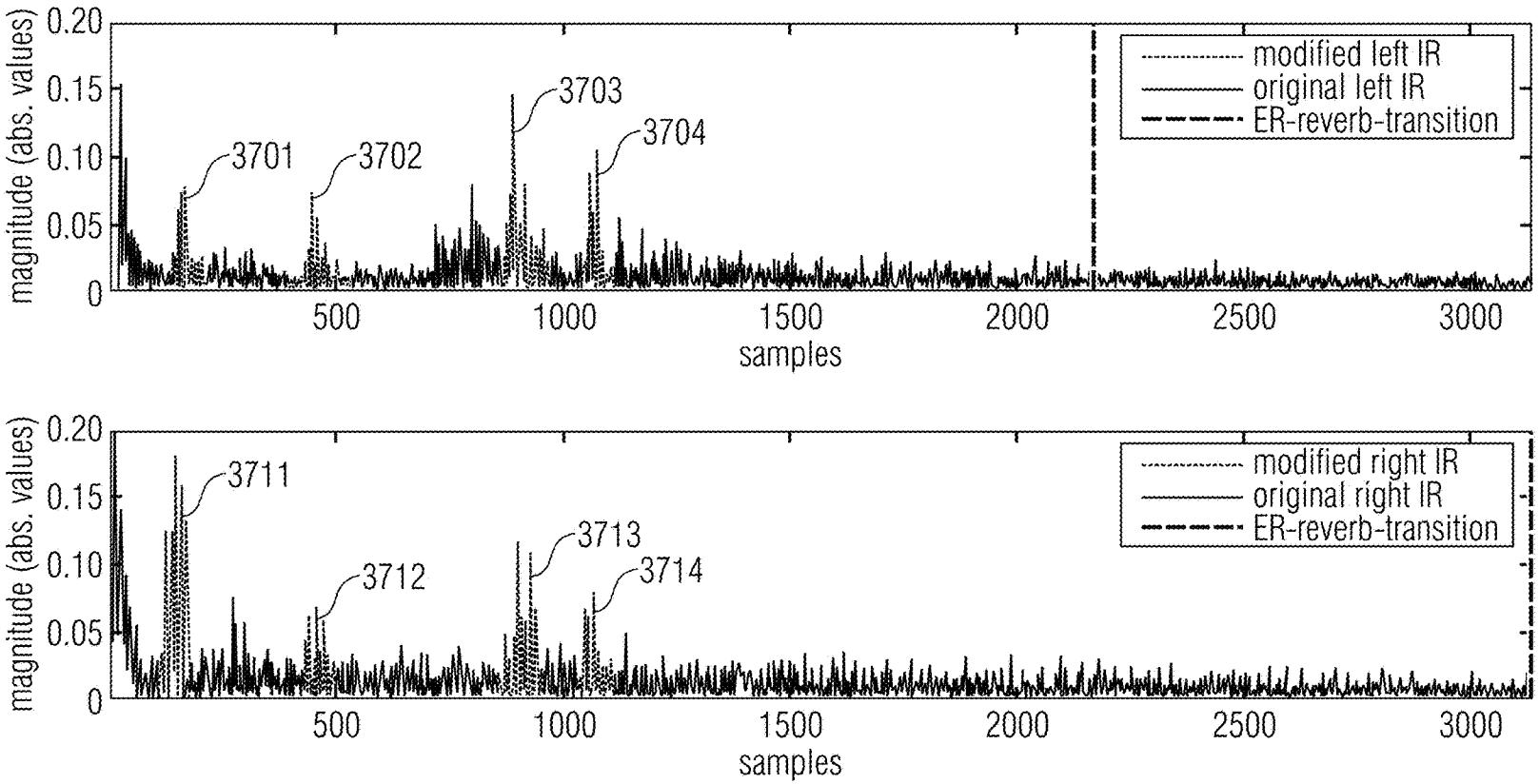
FIG. 37 illustrates four selected reflections arriving at the listener from higher elevation angles which are amplified.

FIG. 37 illustrates four selected reflections 3701, 3702, 3703, 3704; 3711, 3712, 3713, 3714 arriving at the listener from higher elevation angles which are amplified by the value 3. Reflections behind sample 1100 have strong overlapping to adjoining reflections and hence cannot be separated from the impulse responses.

They are amplified and represented by the curve 3701, 3702, 3703, 3704, and by the curve 3711, 3712, 3713, 3714. While comparing the amplified reflections perceptually, it showed up that the $2^{nd}$ reflection 3702; 3712 and $3^{rd}$ reflection 3703; 3713 cause spatial shifts on the azimuth plane rather than the median plane. This results in a strongly reverberant sound impression.

The amplification of the $1^{st}$ reflection 3701; 3711 and $4^{th}$ 3704; 3714 reflection yields to an enhancement of the perceived elevation angle. While comparing them, the amplification of the $1^{st}$ reflection 3701; 3711 leads to more changes in timbre than the $4^{th}$ reflection 3704; 3714. Moreover, in case of the $4^{th}$ reflection 3704; 3714 the source sounds more compact. Nevertheless, amplifying them simultaneously, leads perceptually to the best result. The relation of both gain values is important. It could be observed, that the $4^{th}$ gain value has to be higher than the first. After several attempts, gain values of 4 and 15 were found and confirmed by expert listeners, as having the largest and natural as possible effect. It should be noted that deviations of these values only cause small effect changes. Therefore, they will be used as orientation values in the following experiments.

In the following, specific embodiments of the present invention are provided.

In particular, concepts for elevating virtual sound sources are described.

The results above have shown that the two reflections appearing from higher elevation angles indeed comprise cues, which are responsible for the height impression. Being amplified at their original positions within the BRIRs, the temporal cues do not change. In order to ensure the height enhancement is caused by spectral and not temporal cues, the spectra are isolated to create a filter.

Because of its high sound level, the direct sound dominates the localization process. The early reflections are of secondary importance, and are not perceived as an individual auditory event. Influenced by the precedence effect, they support the direct sound. Hence, it is reasonable to apply the created filter to the direct sound, in order to modify the HRTFs.

A geometrical analysis of the two reflections provides the finding that considering the positions of both reflections in the BRIRs, and the elevation angles in the spatial distribution representation, the reflections can be identified as $1^{st}$ and $2^{nd}$ order ceiling reflections.

Figure 38:
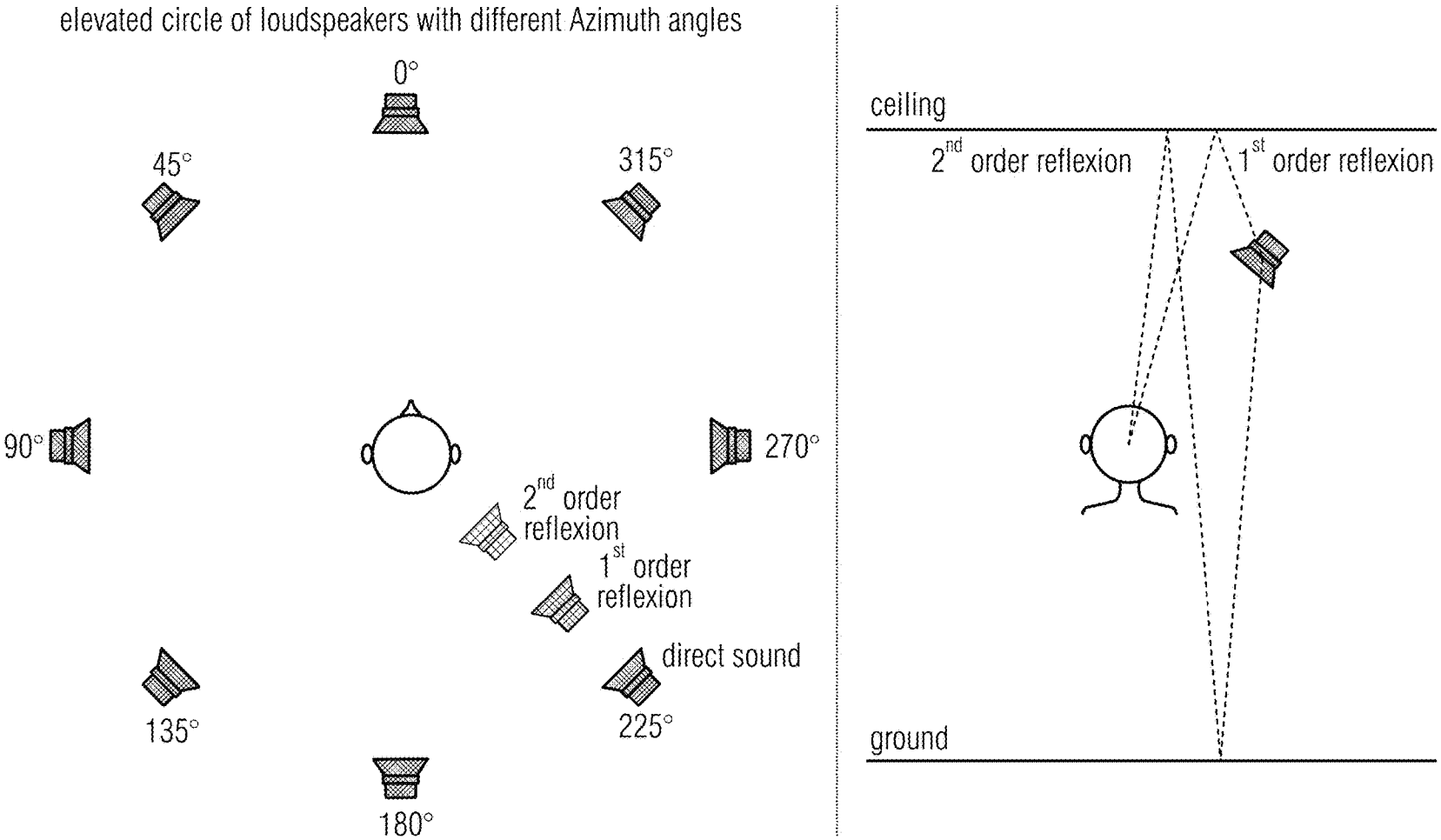
FIG. 38 depicts an illustration of both ceiling reflections for a certain sound source.

FIG. 38 depicts an illustration of both ceiling reflections for a certain sound source. Top view (left) and rear view (right) to the listener and the loudspeakers.

In particular, FIG. 38 shows in a top and a rear view the geometrical situation. The $2^{nd}$ order reflection is of course weaker, and because of being reflected twice, acoustically less similar to the direct sound as the $1^{st}$ order reflection. However, it arrives at the listener from a higher elevation angle. The gain value of 15, being determined as described above, underpins its importance.

In the left illustration of FIG. 38, it can be seen that both reflections appear from the same direction as the direct sound, while having different elevation angles (right illustration). Because of the symmetry of the measurement set-up, this geometrical situation is given for each of the four (diagonal) loudspeakers measured on the elevated ring. It could be observed, that the positions of both reflections in the corresponding BRIRs are the same. Therefore, without having the sound field analysis results for the loudspeakers at azimuth angles $\alpha \in \{0°, 90°, 180° \text{ and } 270°\}$), they can also be used in the following investigations.

In the following, spectral modification of the direct sound according to embodiments is described.

The filter target curve is formed by the combination of the two ceiling reflections. Here, not the absolute gain values (4 and 15) but only their relation is used. Hence, the 1st order reflection is amplified by one and the $2^{nd}$ order reflection by four. Both reflections are consecutively merged to one signal in the time domain. For the spectral modifications of the direct sound a Mel filterbank is used. The order of the filterbank is set to M=24 and the filter length to $N_{MFB}$=2048.

Figure 39:
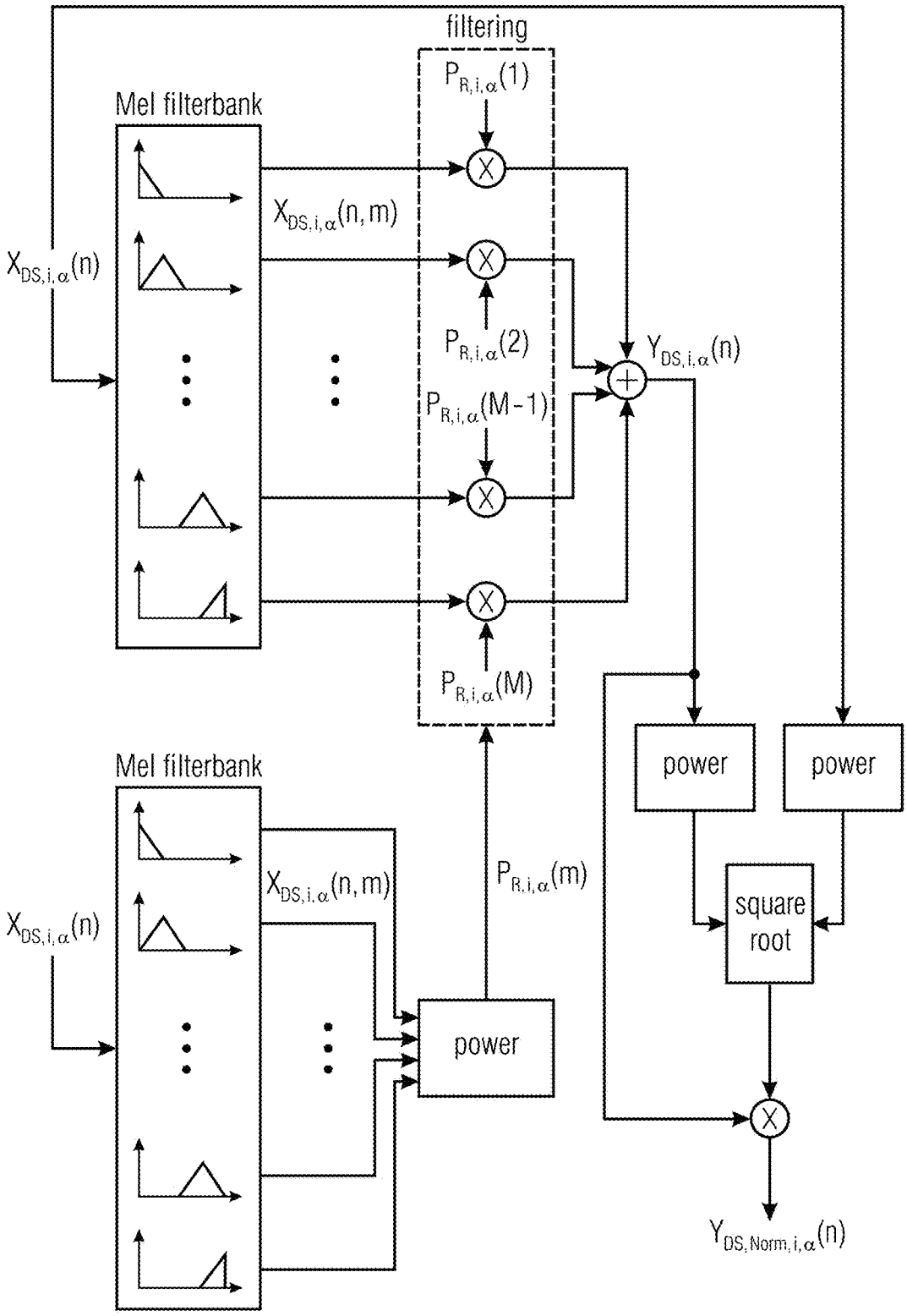
FIG. 39 illustrates a filtering process for each channel using the Mel filterbank.

FIG. 39 illustrates a filtering process for each channel using the Mel filterbank. The input signal $x_{DS,i,\alpha}$ (n) is filtered with each of the M filters. The M subband signals are multiplied with the power vector $P_{R,i,\alpha}$(m) and are added finally to one signal $y_{DS,i,\alpha}$ (n).

The filtering process shown in FIG. 39 is explained step wise:

1. The direct sound $x_{DS,i,\alpha}$ (n) is filtered by the Mel filterbank to obtain M subband signals $x_{DS,i,\alpha\,(n,m)}$. The index i∈{1,2} denotes the channels, a the azimuth angle of the sound source, n the sample position and m∈[1,M] the subband.
2. The combination of the reflections $x_{R,i,\alpha}$ (n) is filtered by the Mel filterbank to obtain M subband signals $x_{R,i,\alpha}$ (n,m) and the power of each subband signal, stored in a power vector $P_{R,i,\alpha}$ (m). The power is calculated by equation (15):

$$P = \frac{1}{N}\sum_{n=0}^{N-1} x(n)^2,\ N\text{: Signal length} \tag{15}$$

3. The power vector $P_{R,i,\alpha}$ (m), which implicitly comprises the filter target curve, is used to weight $x_{DS,i,\alpha}$ (n,m) in each subband.
4. After $x_{DS,i,\alpha}$ (n,m) being multiplied with $P_{R,i,\alpha}$ (m) in the time domain, the weighted subband signals are added together to obtain the complete filtered signal $y_{DS,i,\alpha}$ (n).

After filtering, the ILD between the direct sound impulses is changed. It is now defined through the combination of both reflections in each channel. Therefore, the modified direct sound impulses may be corrected to their original level values. The power of the direct sound is calculated before ($P_{Before,i,\alpha}$) and after ($P_{After,i,\alpha}$) filtering and a correction value $$G_{i,\alpha} = \sqrt{\frac{P_{Before,i,\alpha}}{P_{After,i,\alpha}}}$$

is calculated channel-wise. Each direct sound impulse is then weighted by the corresponding correction value to obtain the original level.

Figure 40:
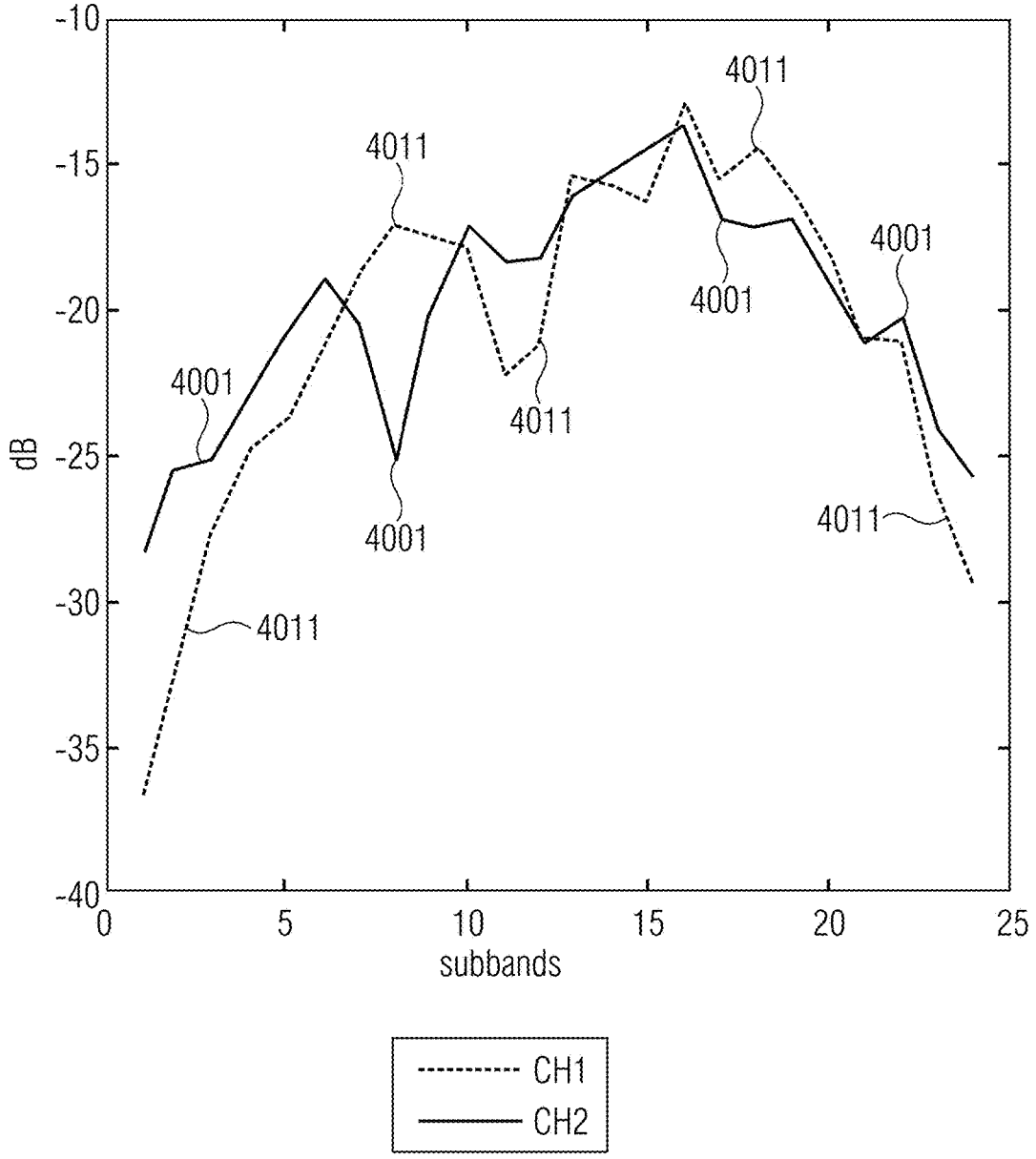
FIG. 40 depicts a power vector for a sound source from azimuth angle $\alpha=225°$.

FIG. 40 depicts a power vector $P_{R,i,\alpha}$(m) for a sound source from azimuth angle α=225°. Here, the curve 4001 causes a correction at the ipsilateral and the curve 4011 at the contralateral ear.

The correction of FIG. 40 is expressed in an increase of the subband signal power in the midrange. The shapes of the ipsilateral and contralateral correction vectors are similar. After an informal listening test, the listeners reported about a clear height difference to the unmodified BRIRs. The elevated sound was perceived having a larger distance and less sound volume. For a few azimuth angles an increase in reverb was audible, which makes the localization more difficult.

In the following, variable height generation according to embodiments is considered.

Figure 41:
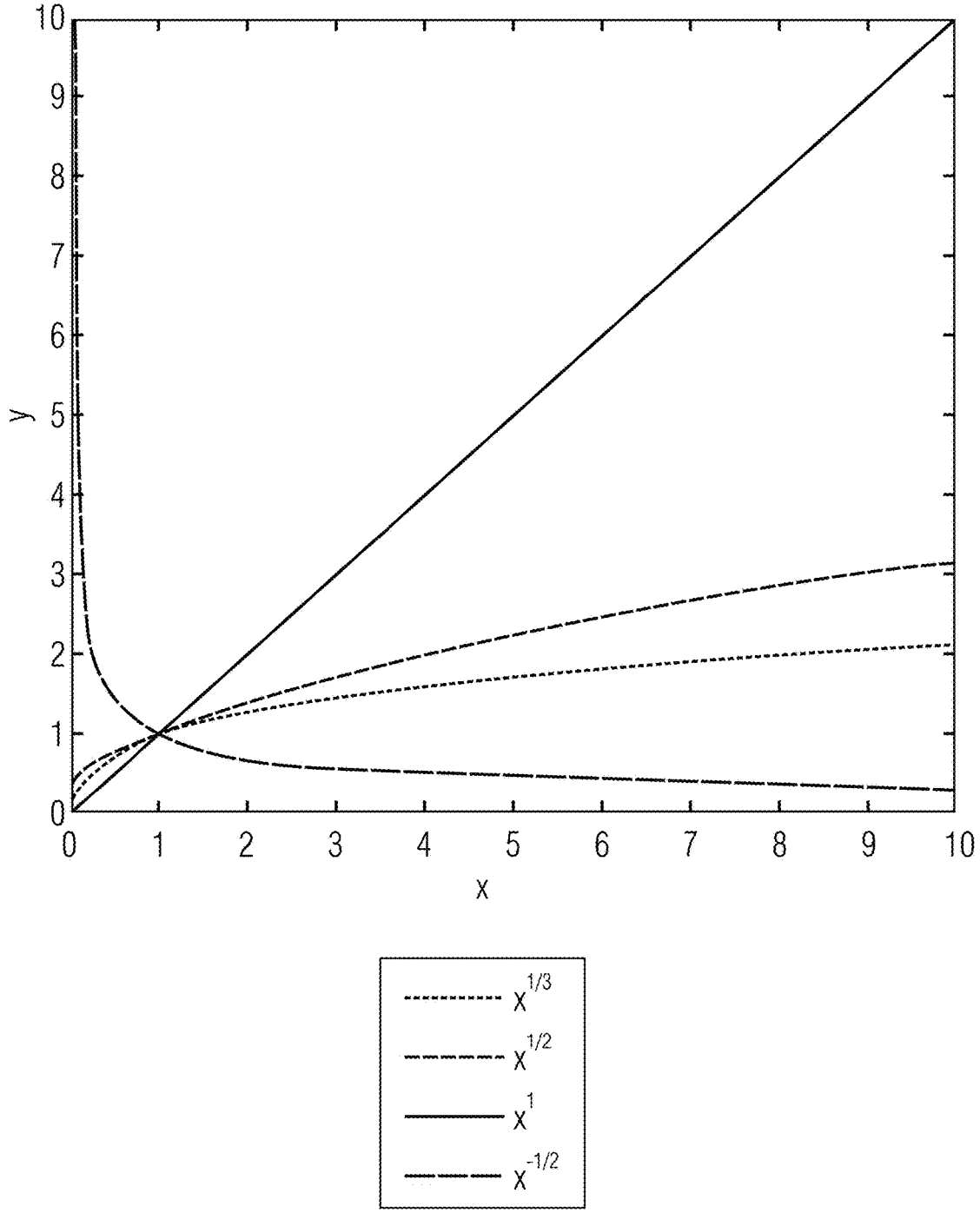
FIG. 41 depicts different amplification curves caused by different exponents.

FIG. 41 depicts different amplification curves caused by different exponents. Considering an exponential function $x^{1/2}$, values smaller than one will be amplified and values lager than one will be attenuated (see FIG. 41). When changing the exponent value, different amplification curves are obtained. In case of 1, no modifications are executed.

Figure 42:
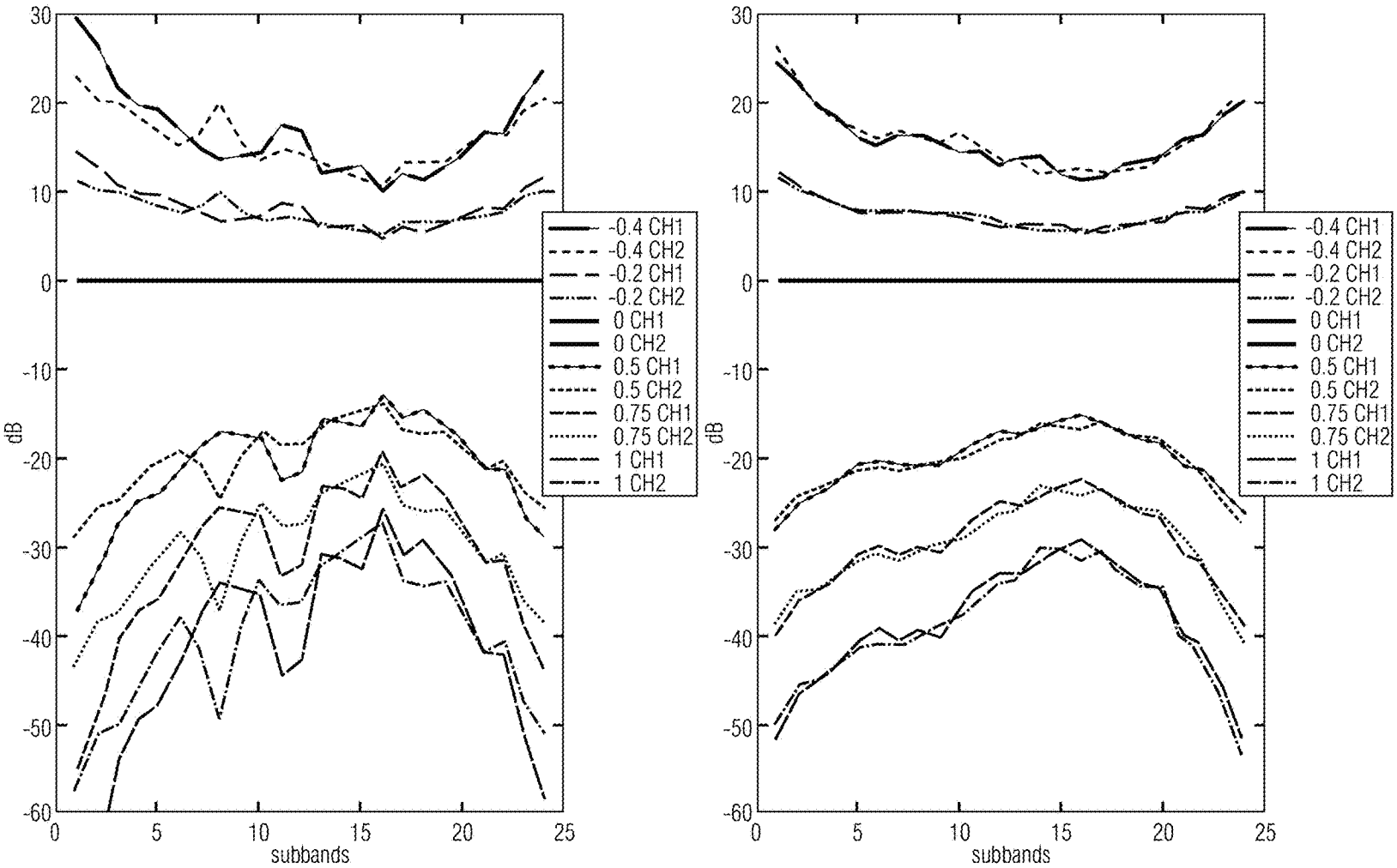
FIG. 42 depicts different exponents being applied to $P_{R,i,225°}(m)$ and to $P_{R,i}(m)$.

FIG. 42 depicts different exponents being applied to $P_{R,i,225°}$(m) (left) and to $P_{R,i}$(m) (right). As a result, different shapes are achieved. In the left plot the azimuth angle is α=225°. Here CH1 refers to the contralateral and CH2 to the ipsilateral channel. In the right plot CH1 refers to the left ear and CH2 to the right ear, since the curves are averaged over all angles.

Applying this mechanism to $P_{R,\alpha}$, different curve emphasis can be achieved. As can be seen in FIG. 42, the strength of the spectral modification of the direct sound can be controlled by the exponential value to control the filter curve and therefore, the height enhancement of the sound source. In contrast, negative exponents lead to a band stop behavior, by attenuating the subband signals in the midrange. The modified direct sound impulses are again corrected to their original level values, afterwards.

An informal listening test has been executed and evaluated. It was reported, that raising the exponents causes the sound source to move up. For negative exponents it moves down. It was also reported, that the timbre changes strongly when lowering the source. It changes to a very "dully" timbre. Moreover, it can be observed, that it is reasonable to limit the range of the exponents to [−0.5, 1.5]. Smaller and higher values cause strong timbre changes, while tending to smaller height differences.

In the following, direction-independent processing according to embodiments is described. Until now, the processing has been executed for each azimuth angle individually. Depending on the azimuthal direction, each sound source was modified by its own reflections, as shown in FIG. 38. Since it is known, that the reflections being involved in the processing appear at the same positions in the BRIRs, the processing can be simplified. Comparing $P_{R,i,\alpha}$ (m) for each direction, one can observe that all curves appear to show a bandpass behavior. Therefore, $P_{R,i,\alpha}$ (m) is reduced to $P_{R,i}$ (m) by averaging over all azimuth angles.

Figure 43:
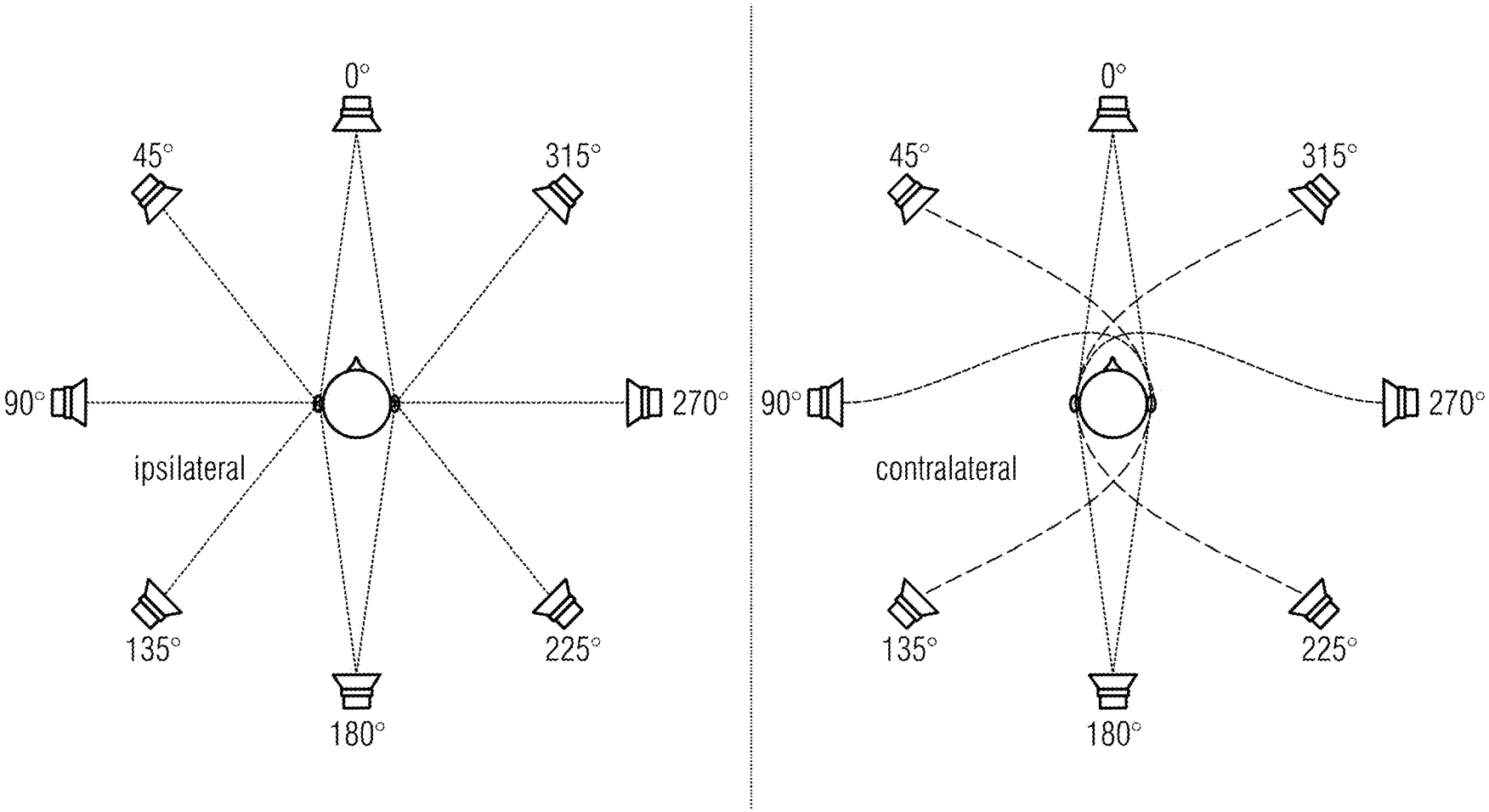
FIG. 43 shows ipsilateral and contralateral channels for the averaging procedure.

It should be noted, that $P_{R,i}$ (m) still depends on, whether the processing is executed on the ipsilateral or the contralateral ear. The averaging process is executed case-dependent, as shown in FIG. 43. On the left side, all ipsilateral signals are averaged, and on the right side, all contralateral signals are averaged. For the loudspeakers at azimuth angles α=0° and α=180°, there is a symmetry in both channels. For this reason, it is not distinguished between ipsilateral and contralateral, such that both are used in each case.

FIG. 43 shows ipsilateral (left) and contralateral (right) channels for the averaging procedure. The two loudspeakers in front and behind the measurement head have symmetric channels. Therefore for these angles it is not distinguished between ipsi- and contralateral.

Figure 44:
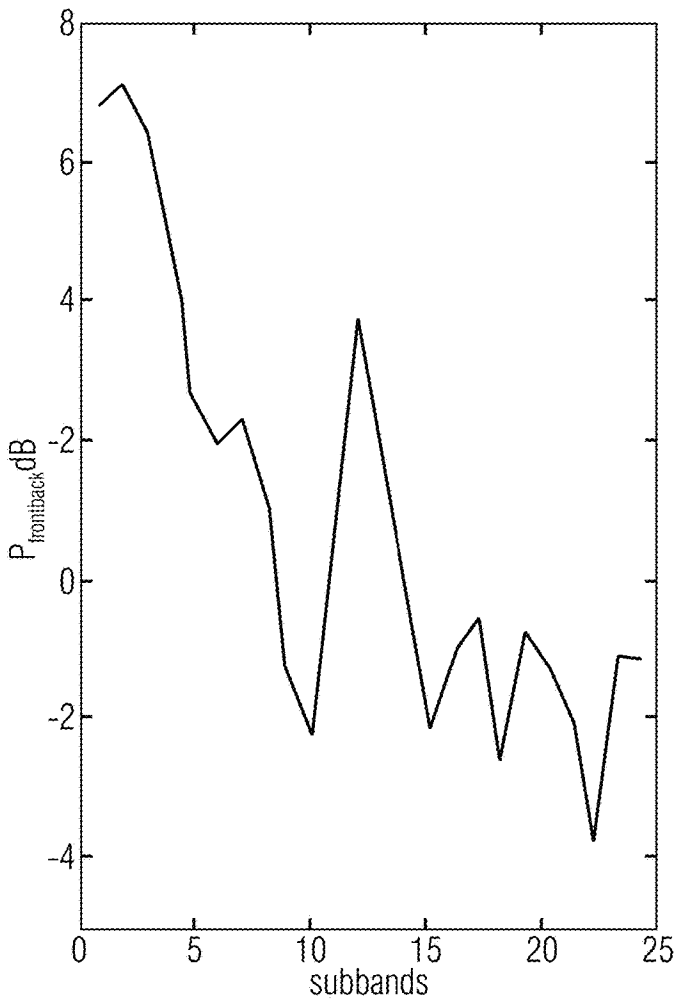
FIG. 44 depicts $P_{R,IpCo}$ and $P_{FrontBack}$.
Figure 44:
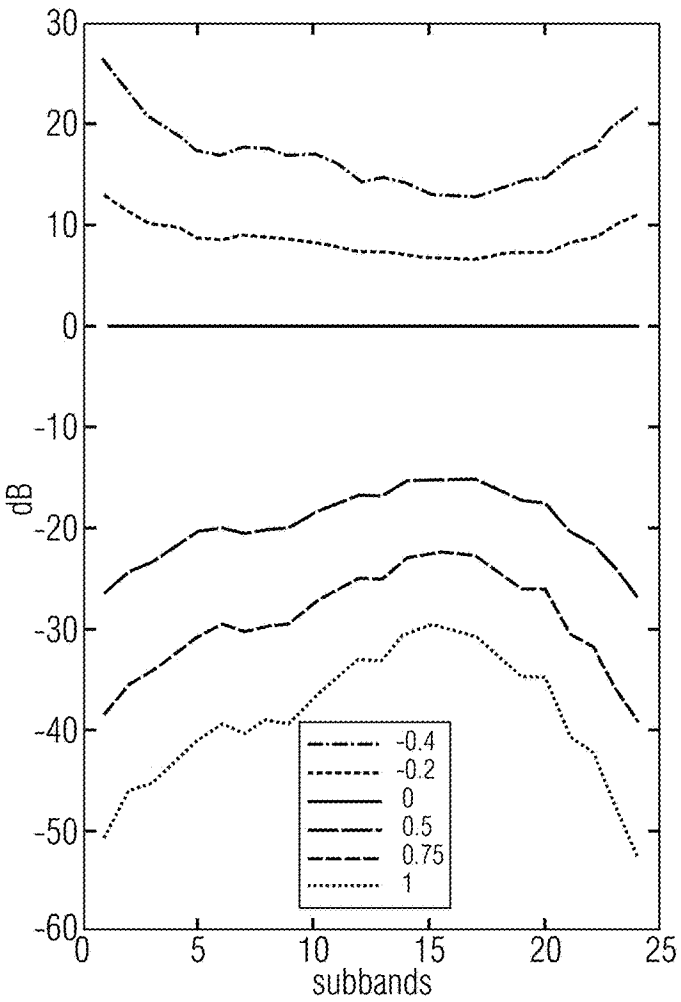

As can be seen in FIG. 42 (right), after the averaging process the differences between the channels are reduced. An informal listening test shows that an additional averaging over both channels, to obtain only one curve $P_R$(m) per exponent, does not cause auditory differences. The averaged curves are shown in FIG. 44 (left).

In the following, front-back-differentiation is considered.

The spectral cues, which are responsible for the "Front-Back-Differentiation", are comprised in the direct sound and in the target filter curve. The cues in the direct sound are suppressed by being filtered and the cues in the target curve are suppressed by averaging $P_{R,i,\alpha}(m)$ over all azimuth angles. Therefore, these cues have to be emphasized again in order to obtain a stronger "Front-Back-Differentiation". This can be achieved as follows.

1. Averaging $P_{R,i,\alpha}(m)$ all channels and all $\alpha \in [90°,270°]$ to obtain $P_{Back}(m)$.
2. Averaging $P_{R,i,\alpha}(m)$ all channels and all $\alpha \in [270°,90°]$ to obtain $P_{Front}(m)$.
3. Calculating $P_{FrontBackmax}(m)=P_{Front}(m)/P_{Back}(m)$ to obtain a difference curve between the frontal and rear directions, as shown in FIG. 44 (right). For achieving a stronger smoothing effect, $P_{R,i,\alpha}(m)$ for $\alpha=90°$ and $\alpha=270°$ are used twice. They do not comprise any frontal or rear information, because being located on the frontal plane, and do not distort the resulting curve. Hypothetically, applying this curve to the elevated source at $\alpha=180°$ would move it to $\alpha=0°$.
4. Depending on the source direction, the curve is exponentially weighted by a half cosine $P_{FrontBack}(m,\alpha)=P_{FrontBackmax}(m)^{0.5*cos(\alpha)}$. For $\alpha=0°$, $P_{FrontBackmax}(m)$ has the half of its maximum extent, and for $\alpha=180°$, the half of its inverse extent. For the angles $\alpha=90°$ and $\alpha=270°$ it is 1, since the cosine turns to be zero.
5. $P_{FrontBack}(m,\alpha)$ is multiplied with $P_R(m)$ in the filtering process.

FIG. 44 depicts $P_{R,IpCo}$ (left) and $P_{FrontBack}$ (right).

With $P_R(m)$ and $P_{FrontBack}(m,\alpha)$ it is possible to enhance the height perception continuously of every sound source being measured on the ring for the elevation angle of $\beta=55°$. This enhancement method has been applied to the sources being measured on the non-elevated ring in "Mozart". Also in this case, a height enhancement could be perceived. Moreover, an attempt was done in order to elevate the non-elevated sources, while using their own reflections. Unfortunately, the $2^{nd}$ order ceiling reflection in that case is strongly overlapped by other reflections. Nevertheless, when using only the $1^{st}$ order ceiling reflection, a height difference is perceivable.

In a further step, this method was applied to BRIRs being measured with a human head, while using the reflections of the BRIRs being measured with "Cortex". Although, the "Cortex" BRIRs already sound higher, without any modifications, this method yields to a clearly perceivable height difference.

Applying $P_R(m)$ and $P_{FrontBack}(m, \alpha)$ to the reflections caused by the sound sources on the elevated ring, this height enhancement method is perceptually investigated within a listening test.

In the following, parameterized variable direction rendering according to embodiments is described.

The aim of this system is to correct the perceived direction in a binaural-rendering by performing a rendering on a base-direction and then correcting the direction with a set of attributes taken from a set of base-filters.

An audio signal and a user direction input is fed to an 'online binaural rendering' block that creates a binaural rendering with variable direction perception.

Online binaural rendering according to embodiments, may, for example, be conducted as follows:

A binaural rendering of an input signal is done using filters of the reference direction ('reference height binaural rendering').

In a first stage, the reference height rendering is done using a set (one or more) of discrete directions Binaural Room Impulse Responses (BRIRs).

In a second stage, e.g., in a direction corrector filter processor, an additional filter may, e.g., be applied to the rendering that adapts the perceived direction (in positive or negative direction of azimuth and/or elevation). This filter may, e.g., be created by calculating actual filter parameters, e.g., with a (variable) user direction input (e.g. in degrees azimuth: 0° to 360°, elevation −90° to +90°) and with, e.g., a set of direction-base-filter coefficients.

First and second stage filters can also be combined (e.g. by addition or multiplication) to save computational complexity.

The present invention is based on the findings presented before.

Now, embodiments of the present invention are described in detail.

Figure 1A:
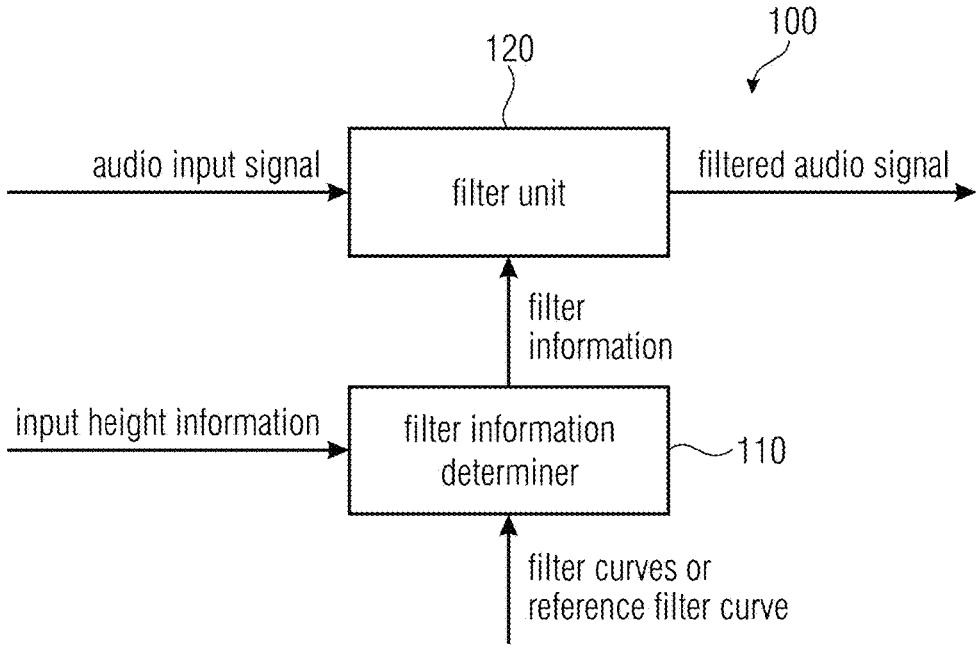
FIG. 1*a* illustrates an apparatus for generating a filtered audio signal from an audio input signal according to an embodiment.

FIG. 1*a* illustrates an apparatus 100 for generating a filtered audio signal from an audio input signal according to an embodiment.

The apparatus 100 comprises a filter information determiner 110 being configured to determine filter information depending on input height information wherein the input height information depends on a height of a virtual sound source.

Moreover, the apparatus 100 comprises a filter unit 120 being configured to filter the audio input signal to obtain the filtered audio signal depending on the filter information.

The filter information determiner 110 is configured to determine the filter information using selecting, depending on the input height information, a selected filter curve from a plurality of filter curves. Or, the filter information determiner 110 is configured to determine the filter information using determining a modified filter curve by modifying a reference filter curve depending on the elevation information.

The present invention is inter alia based on the finding that (virtually) elevating or lowering a virtual sound source can be achieved by suitable filtering an audio input signal. A filter curve may therefore be selected from a plurality of filter curves depending on the input height information and that selected filter curve may then be employed for filtering the audio input signal to (virtually) elevate or lower the virtual sound source. Or, a reference filter curve may be modified depending on the input height information to virtually) elevate or lower the virtual sound source.

In an embodiment, the input height information may, e.g., indicate at least one coordinate value of a coordinate of a coordinate system, wherein the coordinate indicates a position of the virtual sound source.

For example, the coordinate system may, e.g., be a tree-dimensional Cartesian coordinate system, and the input height information is a coordinate of the three-dimensional Cartesian coordinate system or is a coordinate value of three coordinate values of the coordinate of the three-dimensional Cartesian coordinate system.

E.g., a coordinate in a three-dimensional Cartesian coordinate system may comprise an x-value, a y-value and a z-value: (x, y, z),e.g., (x, y, z)=(5, 3, 4). The coordinate (5, 3, 4) may then, e.g., be the input height information. Or, the z-value z=4, which is one of the coordinate values of the coordinate (5, 3, 4) of the Cartesian coordinate system, may, e.g., be the input height information.

Or, for example, the coordinate system may, e.g., be a polar coordinate system, and the input height information may, e.g., be an elevation angle of a polar coordinate of the polar coordinate system.

E.g., a coordinate in a three-dimensional polar coordinate system may, e.g., be comprise an azimuth angle φ, an elevation angle θ, and a radius r, (φ, θ, r), e.g., (φ, θ, r)=(40°, 30°, 5). The elevation angle δ=30° is the elevation angle of the coordinate (40°, 30°, 5) of the polar coordinate system.

For example, in a polar coordinate system, the input height information may, e.g., indicate the elevation angle of a polar coordinate system wherein the elevation angle indicates an elevation between a target direction and a reference direction or between a target direction and a reference plane.

The above concepts for (virtually) elevating or lowering a virtual sound source may, e.g., be particularly suitable for binaural audio. Moreover, the above concepts may also be employed for loudspeaker setups. For example, if all loudspeaker setups are located in the same horizontal plane, and if none elevated or lower loudspeakers are present, virtually elevating or virtually lowering a virtual sound source becomes possible.

According to an embodiment, the filter information determiner 110 may, e.g., be configured to determine the filter information using selecting, depending on the input height information, the selected filter curve from the plurality of filter curves. The input height information is the elevation angle being an input elevation angle, wherein each filter curve of the plurality of filter curves has an elevation angle being assigned to said filter curve, and the filter information determiner 110 may, e.g., be configured to select as the selected filter curve a filter curve from the plurality of filter curves with a smallest absolute difference between the input elevation angle and the elevation angle being assigned to said filter curve among all the plurality of filter curves. Such an approach realizes that a particularly suitable filter curve is selected. For example, the plurality of filter curves may comprise be filter curves for a plurality of elevation angles, for example, for the elevation angles 0°, +3°, −3°, +6°, −6°, +9°, −9°, +12°, −12°, etc. If for example, input height information specifies an elevation angle of +4°, then the filter curve for an elevation of +3° will be chosen, because among all filter curves, the absolute difference between the input height information of +4° and the elevation angle of +3° being assigned to that particular filter curve is the smallest among all filter curves, namely |(+4°)−(+3°)|=1°.

According to another embodiment, the filter information determiner 110 may, e.g., be configured to determine the filter information using selecting, depending on the input height information, the selected filter curve from the plurality of filter curves. The input height information may, e.g., be said coordinate value of the three coordinate values of the coordinate of the three-dimensional Coordinate system being an input coordinate value, wherein each filter curve of the plurality of filter curves has a coordinate value being assigned to said filter curve, and the filter information determiner 110 may, e.g., be configured to select as the selected filter curve a filter curve from the plurality of filter curves with a smallest absolute difference between the input coordinate value and the coordinate value being assigned to said filter curve among all the plurality of filter curves.

According to such an approach, for example, the plurality of filter curves may comprise be filter curves for a plurality of values of, e.g., the z-coordinate of a coordinate of the three-dimensional Cartesian coordinate system, for example, for the z-values 0, +4, −4, +8, −8, +12°, −12, +16, −16, etc. If for example, input height information specifies a z-coordinate value of +5, then the filter curve for the z-coordinate value +4 will be chosen, because among all filter curves, the absolute difference between the input height information of +5 and the z-coordinate value of +4 being assigned to that particular filter curve is the smallest among all filter curves, namely |(+5)−(+4)|=1.

In an embodiment, the filter information determiner 110 may, e.g., be configured to amplify the selected filter curve by a determined amplification value to obtain a processed filter curve, or the filter information determiner 110 is configured to attenuate the selected filter curve by a determined attenuation value to obtain the processed filter curve. The filter unit 120 may, e.g., be configured to filter the audio input signal to obtain the filtered audio signal depending on the processed filter curve. The filter information determiner 110 may, e.g., be configured to determine the determined amplification value or the determined attenuation value depending on a difference between the input coordinate value and the coordinate value being assigned to the selected filter curve. Or the filter information determiner 110 may, e.g., be configured to determine the determined amplification value or the determined attenuation value depending on a difference between the elevation angle and the elevation angle being assigned to the selected filter curve.

When the filter curve relates to (is specified with respect to) a logarithmic scale, the amplification value or attenuation value is an amplification factor or an attenuation factor. The amplification factor or attenuation factor is then multiplied with each value of the selected filter curve to obtain the modified spectral filter curve.

Such an embodiment allows adapting a selected filter curve after selection. In the first example above which relates to elevation angles, the input height information of +4° elevation is not exactly equal to the +3° elevation angle being assigned to the selected filter curve. Similarly, in the second example above which relates to coordinate values, the input height information of +5 for the z-coordinate value is not exactly equal to the +4 z-coordinate value being assigned to the selected filter curve. Therefore, in both examples, adaptation of the selected filter curve appears useful.

When the filter curve relates to (is specified with respect to) a linear scale, the amplification value or attenuation value is an exponential amplification value or an exponential attenuation value. The exponential amplification value/exponential attenuation value is then used as an exponent of an exponential function. The result of exponential function, having the exponential amplification value or the exponential attenuation value as exponent, is then multiplied with each value of the selected filter curve to obtain the modified spectral filter curve.

According to an embodiment, the filter information determiner 110 may, e.g., be configured to determine the filter information using determining the modified filter curve by modifying the reference filter curve depending on the elevation information. Moreover, the filter information determiner 110 may, e.g., be configured to amplify the reference filter curve by a determined amplification value to obtain a processed filter curve, or the filter information determiner 110 is configured to attenuate the reference filter curve by a determined attenuation value to obtain the processed filter curve.

In such an embodiment, only a single filter curve exists, the reference filter curve. The filter information determiner 110 then adapts the reference filter curve depending on the input height information.

In an embodiment, the filter information determiner 110 may, e.g., be configured to determine the filter information using selecting, depending on the input height information, the selected filter curve from a plurality of filter curves as a first selected filter curve. Moreover, the filter information determiner 110 may, e.g., be configured to determine the filter information using selecting, depending on the input height information, a second selected filter curve from the plurality of filter curves. Furthermore, the filter information determiner 110 may, e.g., be configured to determine an interpolated filter curve by interpolating between the first selected filter curve and the second selected filter curve.

In an embodiment, the filter information determiner 110 may, e.g., be configured to determine the filter information such that the filter unit 120 modifies a first spectral portion of the audio input signal, and such that the filter unit 120 does not modify a second spectral portion of the audio input signal.

By modifying first spectral portions of the audio input signal, elevating or lowering a virtual sound source is realized. Other spectral portions of the audio input signal are, however, not modified to elevate or lower the virtual sound source.

According to an embodiment, the filter information determiner 110 may, e.g., be configured to determine the filter information such that the filter unit 120 amplifies a first spectral portion of the audio input signal by a first amplification value, and such that the filter unit 120 amplifies a second spectral portion of the audio input signal by a second amplification value, wherein the first amplification value is different from the second amplification value.

Embodiments are based on the finding that a virtual elevation or a virtual lowering of a virtual sound source is achieved by particularly amplifying some frequency portions, while other frequency portions should be lowered. Thus, in embodiments, filtering is conducted, so that generating a filtered audio signal from an audio input signal corresponds to amplifying (or attenuating) the audio input signal with different amplification values (different gain factors).

In an embodiment, the filter information determiner 110 may, e.g., be configured to determine the filter information using selecting, depending on the input height information, the selected filter curve from the plurality of filter curves, wherein each of the plurality of filter curves has a global maximum or a global minimum between 700 Hz and 2000 Hz. Or, the filter information determiner 110 may, e.g., be configured to determine the filter information using determining the modified filter curve by modifying the reference filter curve depending on the elevation information, wherein the reference filter has a global maximum or a global minimum between 700 Hz and 2000 Hz.

FIG. 51-FIG. 55 show a plurality of different filter curves that are suitable for creating the effect of elevating or lowering a virtual sound source. It has been found that to create the effect of elevating or lowering a virtual sound source, some frequencies particularly in the range between 700 Hz and 2000 Hz should be particularly amplified or should be particularly attenuated to virtually elevate or virtually lower a virtual sound source.

Figure 51:
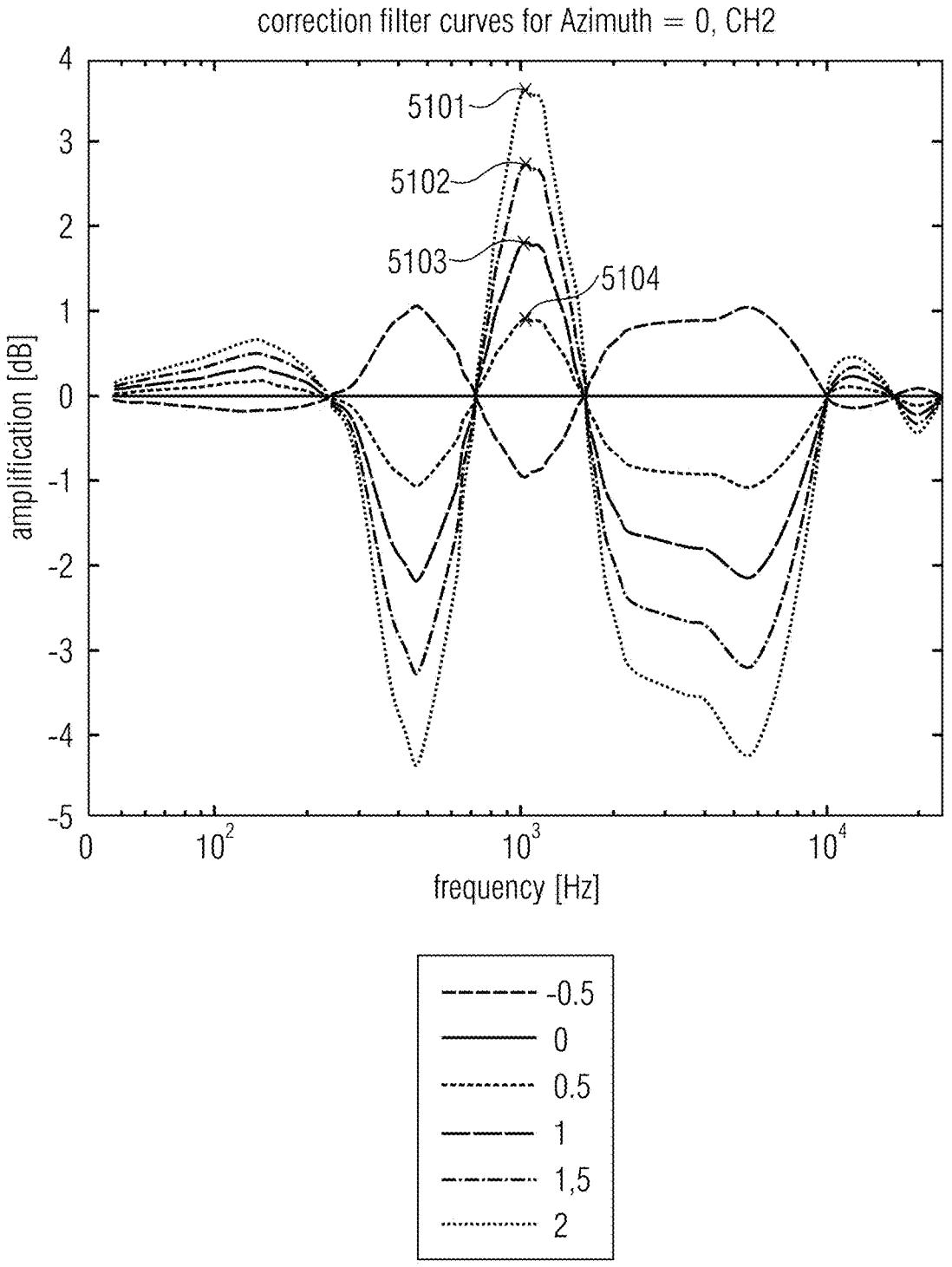
FIG. 51 illustrates correction filter curves for azimuth=0°.

In particular, the filter curves with positive (greater 0) amplification values in FIG. 51 have a global maximum 5101, 5102, 5103, 5104 around 1000 Hz, i.e. between 700 Hz and 2000 Hz.

Similarly, the filter curves with positive amplification values in FIG. 52, FIG. 53, FIG. 54 and FIG. 55 have a global maximum 5201, 5202, 5203, 5204 and 5301, 5302, 5303, 5304 and 5401, 5402, 5403, 5404 and 5501, 5502, 5503, 5504 around 1000 Hz, i.e. between 700 Hz and 2000 Hz.

According to an embodiment, the filter information determiner 110 may, e.g., be configured to determine filter information depending on the input height information and further depending on input azimuth information. Moreover, the filter information determiner 110 may, e.g., be configured to determine the filter information using selecting, depending on the input height information and depending on the input azimuth information, the selected filter curve from the plurality of filter curves. Or, the filter information determiner 110 may, e.g., be configured to determine the filter information using determining the modified filter curve by modifying the reference filter curve depending on the elevation information and depending on the azimuth information.

The above-mentioned FIG. 51-FIG. 55 show filter curves being assigned to different azimuth values.

Figure 52:
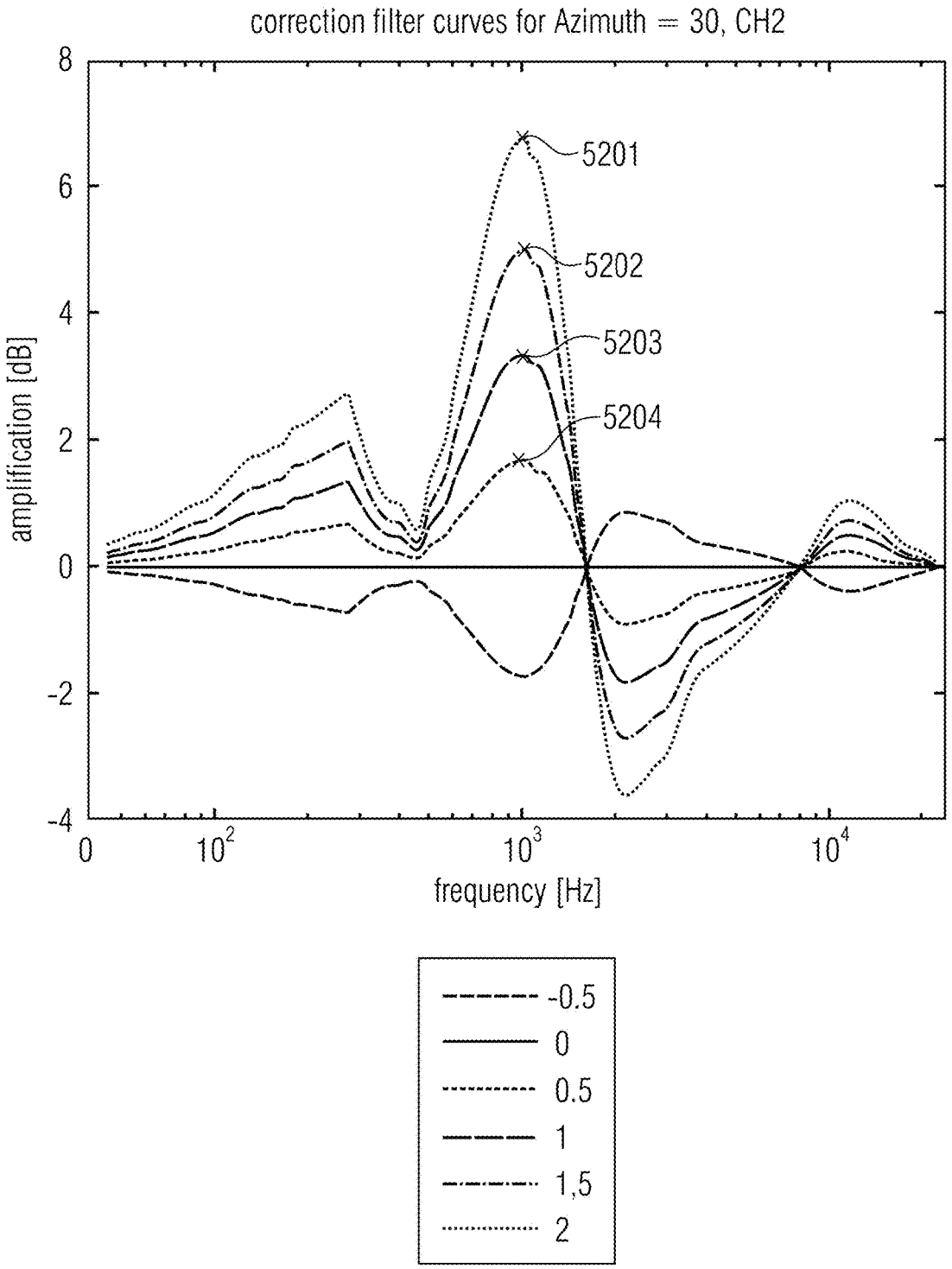
FIG. 52 illustrates correction filter curves for azimuth=30°.
Figure 53:
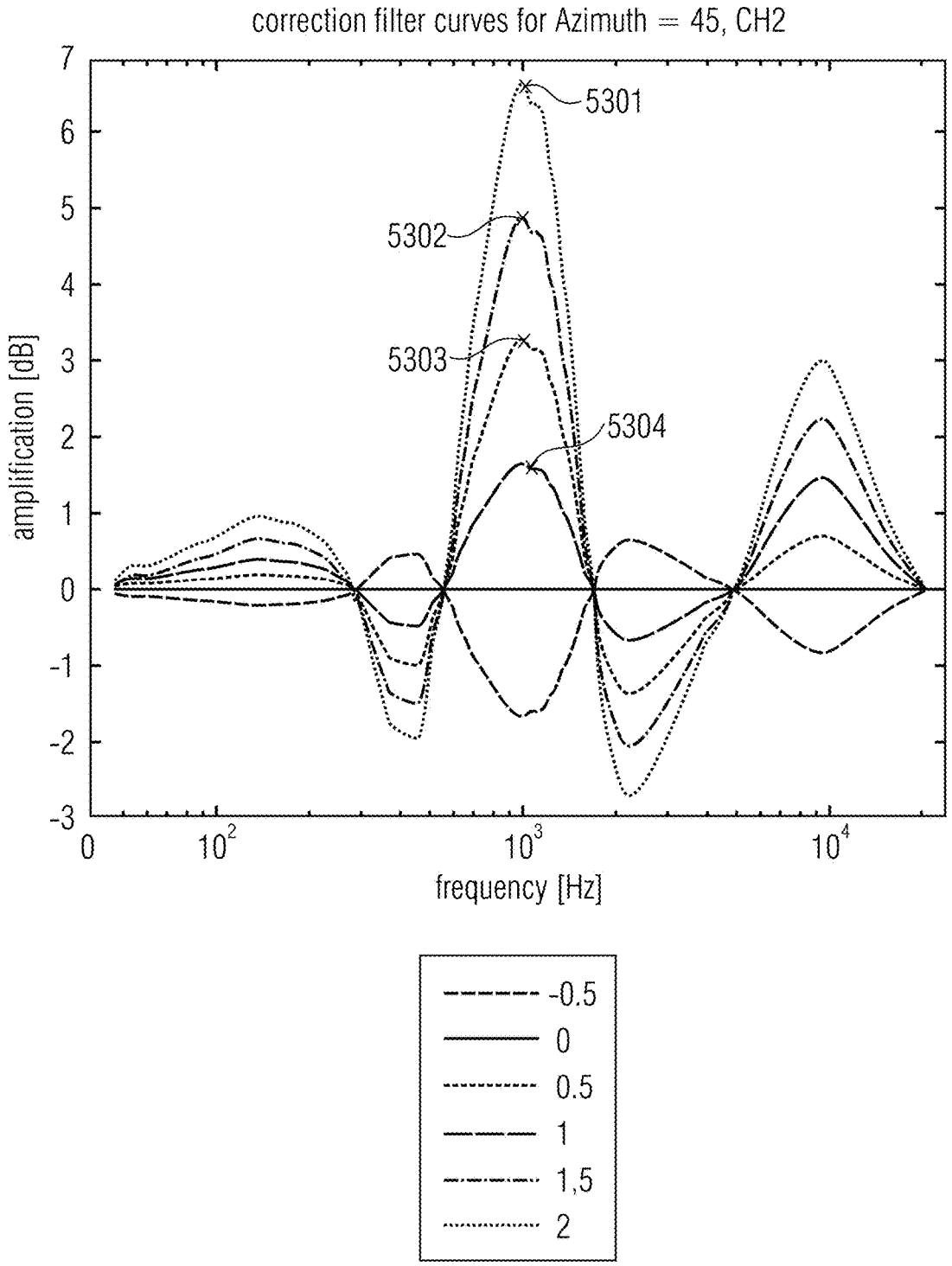
FIG. 53 illustrates correction filter curves for azimuth=45°.
Figure 54:
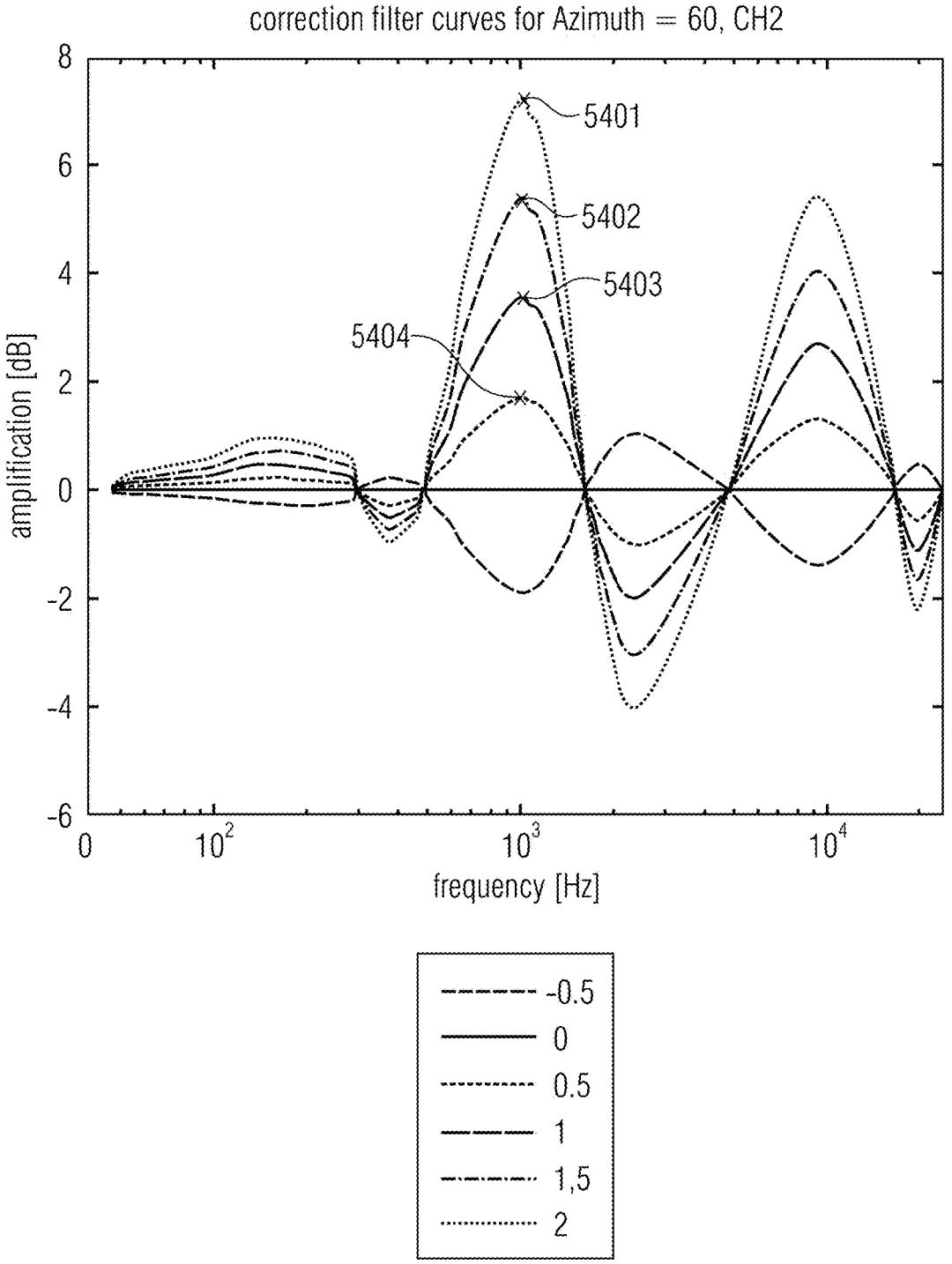
FIG. 54 illustrates correction filter curves for azimuth=60°.
Figure 55:
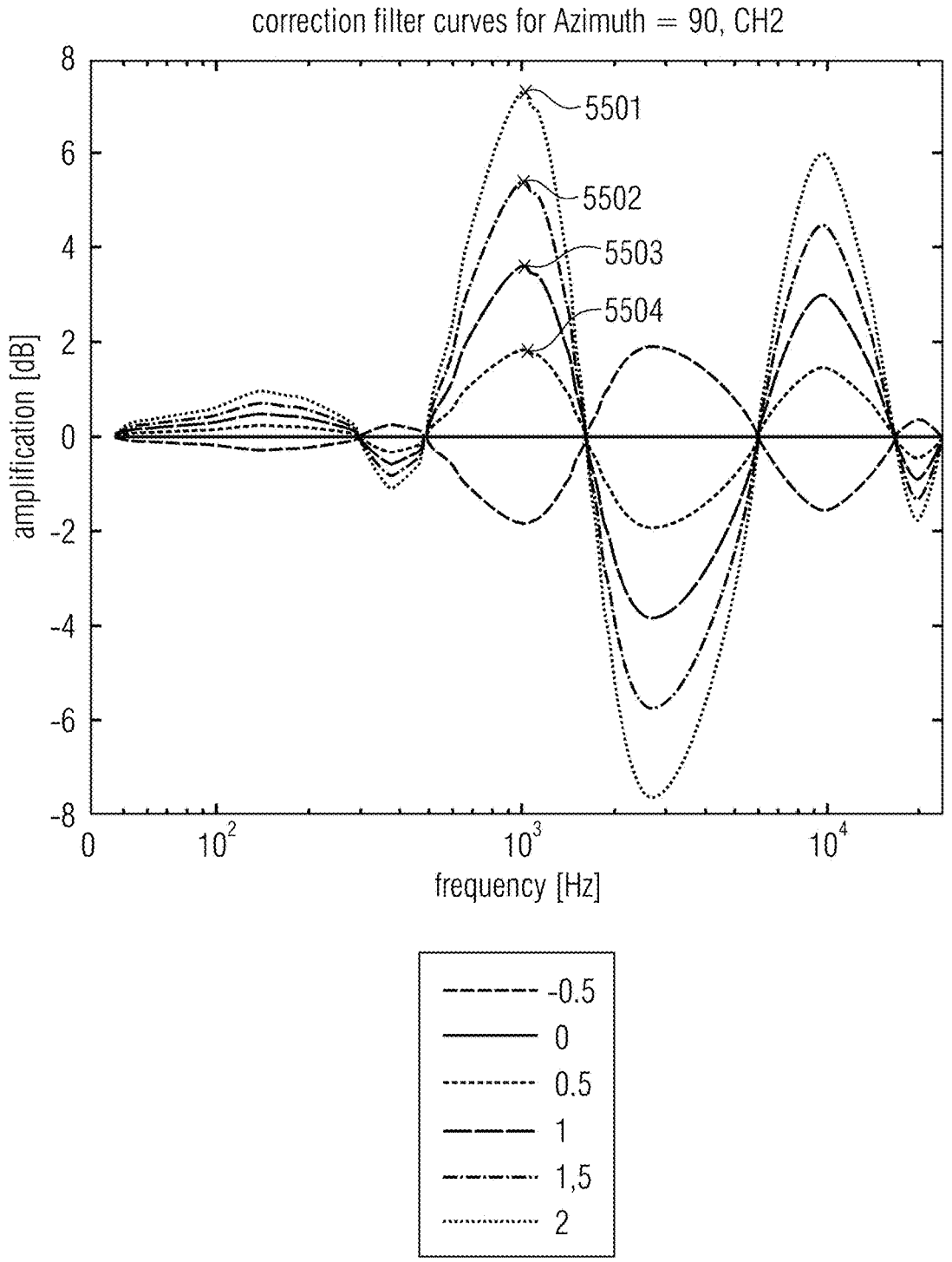
FIG. 55 illustrates correction filter curves for azimuth=90°.

In particular, FIG. 51 illustrates correction filter curves for azimuth=0°, FIG. 52 illustrates correction filter curves for azimuth=30°, FIG. 53 illustrates correction filter curves for azimuth=45°, FIG. 54 illustrates correction filter curves for azimuth=60°, and FIG. 55 illustrates correction filter curves for azimuth=90°.

The corresponding filter curves in FIG. 51-FIG. 55 slightly differ, as the filter curves are assigned to different azimuth values. Thus, in some embodiments, input azimuth information, for example, an azimuth angle depending on a position of a virtual sound source, can also be taken into account.

In an embodiment, the filter unit 120 may, e.g., be configured to filter the audio input signal to obtain a binaural audio signal as the filtered audio signal having exactly two audio channels depending on the filter information. The filter information determiner 110 may, e.g., be configured to receive input information on an input head-related transfer function. Moreover, the filter information determiner 110 may, e.g., be configured to determine the filter information by determining a modified head-related transfer function by modifying the input head-related transfer function depending on the selected filter curve or depending on the modified filter curve.

The above-described concepts are particularly suitable for binaural audio. When conducting binaural rendering, a head-related transfer function is applied on the audio input signal to generate an audio output signal (here: a filtered audio signal) comprising exactly two audio channels. According to embodiments, the head-related transfer function itself is modified (e.g., filtered), before the resulting modified head-related transfer function is applied on the audio input signal.

According to an embodiment, the input head-related transfer function may, e.g., be represented in a spectral domain. The selected filter curve may, e.g., be represented in the spectral domain, or the modified filter curve is represented in the spectral domain.

The filter information determiner 110 may, e.g., be configured

- to determine the modified head-related transfer function by adding spectral values of the selected filter curve or of the modified filter curve to spectral values of the input head-related transfer function, or
- to determine the modified head-related transfer function by multiplying spectral values of the selected filter curve or of the modified filter curve and spectral values of the input head-related transfer function, or
- to determine the modified head-related transfer function by subtracting spectral values of the selected filter curve or of the modified filter curve from spectral values of the input head-related transfer function, or by subtracting spectral values of the input head-related transfer function from spectral values of the selected filter curve or of the modified filter curve, or to determine the modified head-related transfer function by dividing spectral values of the input head-related transfer function by spectral values of the selected filter curve or of the modified filter curve, or by dividing spectral values of the selected filter curve or of the modified filter curve by spectral values of the input head-related transfer function.

In such an embodiment, the head-related transfer function is represented in the spectral domain and the spectral-domain filter curve is used to modify the head-related transfer function. For example, adding or subtracting may, e.g., be employed when the head-related transfer function and the filter curve refer to a logarithmic scale. E.g., multiplying or dividing may, e.g., be employed when the head-related transfer function and the filter curve refer to a linear scale.

In an embodiment, the input head-related transfer function may, e.g., be represented in a time domain. The selected filter curve is represented in the time domain, or the modified filter curve is represented in the time domain. The filter information determiner 110 may, e.g., be configured to determine the modified head-related transfer function by convolving the selected filter curve or the modified filter curve and the input head-related transfer function.

In such an embodiment, the head-related transfer function is represented in the time domain and the head-related transfer function and the filter curve are convolved to obtain the modified head-related transfer function.

In another embodiment, the filter information determiner 110 may, e.g., be configured to determine the modified head-related transfer function by filtering the selected filter curve or the modified filter curve with a non-recursive filter structure. For example, filtering with an FIR filter (Finite Impulse Response filter) may be conducted.

In a further embodiment, the filter information determiner 110 may, e.g., be configured to determine the modified head-related transfer function by filtering the selected filter curve or the modified filter curve with a recursive filter structure. For example, filtering with an IIR filter (Infinite Impulse Response filter) may be conducted.

Figure 1B:
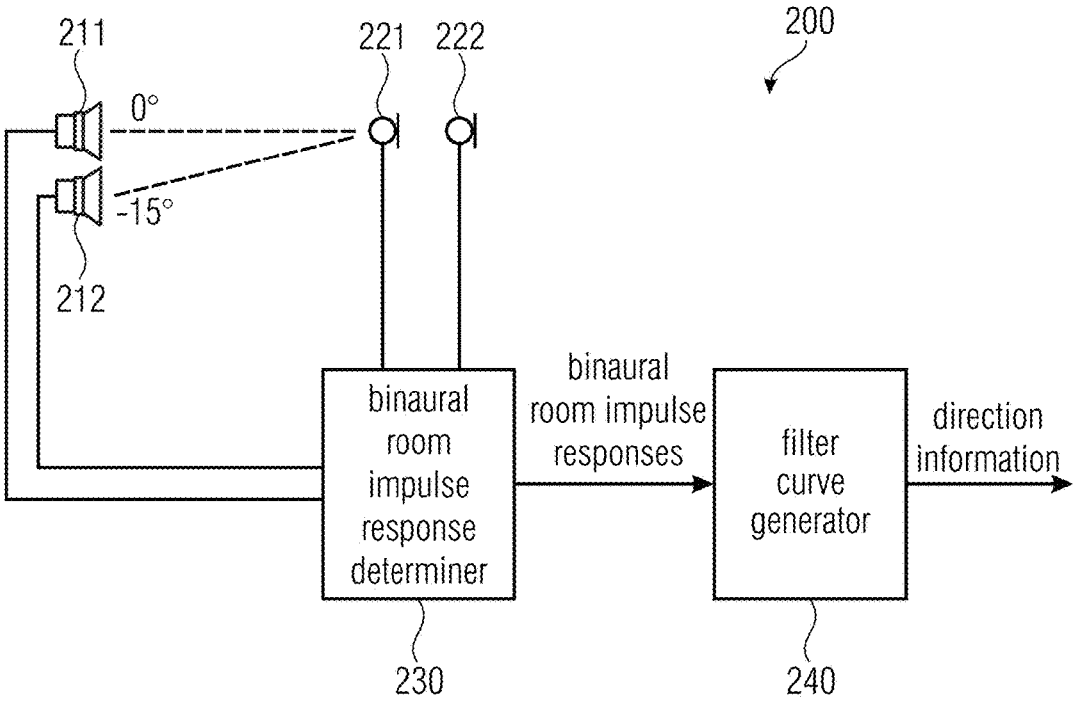
FIG. 1*b* illustrates an apparatus for providing direction modification information according to an embodiment.

FIG. 1*b* illustrates an apparatus 200 for providing direction modification information according to an embodiment.

The apparatus 200 comprises a plurality of loudspeakers 211, 212, wherein each of the plurality of loudspeakers 211, 212 is configured to replay a replayed audio signal, wherein a first one of the plurality of loudspeakers 211, 212 is located at a first position at a first height, and wherein second one of the of the plurality of loudspeakers 211, 212 is located at a second position being different from the first position, at a second height, being different from the first height.

Moreover, the apparatus 200 comprises two microphones 221, 222, each of the two microphones 221, 222 being configured to record a recorded audio signal by receiving sound waves from each loudspeaker of the plurality of loudspeakers 211, 212 emitted by said loudspeaker when replaying the audio signal.

Furthermore, the apparatus 200 comprises a binaural room impulse response determiner 230 being configured to determine a plurality of binaural room impulse responses by determining a binaural room impulse response for each loudspeaker of the plurality of loudspeakers 211, 212 depending on the replayed audio signal being replayed by said loudspeaker and depending on each of the recorded audio signals being recorded by each of the two microphones 221, 222 when said replayed audio signal is replayed by said loudspeaker.

Determining a binaural room impulse response is known in the art. Here binaural room impulse responses are determined for loudspeakers being located at positions that may, e.g., exhibit different elevations, e.g., different elevation angles.

Moreover, the apparatus 200 comprises a filter curve generator 240 being configured to generate at least one filter curve depending on two of the plurality of binaural room impulse responses. The direction modification information depends on the at least one filter curve.

For example, a (reference) binaural room impulse response has been determined for a loudspeaker being located at a reference position at a reference elevation (for example, the reference elevation may, e.g., be 0°). Then a second binaural room impulse response may, e.g., be considered that was determined, e.g., for a loudspeaker at a second position with a second elevation, for example, an elevation of −15°.

Figure 49:
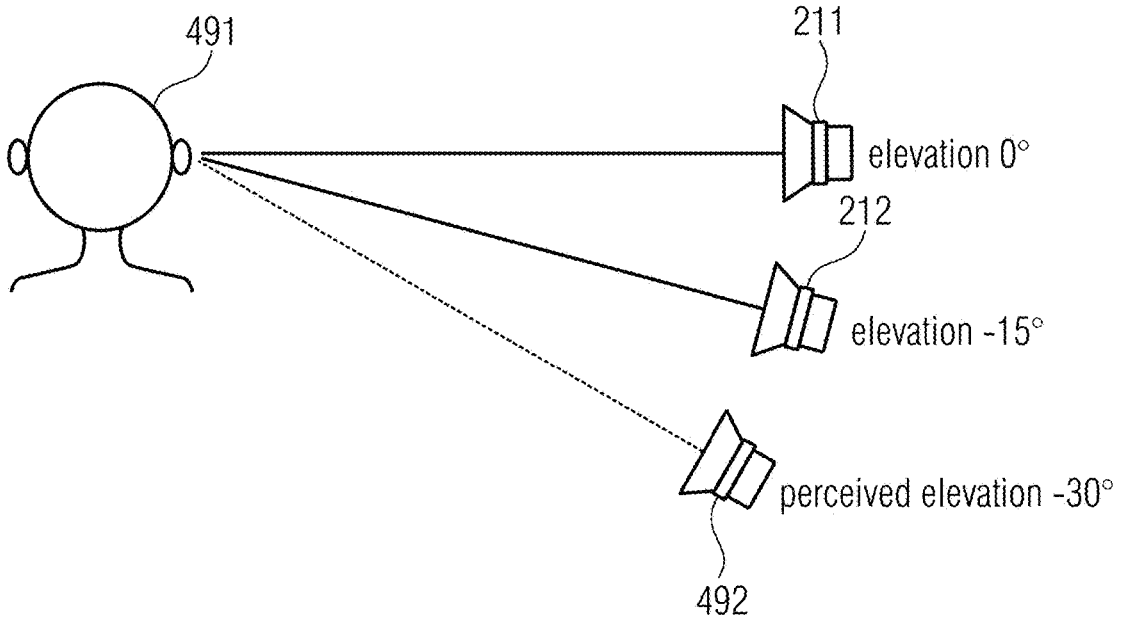
FIG. 49 depicts a schematic illustration showing a listener, two loudspeakers in two different elevations and a virtual sound source.

The first angle of 0° specifies that the first loudspeaker is located at a first height. The second angle of −15° specifies that the second loudspeaker is located at a second height which is lower than the first height. This is shown in FIG. 49. In FIG. 49, the first loudspeaker 211 is located at a first height which is lower than the second height where the second loudspeaker 212 is located.

Both binaural room impulse responses may, e.g., be represented in a spectral domain or may, e.g., be transferred from the time domain to the spectral domain. To obtain one of the filter curves the second binaural room impulse response, being a second signal in the spectral domain, may, e.g., be subtracted from the reference binaural room impulse response, being a first signal in the spectral domain. The resulting signal is one of the at least one filter curves. The resulting signal, being represented in the spectral domain may be, but does not have to be converted into the time domain to obtain the final filter curve.

In an embodiment, the filter curve generator 240 is configured to obtain two or more filter curves by generating one or more intermediate curves depending on the plurality of binaural room impulse responses, by amplifying each of the one or more intermediate curves by each of a plurality of different attenuation values.

Thus, generating the filter curves by the filter curve generator 240 is conducted in a two-step approach. At first, one or more intermediate curves are generated. Then, each of a plurality of attenuation values is applied on the one or more intermediate curves to obtain a plurality of different filter curves. For, example, in FIG. 51, different attenuation values, namely, the attenuation values −0.5, 0, 0.5, 1, 1.5 and 2 have been applied on an intermediate curve. In practice, applying an attenuation value of 0 is unnecessary as this results in a zero function, and applying an attenuation value of 1 is unnecessary this does not modify the already existing intermediate curve.

According to an embodiment, the filter curve generator 240 is configured to determine a plurality of head-related transfer functions from the plurality of binaural room impulse responses by extracting a head-related transfer function from each of the binaural room impulse responses. The plurality of head-related transfer functions may, e.g., be represented in a spectral domain. A height value may, e.g., be assigned to each of the plurality of head-related transfer functions. The filter curve generator 240 may, e.g., be configured to generate two or more filter curves. The filter curve generator 240 is configured to generate each of the two or more filter curves by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions. Moreover, the filter curve generator 240 is configured to assign a height value to each of the two or more filter curves by subtracting the height value being assigned to the first one of the plurality of head-related transfer functions from the height value being assigned to the second one of the plurality of head-related transfer functions. Furthermore, the direction modification information comprises each of the two or more filter curves and the height value being assigned to said filter curve. A height value may, for example, be an elevation angle, for example, an elevation angle of a coordinate of a polar coordinate system. Or, a height value may, for example, be a coordinate value of a coordinate of a Cartesian coordinate system.

In such an embodiment, a plurality of filter curves is generated. Such an embodiment may be suitable to interact with an apparatus 100 of FIG. 1*a* that selects a selected filter curve from a plurality of filter curves.

In an embodiment, the filter curve generator 240 is configured to determine a plurality of head-related transfer functions from the plurality of binaural room impulse responses by extracting a head-related transfer function from each of the binaural room impulse responses. The plurality of head-related transfer functions are represented in a spectral domain. A height value may, e.g., be assigned to each of the plurality of head-related transfer functions. The filter curve generator 240 may, e.g., be configured to generate exactly one filter curve. Moreover, the filter curve generator 240 may, e.g., be configured the exactly one filter curve by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions. The filter curve generator 240 may, e.g., be configured to assign a height value to the exactly one filter curve by subtracting the height value being assigned to the first one of the plurality of head-related transfer functions from the height value being assigned to the second one of the plurality of head-related transfer functions. The direction modification information may, e.g., comprise the exactly one filter curve and the height value being assigned to the exactly one filter curve. A height value may, for example, be an elevation angle, for example, an elevation angle of a coordinate of a polar coordinate system. Or, a height value may, for example, be a coordinate value of a coordinate of a Cartesian coordinate system.

In such an embodiment, only a single filter curve is generated. Such an embodiment may be suitable to interact with an apparatus 100 of FIG. 1*a* that modifies a reference filter curve.

Figure 1C:
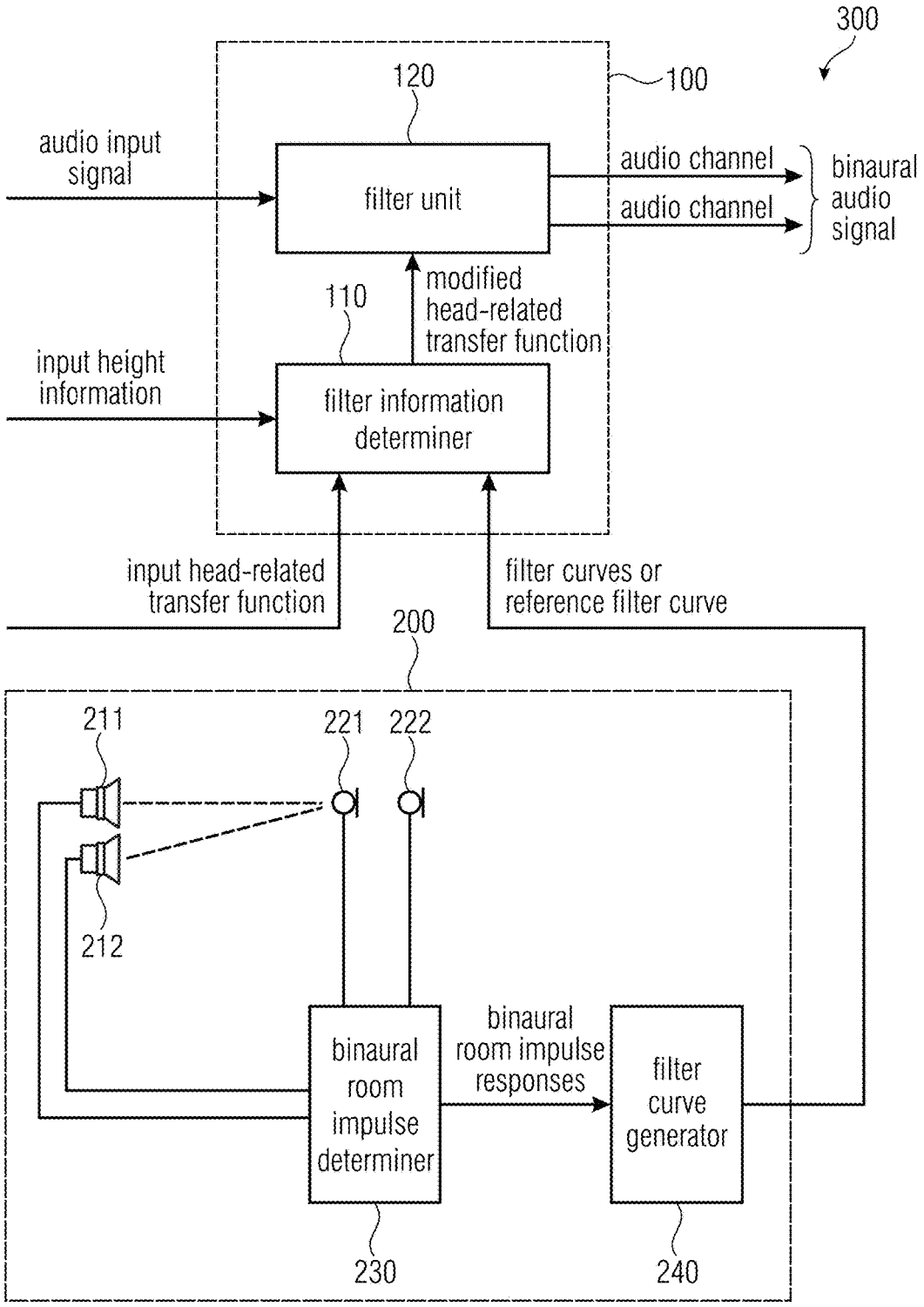
FIG. 1*c* illustrates a system according to an embodiment.

FIG. 1*c* illustrates a system 300 according to an embodiment.

The system 300 comprises the apparatus 200 of FIG. 1*b* for providing direction modification information.

Moreover, the system 300 comprises the apparatus 100 of FIG. 1*a*. In the embodiment illustrated by FIG. 1*c*, the filter unit 120 of the apparatus 100 of FIG. 1*a* is configured to filter the audio input signal to obtain a binaural audio signal as the filtered audio signal having exactly two audio channels depending on the filter information.

In the embodiment of FIG. 1*c*, the filter information determiner 110 of the apparatus 100 of FIG. 1*a* is configured to determine filter information using selecting, depending on input height information, a selected filter curve from a plurality of filter curves. Or, in the embodiment of FIG. 1*c*, the filter information determiner 110 of the apparatus 100 of FIG. 1*a* is configured to determine the filter information using determining a modified filter curve by modifying a reference filter curve depending on the elevation information.

In the embodiment of FIG. 1*c*, the direction modification information provided by the apparatus 200 of FIG. 1*b* comprises the plurality of filter curves or the reference filter curve.

Moreover, in the embodiment of FIG. 1*c*, the filter information determiner 110 of the apparatus 100 of FIG. 1*a* is configured to receive input information on an input head-related transfer function. Furthermore, the filter information determiner 110 of the apparatus 100 of FIG. 1*a* is configured to determine the filter information by determining a modified head-related transfer function by modifying the input head-related transfer function depending on the selected filter curve or depending on the modified filter curve.

Figure 45:
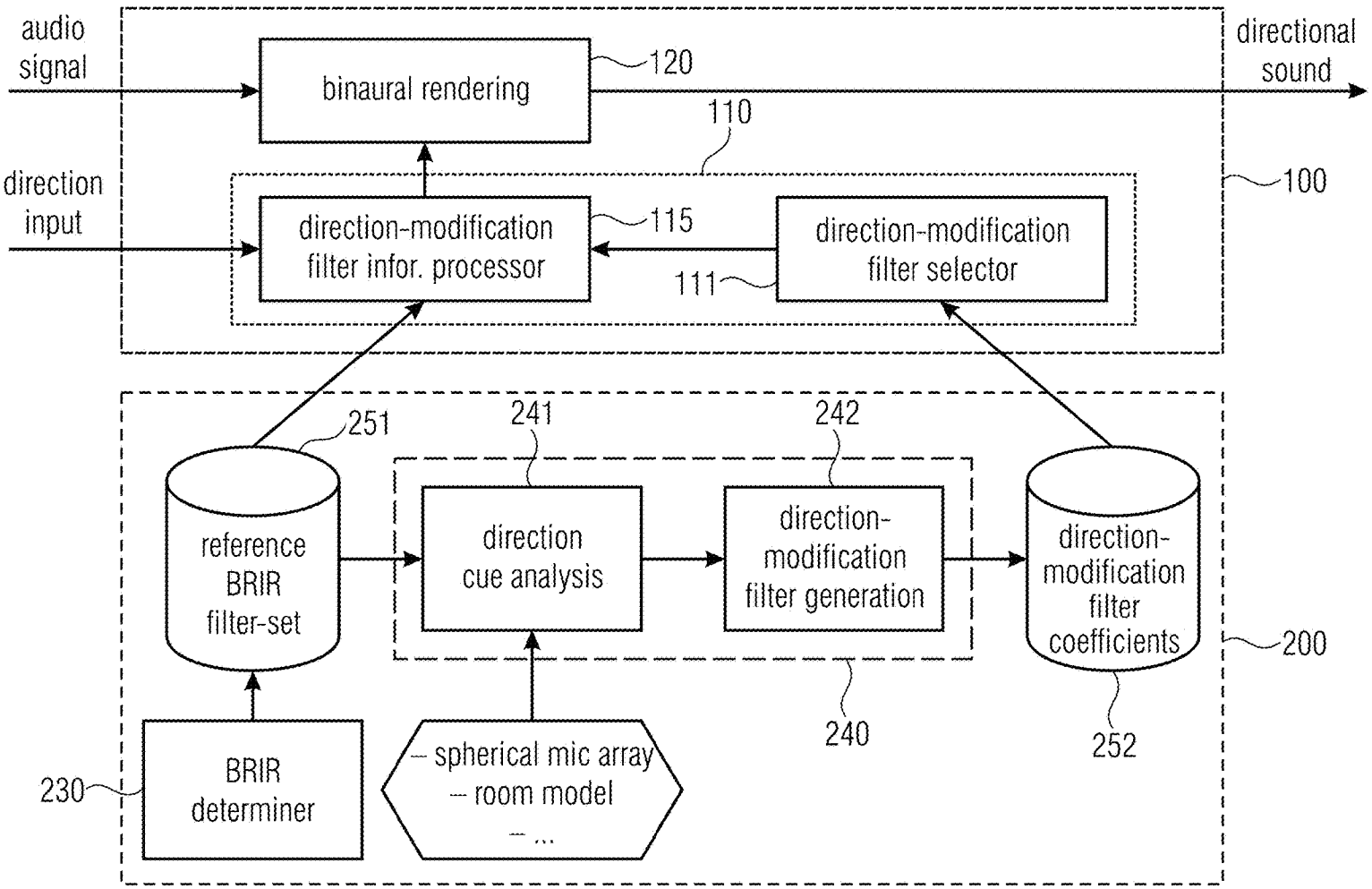
FIG. 45 depicts a system according to another particular embodiment comprising an apparatus for generating directional sound according to another embodiment and further comprising an apparatus for providing direction modification filter coefficients according to another embodiment.
Figure 48:
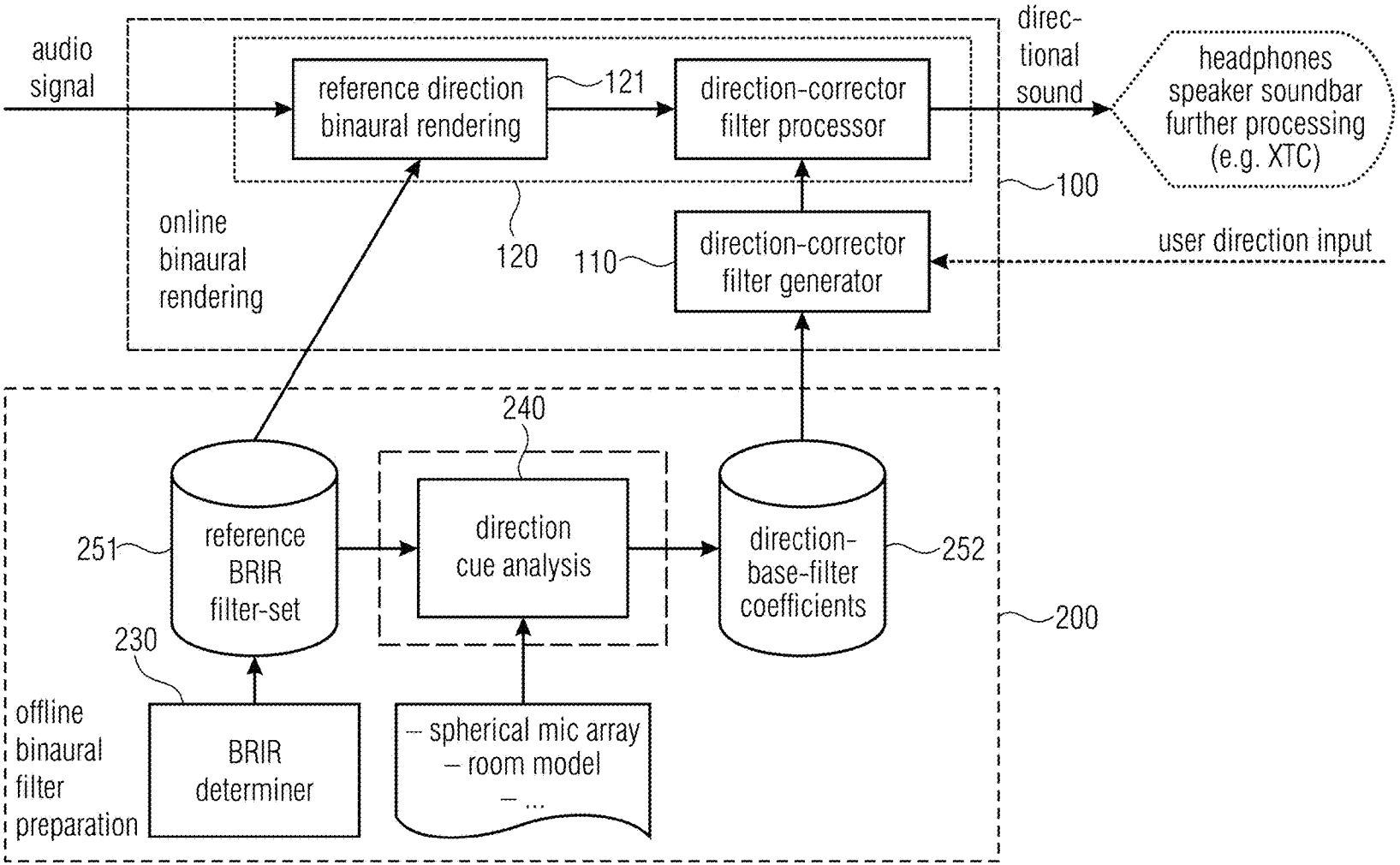
FIG. 48 depicts a system according to a particular embodiment comprising an apparatus for generating directional sound according to an embodiment and further comprising an apparatus for providing direction modification filter coefficients according to an embodiment.

FIG. 45 depicts a system according to a particular embodiment, wherein the system of FIG. 48 comprises an apparatus 100 for generating a filtered audio signal from an audio input signal according to an embodiment and an apparatus 200 for providing direction modification information according to an embodiment.

Figure 46:
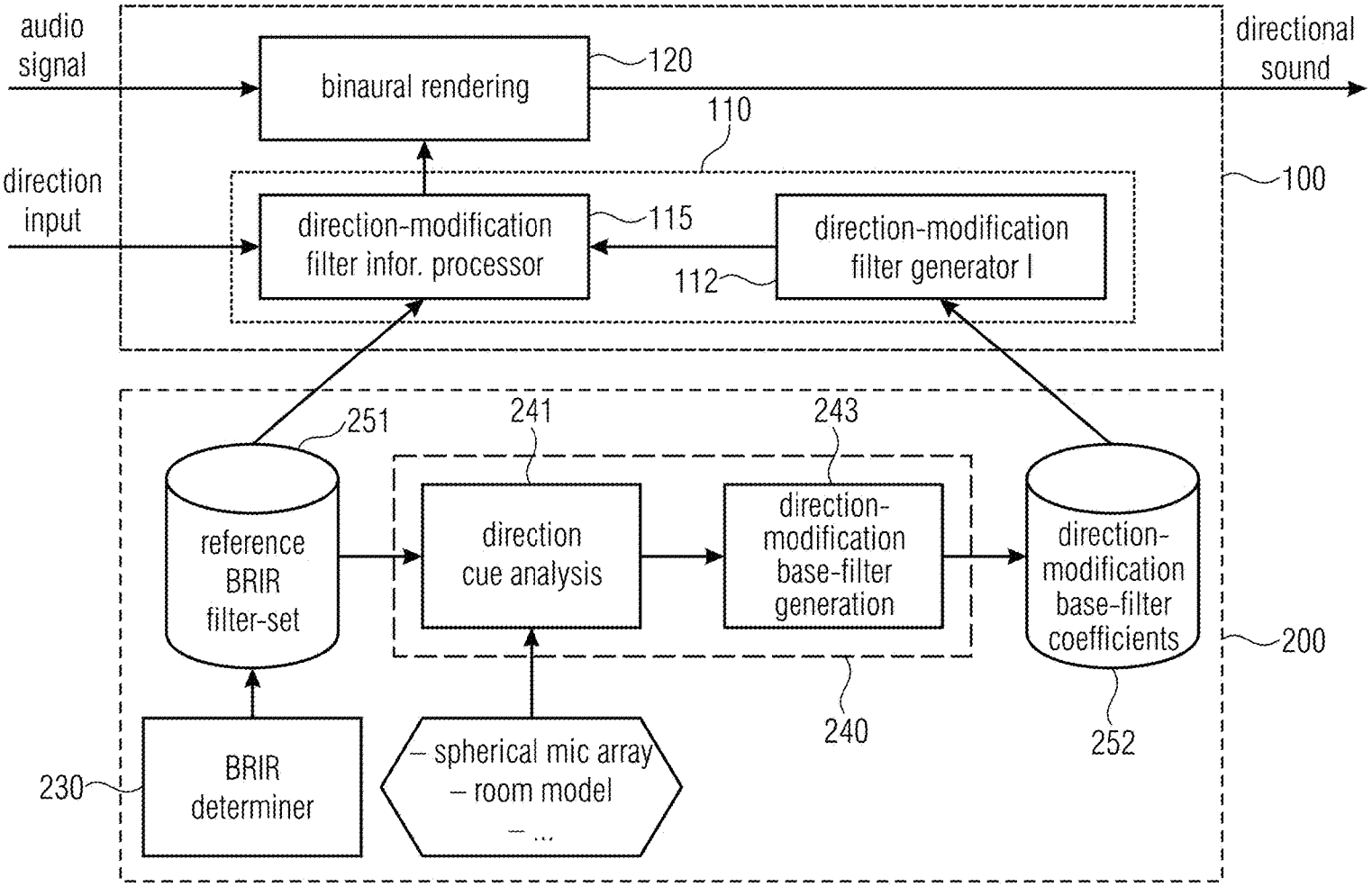
FIG. 46 depicts a system according to a further particular embodiment comprising an apparatus for generating directional sound according to a further embodiment and further comprising an apparatus for providing direction modification filter coefficients according to a further embodiment.
Figure 47:
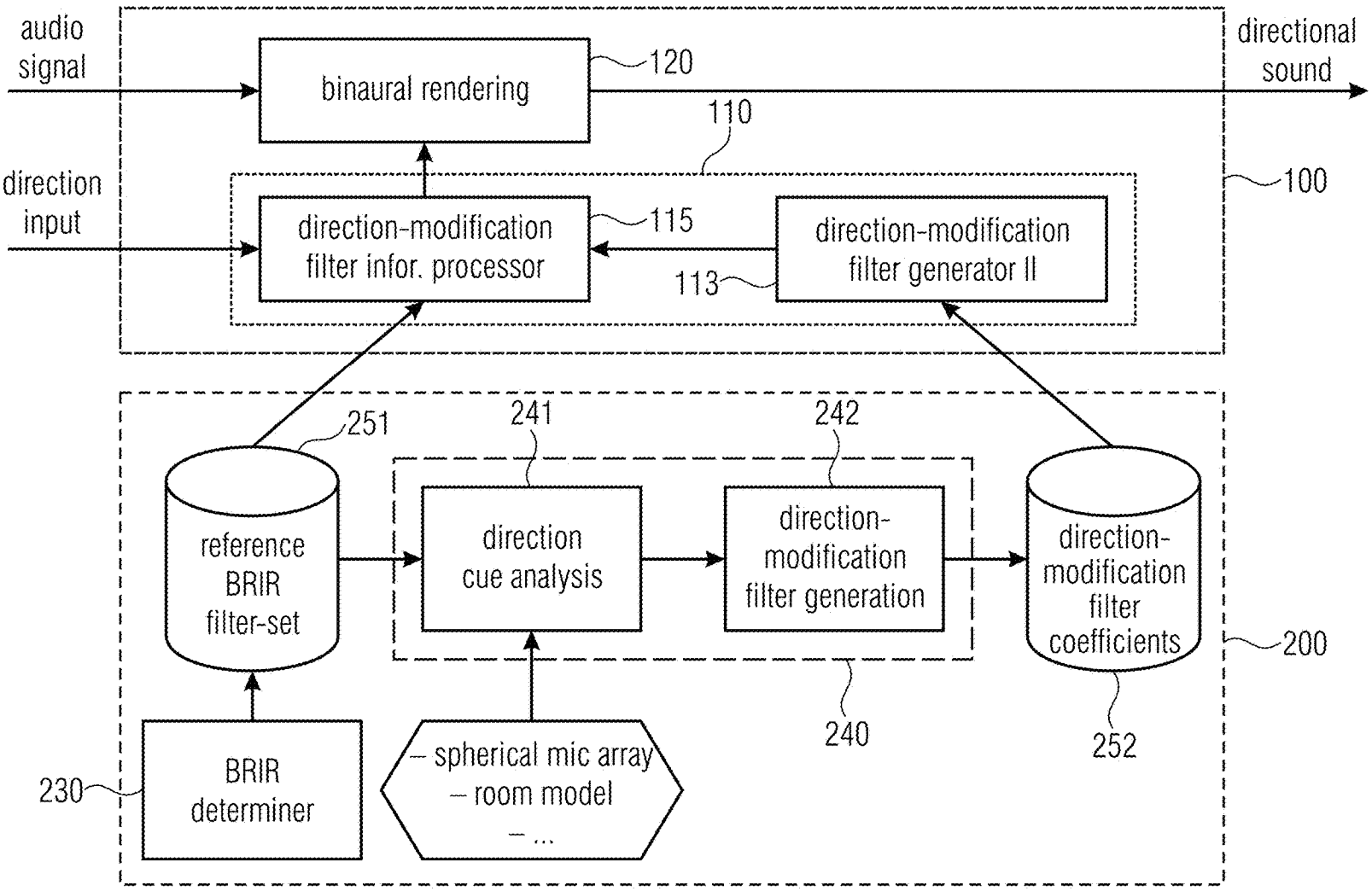
FIG. 47 depicts a system according to a still further particular embodiment comprising an apparatus for generating directional sound according to a still further embodiment and further comprising an apparatus for providing direction modification filter coefficients according to a still further embodiment.

Likewise in FIG. 46-48, systems according to particular embodiments are depicted, wherein each system of each of FIGS. 46-48 comprises an apparatus 100 for generating a filtered audio signal from an audio input signal according to an embodiment and an apparatus 200 for providing direction modification information according to an embodiment.

In each of FIG. 45-FIG. 48, the apparatus 100 for generating a filtered audio signal from an audio input signal according to the embodiment of the respective figure depicts an embodiment that can be realized without the apparatus 200 for providing direction modification information of that figure. Likewise, in each of FIG. 45-FIG. 48, the apparatus 200 for providing direction modification information according to the embodiment of the respective figure depicts an embodiment that can be realized without the apparatus 100 for generating a filtered audio signal from an audio input signal of that figure. Thus, the description provided for FIG. 45-FIG. 48 is not only a description for the respective system, but a description for an apparatus 100 for generating a filtered audio signal from an audio input signal according to the embodiment that is implemented without an apparatus for providing direction modification filter coefficients, and is also a description for an apparatus 200 for providing direction modification information that is implemented without an apparatus for generating directional sound.

At first, offline binaural filter preparation according to embodiments is described, In FIG. 45, an apparatus 200 for providing direction modification information according to a particular embodiment is illustrated. Loudspeakers 211 and 212 of FIG. 1*b* and Microphones 221 and 222 are not shown for illustrative reasons.

A set of BRIRs (binaural room impulse responses) that were determined for a plurality of different loudspeakers 211, 212, located at different positions, are generated by the binaural room impulse response determiner 230. At least some of the plurality of different loudspeakers are located at different positions in different elevations (e.g., the positions of these loudspeakers exhibit different elevation angles). The determined BRIRs may, e.g., be stored in a BRIR storage 251 (e.g., in a memory or, e.g., in a database).

In FIG. 45, the filter curve generator 240 comprises a direction cue analyser 241 and a direction modification filter generator 242.

From the set of reference BRIRs, the direction cue analyser 241 may, e.g., isolate the important cues for directional perception, e.g., in an elevation cue analysis. By this way, elevation base-filter coefficients may, e.g., be created. The important cues may e.g. be frequency-dependent attributes, time-dependent attributes or phase-dependent attributes of specific parts of the reference BRIR filter-set.

The extraction may, e.g., be made using tools like a spherical-microphone array or a geometrical room model to just capture specific parts of the 'Reference BRIR Filter-Set' like the reflection of sound from a wall or the ceiling.

The apparatus 200 for providing direction modification information may comprise tools like the spherical-microphone array or the geometrical room model but does not have to comprise such tools.

In embodiments, where the apparatus for providing direction modification filter coefficients does not comprise tools like the spherical-microphone array or the geometrical room model, data from such tools like the spherical-microphone array or the geometrical room model may, e.g., be provided as input to the apparatus for providing direction modification filter coefficients.

The apparatus for providing direction modification filter coefficients of FIG. 45 further comprises direction-modification filter generator 242. The information from the direction cue analysis, e.g., conducted by direction cue analyser, is used by the direction-modification filter generator 242 to generate one or more intermediate curves. The direction-modification filter generator 242 then generates a plurality of filter curves from the one or more intermediate curves, e.g., by stretching or by compressing the intermediate curve. The resulting filter curves, e.g., their coefficients may then be stored in a filter curve storage 252 (e.g., in a memory or, e.g., in a database).

For example, the direction-modification filter generator 242 may, e.g., generate only one intermediate curve. Then, for some elevations (for example, for elevation angles −15°, −55° and −90°) filter curves may then be generated by the direction-modification filter generator 242 depending on the generated intermediate curve.

The binaural room impulse determiner 230 and the filter curve generator 240 of FIG. 45 are now described in more detail with reference to FIG. 49 and FIG. 50.

FIG. 49 depicts a schematic illustration showing a listener 491, two loudspeakers 211, 212 in two different elevations and a virtual sound source 492.

In FIG. 49, the first loudspeaker 211 with an elevation of 0° (the loudspeaker is not elevated) and the second loudspeaker 212 with an elevation of −15° (the loudspeaker is lowered by 15°) are depicted.

The first loudspeaker 211 emits a first signal with is recorded, e.g., by the two microphones 221, 222 of FIG. 1*b* (not shown in FIG. 49). The binaural room impulse determiner 230 (not shown in FIG. 49) determines a first binaural room impulse response and the elevation of 0° of the first loudspeaker 211 is assigned to that first binaural room impulse response.

Then, the second loudspeaker 212 emits a second signal with is again recorded, e.g., by the two microphones 221, 222. The binaural room impulse determiner 230 determines a second binaural room impulse response and the elevation of −15° of the second loudspeaker 212 is assigned to that second binaural room impulse response.

The direction cue analyser 241 of FIG. 45 may, e.g., now extract a head-related transfer function from each of the two binaural room impulse responses.

After that, the direction modification filter generator 242 may, e.g., determine a spectral difference between the two determined head-related transfer functions.

The spectral difference may, e.g., be considered as an intermediate curve as described above. To determine a plurality of filter curves from this determined spectral difference, the direction modification filter generator 242 may now weight this intermediate curve with a plurality of different stretching factors (also referred to as amplification values). Each amplification value that is applied generated a new filter curve and is associated with a new elevation angle.

If the stretching factor becomes greater, the correction/modification of the intermediate curve, e.g., the elevation of the intermediate curve (that was −15°) further decreases (for example, to −30°; new elevation <−15°).

If, for example, a negative stretching factor is applied, the correction/modification of the intermediate curve, e.g., the elevation of the intermediate curve (that was −15°) increases (the elevation goes up and becomes greater then −15°; new elevation >−15°).

Figure 50:
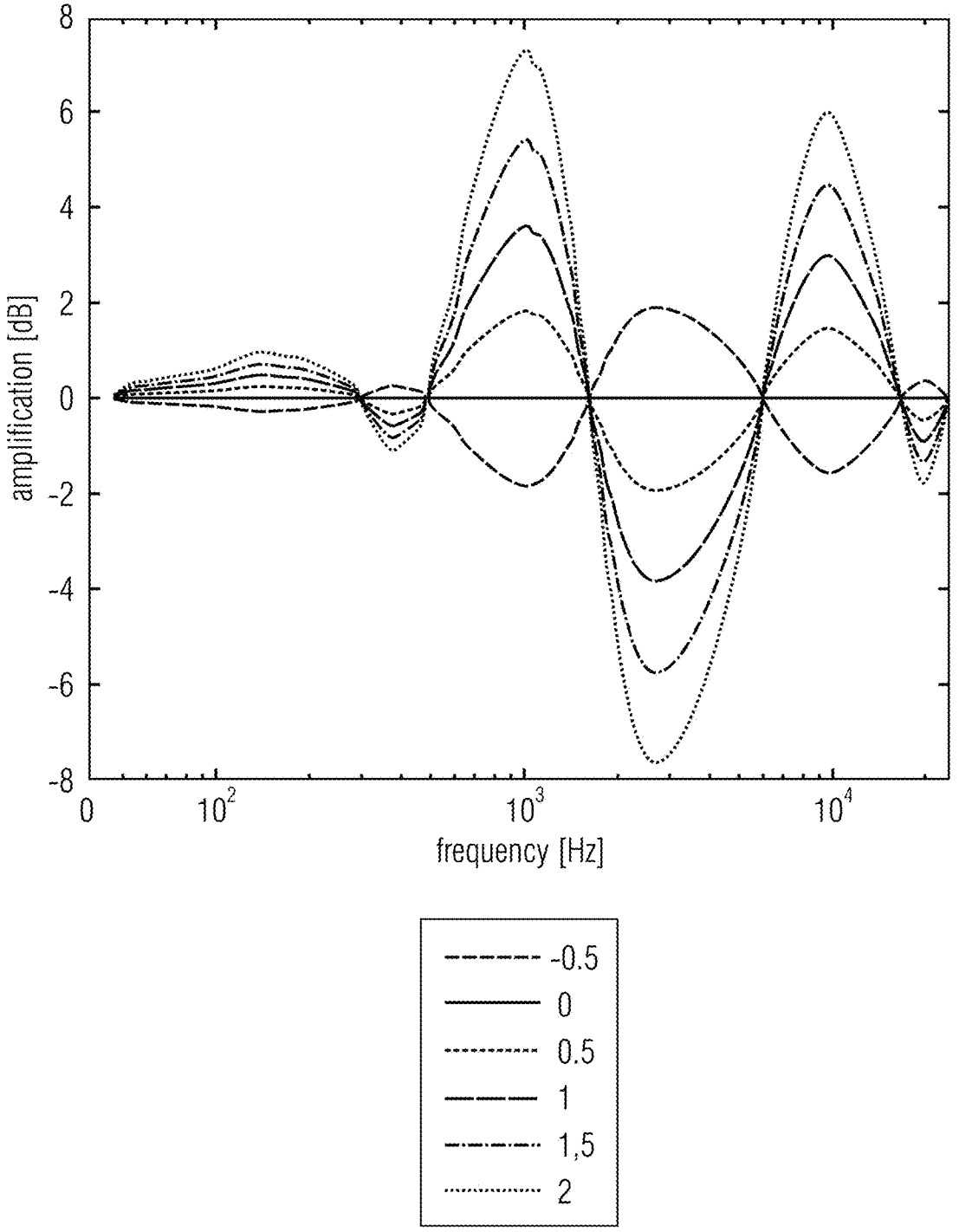
FIG. 50 illustrates filter curves resulting from applying different amplification values (stretching factors) on an intermediate curve.

FIG. 50 illustrates filter curves resulting from applying different amplification values (stretching factors) on an intermediate curve according to an embodiment.

Returning to FIG. 45, there, an apparatus 100 for generating a filtered audio signal comprises a filter information determiner 110 and a filter unit 120. In FIG. 45, the filter information determiner 110 comprises a direction-modification filter selector 111 and a direction-modification filter information processor 115. The direction-modification information filter processor 115 may, for example, apply the selected filter curve on the temporal beginning of binaural room impulse response.

The direction-modification filter selector 111 selects one of the plurality of filter curves provided by the apparatus 200 as a selected filter curve. In particular, the direction-modification filter selector 111 of FIG. 45 selects a selected filter curve (also referred to as a correction curve) depending on the direction input, particularly depending on elevation information.

The selected filter curve may, e.g., be selected from the filter curve storage 252 (also referred to as direction filter coefficients container). In the filter curve storage 252, a filter curve may, e.g., be stored by storing its filter coefficients or by storing its spectral values.

Then, direction-modification filter information processor 115 applies filter coefficients or spectral values of the selected filter curve on an input head-related transfer function to obtain a modified head-related transfer function. The modified head-related transfer function is then used by the filter unit 120 of the apparatus 100 of FIG. 45 for binaural rendering.

The input head-related transfer function may, for example, also be determined by the apparatus 200.

The filter unit 120 of FIG. 45 may, e.g., conduct binaural rendering based on existing (and, e.g., possibly preprocessed) BRIR measurements.

Regarding apparatus 200, the embodiment of FIG. 46 differs from the embodiment of FIG. 45 in that the filter curve generator 240 comprises a direction-modification base-filter generator 243 instead of a direction-modification filter generator 242.

The direction-modification base-filter generator 243 is configured to generate only a single filter curve from the binary room impulse responses as a reference filter curve (also referred to as a base correction filter curve).

Regarding apparatus 100, the embodiment of FIG. 46 differs from the embodiment of FIG. 45 in that the filter information determiner comprises a direction modification filter generator I 112. The direction modification filter generator I 112 is configured to modify the reference filter curve from apparatus 200, e.g., by stretching or by compressing the reference filter curve (depending on the input height information).

In FIG. 47, the apparatus 200 corresponds to the apparatus 200 of FIG. 45. The apparatus 200 generates a plurality of filter curves.

The apparatus 100 of FIG. 47 differs from the apparatus 100 of FIG. 45 in that the filter information determiner 110 of the apparatus 100 of FIG. 47 comprises a direction modification filter generator II 113 instead of a direction-modification filter selector 111.

The direction modification filter generator II 113 selects one of the plurality of filter curves provided by the apparatus 200 as a selected filter curve. In particular, the direction-modification filter selector 111 of FIG. 45 selects a selected filter curve (also referred to as a correction curve) depending on the direction input, particularly depending on elevation information. After selecting the selected filter curve, the direction modification filter generator II 113 modifies the selected filter curve, e.g., by stretching or by compressing the reference filter curve (depending on the input height information).

In an alternative embodiment, the direction modification filter generator II 113 interpolates between two of the plurality of filter curves provided by apparatus 200, e.g., depending on the input height information, and generates an interpolated filter curve from these two filter curves.

FIG. 48 illustrates an apparatus 100 for generating a filtered audio signal according to a different embodiment.

In the embodiment of FIG. 48, the filter information determiner 110 may, for example, be implemented as in the embodiment of FIG. 45 or as in the embodiment of FIG. 46 or as in the embodiment of FIG. 47.

In the embodiment of FIG. 48, the filter unit 120 comprises a binaural renderer 121 which conducts binaural rendering to obtain an intermediate binaural audio signal comprising two intermediate audio channels.

Moreover, the filter unit 120 comprises a direction-corrector filter processor 122 being configured to filter the two intermediate audio channels of the intermediate binaural audio signal depending on the filter information provided by the filter information determiner 110.

Thus, in the embodiment of FIG. 48, at first binaural rendering is conducted. The virtual elevation adaption is conducted afterwards by the direction-corrector filter processor 122.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software or at least partially in hardware or at least partially in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[001] Rubak, P. and Johansen, L., "Artificial reverberation based on a pseudo-random impulse response 2", Proceedings of the 106$^{th}$ AES Convention, 4875, May 8-11, 1999

[002] Kuttruff H. Room Acoustics, Fourth Edition, Spon Press, 2000

[003] Jens Blauert, Räumliches Hören, S. Hirzel Verlag, Stuttgart, 1974

[004] https://commons.wikimedia.org/wiki/File:Akustik_-_Richtungsb%C3%A4nder.svg

[005] Litovsky et. al., Precedence effect, J. Acoust. Soc. Am. Vol. 106, No. 4. Pt. 1. October 1999

[005] V. Pullki, M. Karjalainen, Communication Acoustics, Wiley, 2015

[007] http://www.sengpielaudio.com/PraktischeDatenZurStereo-Lokalisation.pdf

[008] http://www.sengpielaudio.com/Haas-Effekt.pdf

[009] G. Theile. On the Standardization of the Frequency Response of High Quality Studio Headphones. AES convention 77, 1985

[010] F. Fleischmann, Messung, Vergleich and psychoakustische Evaluierung von Kopfhörer-Übertragungsmaßen, FAU Erlangen, Diplomarbeit, 2011

[011] A Simple, Robust Measure of Reverberation Echo Density, J. Abel, P. Huang, AES 121st Convention, 2006 Oct. 5-8

[012] Perceptual Evaluation of Model- and Signal-Based Predictors of the Mixing Time in Binaural Room Impulse Responses, A. Lindau, L. Kosanke, S. Weinzierl, J. Audio Eng. Soc., Vol. 60, No. 11, 2012 November

[013] Rubak, P. and Johansen, L., "Artificial reverberation based on a pseudo-random impulse response," in Proceedings of the 104th AES Convention, preprint 4875, Amsterdam, Netherlands, May 16-19, 1998.

[014] Rubak, P. and Johansen, L., "Artificial reverberation based on a pseudo-random impulse response II," in Proceedings of the 106th AES Convention, preprint 4875, Munich, Germany, May 8-11, 1999.

[015] Jot, J.-M., Cerveau, L., and Warusfel, O., "Analysis and synthesis of room reverberation based on a statistical time-frequency model," in Proceedings of the 103rd AES Convention, preprint 4629, New York, Sep. 26-29, 1997.

[016] Stanley Smith Stevens: Psychoacoustics. John Wiley & Sons, 1975

[017] http://www.mathworks.com/matlabcentral/mlc-downloads/downloads/submissions/43856/versions/8/screenshot.jpg

[018] Fourier Acoustics, Sound Radiation and Nearfield Acoustical Holography, Earl. G. Williams, Academic Press, 1999

[019] Richtungsdetektion mit dem Eigenmike Mikrofonarray, Messung und Analyse, M. Brandner, IEM, Kunst Uni Graz, 2013

[020] Bandwidth Extension for Microphone Arrays, B. Bemschutz, AES 8751, October 2012

[021] Zotter, F. (2009): *Analysis and Synthesis of Sound-Radiation with Spherical Arrays*. Dissertation, University of Music and Performing Arts Graz

[022] Sank J. R., Improved Real-Ear Test for Stereophones. J. Audio Eng Soc 28 (1980), Nr. 4, S. 206-218

[023] Spikofski, G. Das Diffusfeldsonden-Übertragungsmass eines Studiokopfhörers. Rundfunktechnische Mitteilung Nr. 3, 1988

[024] Vision and Technique behind the New Studios and Listening Rooms of the Fraunhofer IIS Audio Laboratory, A. Silzle, AES 7672, May 2009

[025] https://hps.oth-regensburg.de/~elektrogitarre/pdfs/kunstkopf.pdf

[026] Localization with Binaural Recordings from Artificial and Human Heads, P. Minhaar, S. Olesen, F. Christensen, H. Moller, J Audio Eng. Soc, Vol 49, No 5, 2001 May

[027] http://www.f07.fh-koeln.de/einrichtungen/nachrichtentechnik/forschung_kooperationen/aktuelle_projekte/asar/00534/index.html

[028] Entwurf und Aufbau eines variable sphärischen Mikrofonarrays für Forschungsan-wendungen in Raumakustik und Virtual Audio. B. Bernschütz, C. Pörschmann, S. Spors, S. Weinzierl, DAGA 2010, Berlin

[029] Farina, A. Advances in Impulse Response Measurements by Sine Sweeps. AES Convention 122. Wien, Mai 2007

[030] Weinzierl, S. et. al. Generalized multiple sweep measurement. AES Convention 126, 7767. Munich, Mai 2009

[031] Weinzierl, S. Handbuch der Audiotechnik. Springer, 2008

[032] https://web.archive.org/web/20160615231517/https://code.google.com/p/sofia-toolbox/wiki/WELCOME

[033] E. C. Cherry. "Some experiments on the recognition of speech with one and with two ears". J. Acoustical Soc. Am. vol. 25 pp. 975-979 (1953).

[034] https://ccrma.stanford.edu/~jos/bbt/Equivalent_Rectangular_Bandwidth.html

[035] http://de.mathworks.com/help/signal/ref/rceps.html

The invention claimed is:

1. An apparatus for generating a filtered audio signal from an audio input signal, wherein the apparatus comprises:

a filter information determiner being configured to determine filter information depending on input height information, wherein the input height information depends on a height of a virtual sound source, and a filter unit being configured to filter the audio input signal to acquire the filtered audio signal depending on the filter information, wherein the filter information determiner is configured to determine the filter information using selecting, depending on the input height information, a selected filter curve from a plurality of filter curves, or wherein the filter information determiner is configured to determine the filter information using determining a modified filter curve by modifying a reference filter curve depending on the elevation information.

2. An apparatus according to claim 1, wherein the filter information determiner is configured to determine the filter information such that the filter unit modifies a first spectral portion of the audio input signal, and such that the filter unit does not modify a second spectral portion of the audio input signal.

3. An apparatus according to claim 1, wherein the filter information determiner is configured to determine the filter information such that the filter unit amplifies a first spectral portion of the audio input signal by a first amplification value, and such that the filter unit amplifies a second spectral portion of the audio input signal by a second amplification value, wherein the first amplification value is different from the second amplification value.

4. An apparatus according to claim 1, wherein the input height information indicates at least one coordinate value of a coordinate of a coordinate system, wherein the coordinate indicates a position of the virtual sound source.

5. An apparatus according to claim 4, wherein the coordinate system is a tree-dimensional Cartesian coordinate system, and the input height information is a coordinate of the three-dimensional Cartesian coordinate system or is a coordinate value of three coordinate values of the coordinate of the three-dimensional Cartesian coordinate system, or wherein the coordinate system is a polar coordinate system, and the input height information is an elevation angle of a polar coordinate of the polar coordinate system.

6. An apparatus according to claim 5, wherein the filter information determiner is configured to determine the filter information using selecting, depending on the input height information, the selected filter curve from the plurality of filter curves, and wherein the input height information is said coordinate value of the three coordinate values of the coordinate of the three-dimensional Coordinate system being an input coordinate value, wherein each filter curve of the plurality of filter curves comprises a coordinate value being assigned to said filter curve, and the filter information determiner is configured to select as the selected filter curve a filter curve from the plurality of filter curves with a smallest absolute difference between the input coordinate value and the coordinate value being assigned to said filter curve among all the plurality of filter curves, or wherein the input height information is the elevation angle being an input elevation angle, wherein each filter curve of the plurality of filter curves comprises an elevation angle being assigned to said filter curve, and the filter information determiner is configured to select as the selected filter curve a filter curve from the plurality of filter curves with a smallest absolute difference between the input elevation angle and the elevation angle being assigned to said filter curve among all the plurality of filter curves.

7. An apparatus according to claim 6, wherein the filter information determiner is configured to amplify the selected filter curve by a determined amplification value to acquire a processed filter curve, or the filter information determiner is configured to attenuate the selected filter curve by a determined attenuation value to acquire the processed filter curve, wherein the filter unit is configured to filter the audio input signal to acquire the filtered audio signal depending on the processed filter curve, and wherein the filter information determiner is configured to determine the determined amplification value or the determined attenuation value depending on a difference between the input coordinate value and the coordinate value being assigned to the selected filter curve, or the filter information determiner is configured to determine the determined amplification value or the determined attenuation value depending on a difference between the elevation angle and the elevation angle being assigned to the selected filter curve.

8. An apparatus according to claim 1, wherein the filter information determiner is configured to determine the filter information using determining the modified filter curve by modifying the reference filter curve depending on the elevation information, and wherein the filter information determiner is configured to amplify the reference filter curve by a determined amplification value to acquire a processed filter curve, or the filter information determiner is configured to attenuate the reference filter curve by a determined attenuation value to acquire the processed filter curve.

9. An apparatus according to claim 1, wherein the filter information determiner is configured to determine the filter information using selecting, depending on the input height information, the selected filter curve from a plurality of filter curves as a first selected filter curve, wherein the filter information determiner is configured to determine the filter information using selecting, depending on the input height information, a second selected filter curve from the plurality of filter curves, and wherein the filter information determiner is configured to determine an interpolated filter curve by interpolating between the first selected filter curve and the second selected filter curve.

10. An apparatus according to claim 1, wherein the filter information determiner is configured to determine the filter information using selecting, depending on the input height information, the selected filter curve from the plurality of filter curves, wherein each of the plurality of filter curves comprises a global maximum or a global minimum between 700 Hz and 2000 Hz, or wherein the filter information determiner is configured to determine the filter information using determining the modified filter curve by modifying the reference filter curve depending on the elevation information, wherein the reference filter comprises a global maximum or a global minimum between 700 Hz and 2000 Hz.

11. An apparatus according to claim 1, wherein the filter information determiner configured to determine filter information depending on the input height information and further depending on input azimuth information, and wherein the filter information determiner is configured to determine the filter information using selecting, depending on the input height information and depending on the input azimuth information, the selected filter curve from the plurality of filter curves, or wherein the filter information determiner is configured to determine the filter information using determining the modified filter curve by modifying the reference filter curve depending on the elevation information and depending on the azimuth information.

12. An apparatus according to claim 1, wherein the filter unit is configured to filter the audio input signal to acquire a binaural audio signal as the filtered audio signal comprising exactly two audio channels depending on the filter information, wherein the filter information determiner is configured to receive input information on an input head-related transfer function, and wherein the filter information determiner is configured to determine the filter information by determining a modified head-related transfer function by modifying the input head-related transfer function depending on the selected filter curve or depending on the modified filter curve.

13. An apparatus according to claim 12, wherein the input head-related transfer function is represented in a spectral domain, wherein the selected filter curve is represented in the spectral domain, or the modified filter curve is represented in the spectral domain, and wherein the filter information determiner is configured to determine the modified head-related transfer function by adding spectral values of the selected filter curve or of the modified filter curve to spectral values of the input head-related transfer function, or the filter information determiner is configured to determine the modified head-related transfer function by multiplying spectral values of the selected filter curve or of the modified filter curve and spectral values of the input head-related transfer function, or the filter information determiner is configured to determine the modified head-related transfer function by subtracting spectral values of the selected filter curve or of the modified filter curve from spectral values of the input head-related transfer function, or by subtracting spectral values of the input head-related transfer function from spectral values of the selected filter curve or of the modified filter curve, or the filter information determiner is configured to determine the modified head-related transfer function by dividing spectral values of the input head-related transfer function by spectral values of the selected filter curve or of the modified filter curve, or by dividing spectral values of the selected filter curve or of the modified filter curve by spectral values of the input head-related transfer function.

14. An apparatus according to claim 12, wherein the input head-related transfer function is represented in a time domain, wherein the selected filter curve is represented in the time domain, or the modified filter curve is represented in the time domain, and wherein the filter information determiner is configured to determine the modified head-related transfer function by convolving the selected filter curve or the modified filter curve and the input head-related transfer function, or wherein the filter information determiner is configured to determine the modified head-related transfer function by filtering the selected filter curve or the modified filter curve with a non-recursive filter structure, or wherein the filter information determiner is configured to determine the modified head-related transfer function by filtering the selected filter curve or the modified filter curve with a recursive filter structure.

15. A system comprising:

an apparatus for generating an filtered audio signal from an audio input signal, wherein the filter unit is configured to filter the audio input signal to acquire a binaural audio signal as the filtered audio signal comprising exactly two audio channels depending on the filter information, wherein the filter information determiner is configured to receive input information on an input head-related transfer function, and wherein the filter information determiner is configured to determine the filter information by determining a modified head-related transfer function by modifying the input head-related transfer function depending on the selected filter curve or depending on the modified filter curve;

an apparatus for providing direction modification information, wherein the apparatus for providing direction modification information comprises:

a plurality of loudspeakers, wherein each of the plurality of loudspeakers is configured to replay a replayed audio signal, wherein a first one of the plurality of loudspeakers is located at a first position at a first height, and wherein second one of the of the plurality of loudspeakers is located at a second position being different from the first position at a second height, being different from the first height, two microphones, each of the two microphones being configured to record a recorded audio signal by receiving sound waves from each loudspeaker of the plurality of loudspeakers emitted by said loudspeaker when replaying the audio signal, a binaural room impulse response determiner being configured to determine a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and a filter curve generator being configured to generate at least one filter curve depending on two of the plurality of binaural room impulse responses, wherein the direction modification information depends on the at least one filter curve, wherein the filter information determiner of the apparatus for generating an filtered audio signal from an audio input signal is configured to determine filter information using selecting, depending on input height information, a selected filter curve from a plurality of filter curves, or wherein the filter information determiner of the apparatus for generating an filtered audio signal from an audio input signal is configured to determine the filter information using determining a modified filter curve by modifying a reference filter curve depending on the elevation information, wherein direction modification information provided by the apparatus for providing direction modification information comprises the plurality of filter curves or the reference filter curve.

16. A system according to claim 15, wherein the filter curve generator of the apparatus for providing direction modification information is configured to acquire two or more filter curves by generating one or more intermediate curves depending on the plurality of binaural room impulse responses, by amplifying each of the one or more intermediate curves by each of a plurality of different attenuation values.

17. A system according to claim 15, wherein the filter curve generator of the apparatus for providing direction modification information is configured to determine a plurality of head-related transfer functions from the plurality of binaural room impulse responses by extracting a head-related transfer function from each of the binaural room impulse responses, wherein the plurality of head-related transfer functions are represented in a spectral domain, wherein a height value is assigned to each of the plurality of head-related transfer functions, wherein the filter curve generator of the apparatus for providing direction modification information is configured to generate two or more filter curves, wherein the filter curve generator of the apparatus for providing direction modification information is configured to generate each of the two or more filter curves by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions, wherein the filter curve generator of the apparatus for providing direction modification information is configured to assign a height value to each of the two or more filter curves by subtracting the height value being assigned to the first one of the plurality of head-related transfer functions from the height value being assigned to the second one of the plurality of head-related transfer functions, and wherein the direction modification information comprises each of the two or more filter curves and the height value being assigned to said filter curve.

18. A system according to claim 15, wherein the filter curve generator of the apparatus for providing direction modification information is configured to determine a plurality of head-related transfer functions from the plurality of binaural room impulse responses by extracting a head-related transfer function from each of the binaural room impulse responses, wherein the plurality of head-related transfer functions are represented in a spectral domain, wherein a height value is assigned to each of the plurality of head-related transfer functions, wherein the filter curve generator of the apparatus for providing direction modification information is configured to generate exactly one filter curve, wherein the filter curve generator of the apparatus for providing direction modification information is configured the exactly one filter curve by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions, wherein the filter curve generator of the apparatus for providing direction modification information is configured to assign a height value to the exactly one filter curve by subtracting the height value being assigned to the first one of the plurality of head-related transfer functions from the height value being assigned to the second one of the plurality of head-related transfer functions, and wherein the direction modification information comprises the exactly one filter curve and the height value being assigned to the exactly one filter curve.

19. An apparatus for providing direction modification information, wherein the apparatus comprises:

a plurality of loudspeakers, wherein each of the plurality of loudspeakers is configured to replay a replayed audio signal, wherein a first one of the plurality of loudspeakers is located at a first position at a first height, and wherein second one of the of the plurality of loudspeakers is located at a second position being different from the first position, at a second height, being different from the first height, two microphones, each of the two microphones being configured to record a recorded audio signal by receiving sound waves from each loudspeaker of the plurality of loudspeakers emitted by said loudspeaker when replaying the audio signal, a binaural room impulse response determiner being configured to determine a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and a filter curve generator being configured to generate at least one filter curve depending on two of the plurality of binaural room impulse responses, wherein the direction modification information depends on the at least one filter curve.

20. An apparatus according to claim 19, wherein the filter curve generator is configured to acquire two or more filter curves by generating one or more intermediate curves depending on the plurality of binaural room impulse responses, by amplifying each of the one or more intermediate curves by each of a plurality of different attenuation values.

21. An apparatus according to claim 19, wherein the filter curve generator is configured to determine a plurality of head-related transfer functions from the plurality of binaural room impulse responses by extracting a head-related transfer function from each of the binaural room impulse responses, wherein the plurality of head-related transfer functions are represented in a spectral domain, wherein a height value is assigned to each of the plurality of head-related transfer functions, wherein the filter curve generator is configured to generate two or more filter curves, wherein the filter curve generator is configured to generate each of the two or more filter curves by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions, wherein the filter curve generator is configured to assign a height value to each of the two or more filter curves by subtracting the height value being assigned to the first one of the plurality of head-related transfer functions from the height value being assigned to the second one of the plurality of head-related transfer functions, and wherein the direction modification information comprises each of the two or more filter curves and the height value being assigned to said filter curve.

22. An apparatus according to claim 19, wherein the filter curve generator is configured to determine a plurality of head-related transfer functions from the plurality of binaural room impulse responses by extracting a head-related transfer function from each of the binaural room impulse responses, wherein the plurality of head-related transfer functions are represented in a spectral domain, wherein a height value is assigned to each of the plurality of head-related transfer functions, wherein the filter curve generator is configured to generate exactly one filter curve, wherein the filter curve generator is configured the exactly one filter curve by subtracting spectral values of a second one of the plurality of head-related transfer functions from spectral values of a first one of the plurality of head-related transfer functions, or by dividing the spectral values of the first one of the plurality of head-related transfer functions by the spectral values of the second one of the plurality of head-related transfer functions, wherein the filter curve generator is configured to assign a height value to the exactly one filter curve by subtracting the height value being assigned to the first one of the plurality of head-related transfer functions from the height value being assigned to the second one of the plurality of head-related transfer functions, and wherein the direction modification information comprises the exactly one filter curve and the height value being assigned to the exactly one filter curve.

23. A method for generating a filtered audio signal from an audio input signal, wherein the method comprises:

determining filter information depending on input height information wherein the input height information depends on a height of a virtual sound source, and filtering the audio input signal to acquire the filtered audio signal depending on the filter information, wherein determining the filter information is conducted using selecting, depending on the input height information, a selected filter curve from a plurality of filter curves, or wherein determining the filter information is conducted using determining a modified filter curve by modifying a reference filter curve depending on the elevation information.

24. A method for providing direction modification information, wherein the method comprises:

for each loudspeaker of a plurality of loudspeakers, replaying a replayed audio signal by said loudspeaker and recording sound waves emitted from said loudspeaker when replaying said replayed audio signal by two microphones to acquire a recorded audio signal for each of the two microphones, wherein a first one of the plurality of loudspeakers is located at a first position at a first height, and wherein second one of the of the plurality of loudspeakers is located at a second position being different from the first position, at a second height, being different from the first height, determining a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and generating at least one filter curve depending on two of the plurality of binaural room impulse responses, wherein the direction modification information depends on the at least one filter curve.

25. A non-transitory digital storage medium having a computer program stored thereon to perform the method for generating a filtered audio signal from an audio input signal, said method comprising:

determining filter information depending on input height information wherein the input height information depends on a height of a virtual sound source, and filtering the audio input signal to acquire the filtered audio signal depending on the filter information, wherein determining the filter information is conducted using selecting, depending on the input height information, a selected filter curve from a plurality of filter curves, or wherein determining the filter information is conducted using determining a modified filter curve by modifying a reference filter curve depending on the elevation information;

when said computer program is run by a computer.

26. A non-transitory digital storage medium having a computer program stored thereon to perform the method for providing direction modification information, said method comprising:

for each loudspeaker of a plurality of loudspeakers, replaying a replayed audio signal by said loudspeaker and recording sound waves emitted from said loudspeaker when replaying said replayed audio signal by two microphones to acquire a recorded audio signal for each of the two microphones, wherein a first one of the plurality of loudspeakers is located at a first position at a first height, and wherein second one of the of the plurality of loudspeakers is located at a second position being different from the first position, at a second height, being different from the first height, determining a plurality of binaural room impulse responses by determining a binaural room impulse response for each loudspeaker of the plurality of loudspeakers depending on the replayed audio signal being replayed by said loudspeaker and depending on each of the recorded audio signals being recorded by each of the two microphones when said replayed audio signal is replayed by said loudspeaker, and generating at least one filter curve depending on two of the plurality of binaural room impulse responses, wherein the direction modification information depends on the at least one filter curve;

when said computer program is run by a computer.

* * * * *